US007707779B2

(12) United States Patent
Petta et al.

(10) Patent No.: US 7,707,779 B2
(45) Date of Patent: May 4, 2010

(54) FRAME ASSEMBLY FOR WINDOW WITH VERTICALLY SLIDING SASH

(75) Inventors: Gabriel Petta, Woodbridge (CA); Rolf J. Ohrstrom, Toronto (CA)

(73) Assignee: Alpa Lumber Inc., Mississauga (CA)

( * ) Notice: Subject to any disclaimer, the term of this patent is extended or adjusted under 35 U.S.C. 154(b) by 1257 days.

(21) Appl. No.: 11/229,839

(22) Filed: Sep. 20, 2005

(65) Prior Publication Data

US 2006/0059780 A1 Mar. 23, 2006

Related U.S. Application Data

(60) Provisional application No. 60/610,976, filed on Sep. 20, 2004.

(51) Int. Cl.
*E06B 1/04* (2006.01)

(52) U.S. Cl. ..... 49/504; 49/463; 49/453; 49/125; 49/408; 49/404; 52/204.51

(58) Field of Classification Search ..... 52/204.51; 49/458, 459, 414, 417, 428, 431, 436, 501, 49/504

See application file for complete search history.

(56) References Cited

U.S. PATENT DOCUMENTS

| | | | | | |
|---|---|---|---|---|---|
| 1,543,334 | A | | 6/1925 | Loeb | |
| 1,765,442 | A | * | 6/1930 | Paitl | 49/472 |
| 2,304,062 | A | * | 12/1942 | Peremi et al. | 49/438 |
| 2,608,277 | A | * | 8/1952 | Storms | 49/438 |
| 2,776,737 | A | | 1/1957 | Bianco | |
| 3,090,085 | A | | 5/1963 | Brown | |
| 3,172,169 | A | * | 3/1965 | Anderson | 49/446 |
| 3,208,564 | A | | 9/1965 | Sitterly | |
| 3,214,873 | A | * | 11/1965 | Davis | 52/513 |
| 3,336,698 | A | | 8/1967 | MacGregor | |
| 3,451,168 | A | | 6/1969 | Pengelly | |
| 3,491,486 | A | | 1/1970 | Caruth | |
| 3,861,444 | A | | 1/1975 | Portwood | |
| 4,040,219 | A | | 8/1977 | Budich | |
| 4,114,317 | A | | 9/1978 | Crawley | |

(Continued)

FOREIGN PATENT DOCUMENTS

| | | |
|---|---|---|
| CA | 1307165 | 9/1992 |

(Continued)

OTHER PUBLICATIONS

USPTO. U.S. Appl. No. 10/811,154. Office Action Mailed Feb. 16, 2007.

(Continued)

*Primary Examiner*—David Dunn
*Assistant Examiner*—Joshua Ihezie
(74) *Attorney, Agent, or Firm*—Bereskin & Parr LLP/S.E.N.C.R. L.,s.r.l.

(57) ABSTRACT

A frame assembly for a window including a sash that slides vertically within a master frame. The master frame is substantially of unitary, one-piece construction that can advantageously be manufactured by an injection moulding process. The sash frame can also be of unitary, one-piece construction, and can also be manufactured by injection moulding. The master frame can be provided with liner support structures along the jambs to receive jamb liners in snap-fit. The liner support structures can advantageously be integrally moulded with the master frame.

14 Claims, 61 Drawing Sheets

U.S. PATENT DOCUMENTS

| | | | | | |
|---|---|---|---|---|---|
| 4,314,598 | A | * | 2/1982 | Roesch | 160/90 |
| 4,554,770 | A | | 11/1985 | Anders | |
| 4,604,840 | A | | 8/1986 | Mondon | |
| 4,610,472 | A | | 9/1986 | Billingsley | |
| 4,621,478 | A | | 11/1986 | Phillips et al. | |
| 4,674,246 | A | * | 6/1987 | Giguere | 52/204.51 |
| 4,742,647 | A | | 5/1988 | Pacca | |
| 4,754,592 | A | | 7/1988 | Moench | |
| 4,799,332 | A | | 1/1989 | Haas | |
| 4,803,808 | A | | 2/1989 | Greisner | |
| 4,809,469 | A | | 3/1989 | Klein | |
| 4,815,246 | A | | 3/1989 | Haas | |
| 4,890,418 | A | | 1/1990 | Sachs | |
| 4,996,814 | A | | 3/1991 | Guillemet | |
| 5,099,624 | A | | 3/1992 | Valentin | |
| 5,118,145 | A | | 6/1992 | Tucker | |
| 5,189,837 | A | | 3/1993 | Ienaga | |
| 5,189,841 | A | | 3/1993 | Arbetter | |
| 5,280,686 | A | | 1/1994 | Davies | |
| 5,315,798 | A | | 5/1994 | Zarwell | |
| 5,321,911 | A | * | 6/1994 | Dickinson | 49/404 |
| 5,355,626 | A | | 10/1994 | Sachs | |
| 5,379,518 | A | | 1/1995 | Hopper | |
| 5,522,191 | A | | 6/1996 | Wenner et al. | |
| 5,553,420 | A | | 9/1996 | Klimek | |
| 5,555,684 | A | * | 9/1996 | Galowitz et al. | 52/204.5 |
| 5,560,154 | A | * | 10/1996 | Matarazzo | 49/484.1 |
| 5,678,366 | A | | 10/1997 | Nambo et al. | |
| 5,687,519 | A | * | 11/1997 | Bruchu | 52/213 |
| 5,692,349 | A | | 12/1997 | Guillemet | |
| 5,729,942 | A | * | 3/1998 | Moore, Jr. | 52/437 |
| 5,839,234 | A | | 11/1998 | Mayer | |
| 5,934,031 | A | * | 8/1999 | deNormand | 52/204.5 |
| 5,987,826 | A | | 11/1999 | Petta | |
| 6,047,514 | A | | 4/2000 | Verch | |
| 6,073,412 | A | | 6/2000 | Verch | |
| 6,109,668 | A | | 8/2000 | Demarco | |
| 6,135,511 | A | | 10/2000 | Smith et al. | |
| 6,173,541 | B1 | | 1/2001 | Petta | |
| 6,243,999 | B1 | * | 6/2001 | Silverman | 52/204.51 |
| 6,311,439 | B1 | | 11/2001 | Arcati et al. | |
| 6,431,620 | B2 | | 8/2002 | Tremblay et al. | |
| 6,749,797 | B2 | | 6/2004 | Kownacki et al. | |
| 6,904,727 | B2 | | 6/2005 | Edger | |
| 2002/0124494 | A1 | | 9/2002 | Zen | |
| 2003/0079414 | A1 | * | 5/2003 | Rangabasyam et al. | 49/395 |

FOREIGN PATENT DOCUMENTS

| | | |
|---|---|---|
| CA | 2008484 | 10/1995 |
| CA | 2164252 | 6/1997 |
| CA | 2260070 | 1/1998 |
| CA | 2276746 | 7/1998 |
| CA | 2245078 | 2/1999 |
| CA | 2241680 | 12/1999 |
| CA | 2306503 | 3/2000 |
| CA | 2292094 | 6/2000 |
| CA | 2314793 | 1/2002 |
| CA | 2274025 | 6/2004 |
| GB | 2252586 | 8/1992 |
| WO | WO 93/11332 | 6/1993 |

OTHER PUBLICATIONS

USPTO. U.S. Appl. No. 10/811,154. Office Action Mailed Oct. 10, 2007.

USPTO. U.S. Appl. No. 10/811,154. Office Action Mailed Jul. 26, 2007.

USPTO. U.S. Appl. No. 10/811,154. Office Action Mailed Apr. 15, 2008.

USPTO. U.S. Appl. No. 10/811,154. Office Action Mailed Sep. 2, 2008.

* cited by examiner

FRAME ASSEMBLY FOR WINDOW WITH VERTICALLY SLIDING SASH

This application claims the benefit under 35 USC 119(e) of U.S. Provisional Application No. 60/610,976, which was filed on Sep. 20, 2004, and the entire contents of which are hereby incorporated by reference.

FIELD OF THE INVENTION

This invention relates to an improved frame assembly for windows.

BACKGROUND OF THE INVENTION

A common style of window construction has a first framed pane of glass (the sash) mounted within a larger frame (herein referred to for convenience as the master frame) in such a way that the sash is slidable between open and closed positions within the master frame. Typically, adjacent horizontal members of the sash frame and master frame are provided with slidably engaging tongue-and-groove style projections and recesses to define and support the sliding movement of the sash within the master frame. By adjusting the dimensions of the sash frame and master frame, this construction can also be used to provide doors, such as sliding patio doors.

A known technique for constructing frame assemblies for windows or doors is to extrude sections of aluminum or vinyl having a desired cross-sectional profile for the various vertical and horizontal members of the frames. The extrusions are then cut to length, and then assembled to form a separate master frame and sash frame. An example of known extrusion profiles for constructing window frames can be seen in U.S. Pat. No. 4,621,478 (Phillips et al.).

Another frame construction for a sliding window is disclosed in U.S. patent application Ser. No. 09/735,498, having Publication No. US 2002/0124494(Zen). This frame construction has a two-piece master frame, between which a sash frame is sandwiched. The sash comprises two injection molded halves which are secured together with fasteners. The assembled sash is positioned between two halves of the master frame, each of which are also separate, injection molded elements, secured together with fasteners.

The construction techniques described above can be relatively time-consuming and costly. Also, if the assembly is improperly performed, problems with the function or appearance of the product may result. Accordingly, it may be advantageous to provide a frame assembly for a window or door wherein the master frame and sash frame are each integrally molded, one-piece structures.

SUMMARY OF THE INVENTION

The present invention provides a frame assembly for a sliding window or patio door, in which the frame assembly includes an integrally moulded unitary master frame having upper and lower horizontal members, and opposed first and second vertical jamb members extending between the horizontal members. An integrally moulded unitary sash frame is slidably mounted within the master frame.

In one embodiment, the frame assembly includes a mullion integrally moulded with the master frame, the mullion extending contiguously from, and vertically between, the upper and lower horizontal members, at a position between the first and second vertical jamb members. The master frame and the sash frame have inter-engaging channels and projections for supporting the sash frame within the master frame.

The projections and channels are integrally moulded with the respective sash frame and master frame. More particularly, the upper and lower horizontal members of the master frame are provided with vertically projecting tongues, and the upper and lower horizontal members of the sash frame are provided with grooves shaped to receive the tongues in sliding engagement.

The present invention also provides an injection moulded frame assembly for a sliding window or door that is reversible. The frame assembly has a master frame and sash frame slidably supported within the master frame. At least the master frame can be installed in either one of a first position or a second position that is generally inverted (rotated 180 degrees in a vertical place) relative to the first position. In another embodiment, both the master frame and sash frame are inverted to provide the first and second positions. An interlacing configuration can be provided on two opposite horizontal or vertical frame elements to provide a gap between the sash frame and master frame for installation and removal of the sash frame within the master frame. Duplicate attachment elements can be provided for attaching gliders or other space-taking support elements for selectively filling the gap along one of the opposing frame elements.

In another aspect of the invention, a frame assembly for a window or patio door is provided with a weather buffering chamber across one or more flow paths between interior and exterior sides of the frame assembly and through which water or air may try to penetrate from the exterior to the interior side of the assembly. The weather buffering chamber can have an exterior seal with a first pressure gradient, and an interior seal with a second pressure gradient, the first and second pressure gradients being portions of the total pressure gradient across the two sides or faces of the assembly. The weather buffering chamber can be independently drained relative to any drains for water that may penetrate to the interior face of the assembly.

In another aspect of the invention, a sealed valve element is provided for draining water that may have penetrated to the interior face of the assembly. The sealed valve element can inhibit the suction of air from the exterior face to the interior face of the assembly.

In another aspect, the present invention provides a frame assembly for a window or door that has integrally moulded attachment elements for attaching gliders, locks, handles, seal elements including weatherstripping, in press fit or snap fit arrangements. A break-away panel can be provided to seal off duplicate attachment elements that may be provided for a reversible frame assembly.

In another aspect, the present invention provides a frame assembly for a window having a sash that slides vertically within a master frame. The master frame is substantially of unitary, one-piece construction that can advantageously be manufactured by an injection moulding process. The sash frame can also be of unitary, one-piece construction, and can also be manufactured by injection moulding. The master frame can be provided with liner support structures along the jambs to receive jamb liners in shamp fit. The liner support structures can advantageously be integrally moulded with the master frame.

BRIEF DESCRIPTION OF THE DRAWINGS

For a better understanding of the present invention and to show more clearly how it would be carried into effect, reference will now be made by way of example, to the accompanying drawings that show a preferred embodiment of the present invention, and in which.

DETAILED DESCRIPTION OF THE INVENTION

Figure 1:
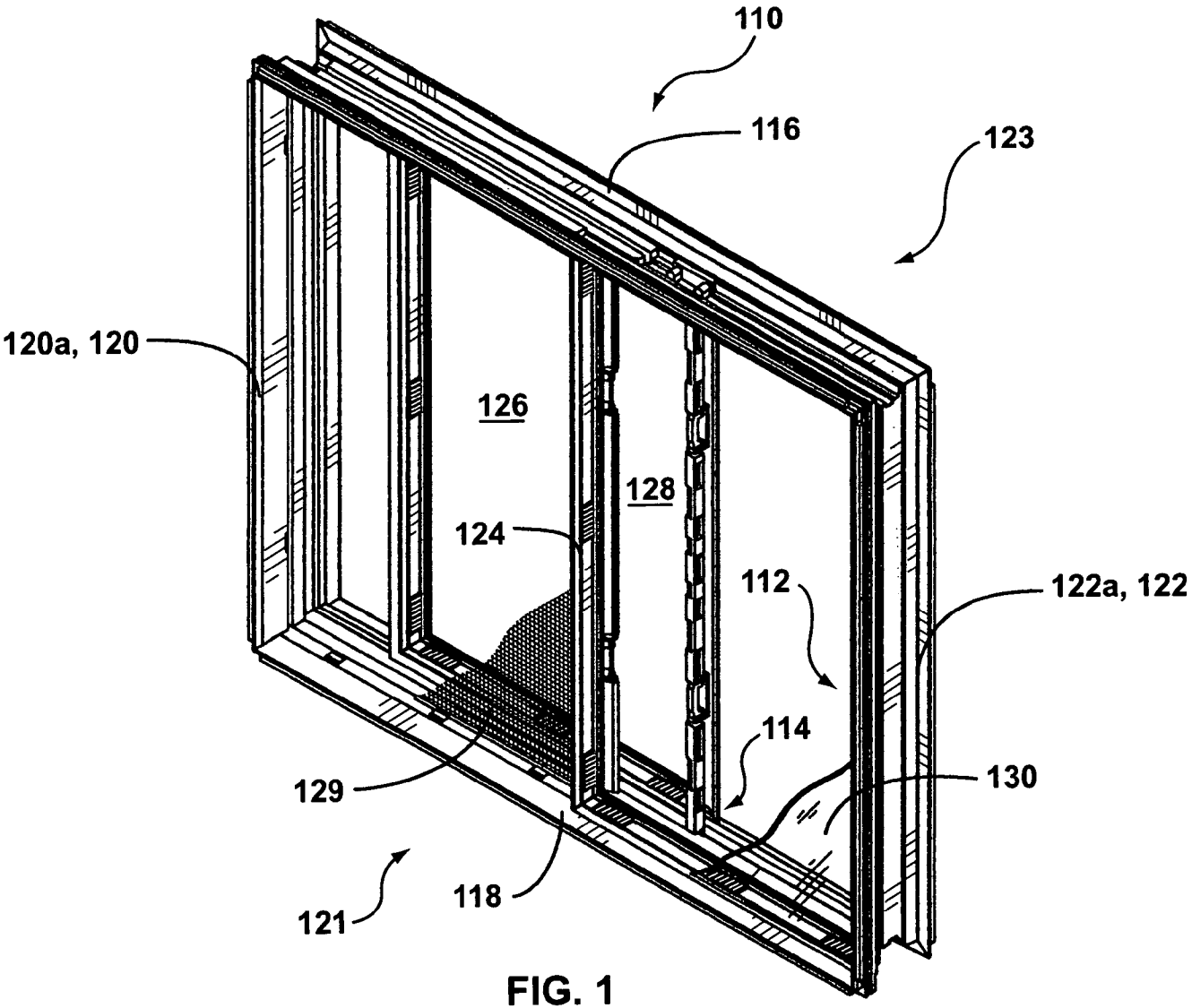
FIG. 1 is a perspective view of a frame assembly according to one embodiment of the present invention, looking at the exterior face.

A frame assembly for a window or door according to the present invention is shown generally at 110 in FIG. 1. The frame assembly 110 has a master frame 112 and a sash frame 114, which is slidably mounted within the master frame 112.

The master frame 112 is generally rectangular, having upper and lower horizontal members 116 and 118, respectively. Vertical side members 120*a* and 122*a* extend between the upper and lower horizontal members 116 and 118, at either side of the master frame 112. The upper and lower horizontal members of the master frame 112 are commonly referred to as the header 116 and sill 118, respectively.

Aspects of the present invention generally provide a frame assembly having a slidable sash mounted in a master frame. Embodiments of the invention can provide horizontally or vertically slidable sash frames within respective master frames. For the purposes of illustration, in the embodiment illustrated in FIG. 1, the frame assembly 110 is a horizontal slider in which the sash frame 114 slides horizontally between the vertical side members 120*a* and 122*a*. The master frame 112 has a third vertical member defined as a mullion 124, which extends between the header 116 and sill 118, at a point approximately midway between the vertical side members 120*a* and 122*a*. The mullion 124 divides the master frame 112 into a vent side 126, extending between the vertical side member 120*a* and the mullion 124, and a fixed side 128, extending between the vertical side member 122*a* and the mullion 124 (see also FIG. 4). The vertical side members 120*a*, 122*a* are conveniently referred to as the vent side jamb 120 and the fixed side jamb 122, respectively.

Figure 3:
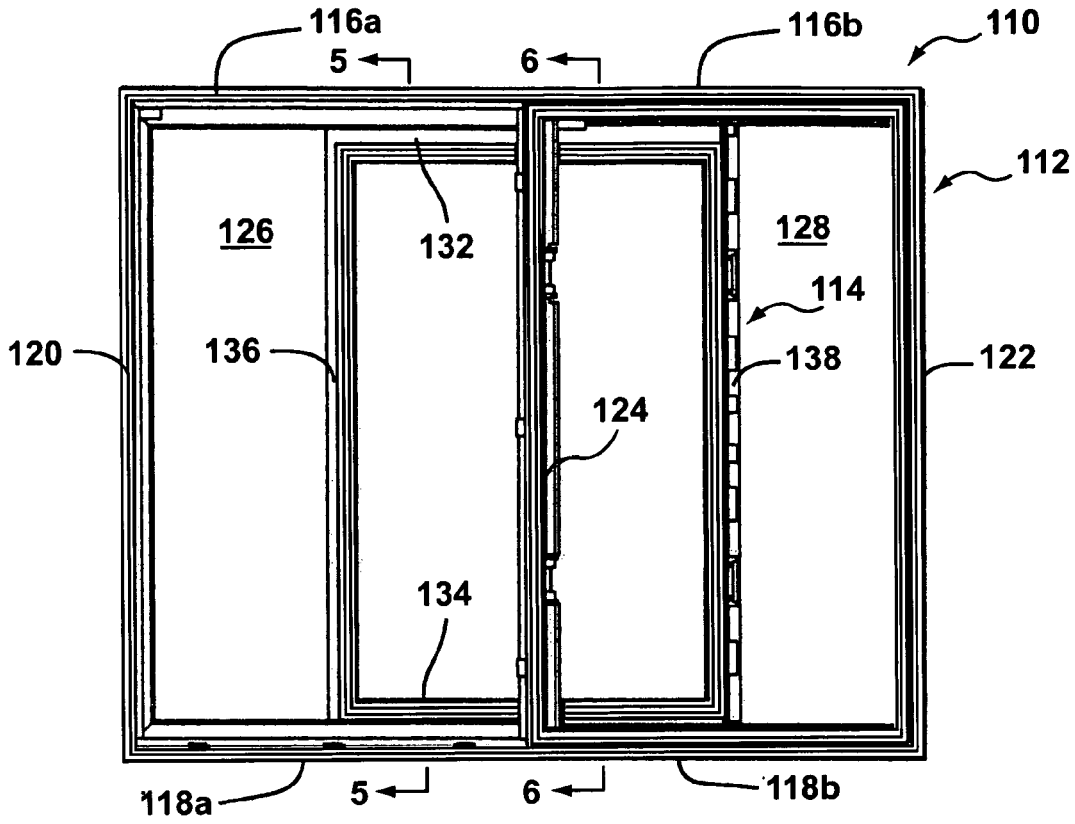
FIG. 3 is a front view of the frame assembly shown in FIG. 1, with the sash frame positioned between open and closed positions.

The sash frame 114 is slidable within the master frame 112 between fully open and fully closed positions. In the fully open position, the vertical member 136 of the sash frame 114 is generally positioned behind the mullion 124, and the check rail 138 generally abuts (or nearly abuts) the fixed side jamb 122. In the fully closed position (FIG. 4), the vertical member 136 abuts (and generally sealingly engages) the vent side jamb 120, and the check rail 138 abuts (and generally sealingly engages) the mullion 124. The sash frame 114 can also be moved to any one of an infinite number of partially open positions between the fully closed and fully open positions. In any of the partially open positions, the vertical member 136 of the sash frame is generally spaced apart from the vent side jamb 120, between the vent side jamb 120 and the mullion 124 of the master frame 112 (FIG. 3). When in an open position (partially open or fully open), air can flow through the vent side 126 of the master frame 112, between the exterior and interior faces 121 and 123 of the assembly 110. Air flow between the exterior and interior faces 121 and 123 is generally prevented when the sash frame 114 is in the fully closed position.

In the frame assembly 110, glazing 130 can be set directly into the fixed side 128 of the master frame 112. A screen element 129 can be provided in the vent side 126 of the master frame 112. Details of how the glazing 130 and screen element 129 may be mounted in the frame assembly 110 are provided hereinafter.

The frame assembly 110 has an exterior face 121 which would typically be exposed to the elements, and an interior face 123 opposite the exterior face 121. The glazing 130 and screen element 129 are positioned towards the exterior face 121 of the frame assembly 110, and the sash frame 114 is mounted interiorly of the glazing 130 and screen 129.

The master frame 112 of the frame assembly 110 is of one-piece, integrally moulded construction, devoid of any seams or joint lines between contiguous vertical and horizontal members 116, 118, 120, 122, and 124. In the embodiment illustrated, the members of the master frame 112 are advantageously provided with geometrical configurations which can facilitate manufacturing the master frame by a moulding process, such as, for example, but not limited to, injection moulding. More particularly, the geometrical configurations of the vertical and horizontal members of the master frame 112 have, in cross-section, a generally uniform wall thickness, and an orientation which permits ejection of the master frame 112 from a mould. The master frame 112 can be constructed of a suitable plastic material.

Figure 2:
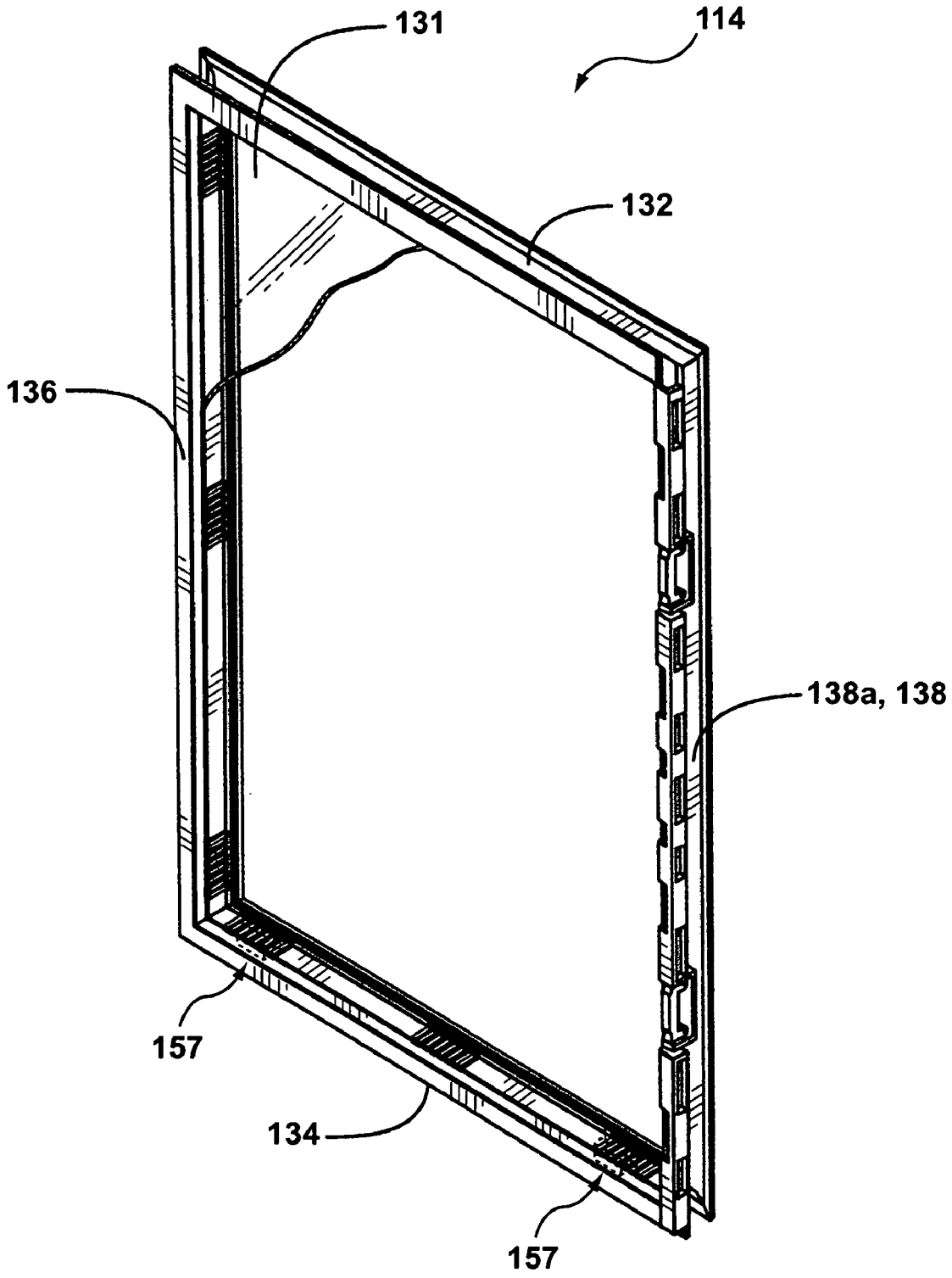
FIG. 2 is a perspective view of a sash frame shown in FIG. 1.

Referring to FIG. 2, the sash frame 114 is also of one-piece, integrally moulded construction. The sash frame 114 is rectangular in shape, having upper and lower horizontal members 132 and 134, respectively. Vertical side members 136 and 138*a* extend between the horizontal members 132 and 134 at either side of the sash 114. The vertical side member 138*a* is also called the check rail 138. Like the master frame 112, the geometrical configurations of the vertical and horizontal members of the sash frame 114 have, in cross-section, a generally uniform wall thickness, and an orientation which permits ejection of the master frame 114 from a mould, and the master frame 114 can be constructed of a suitable plastic material. In the frame assembly 110, glazing 131 can be set into the sash frame 114, in a manner described in further detail hereinafter.

Figure 4:
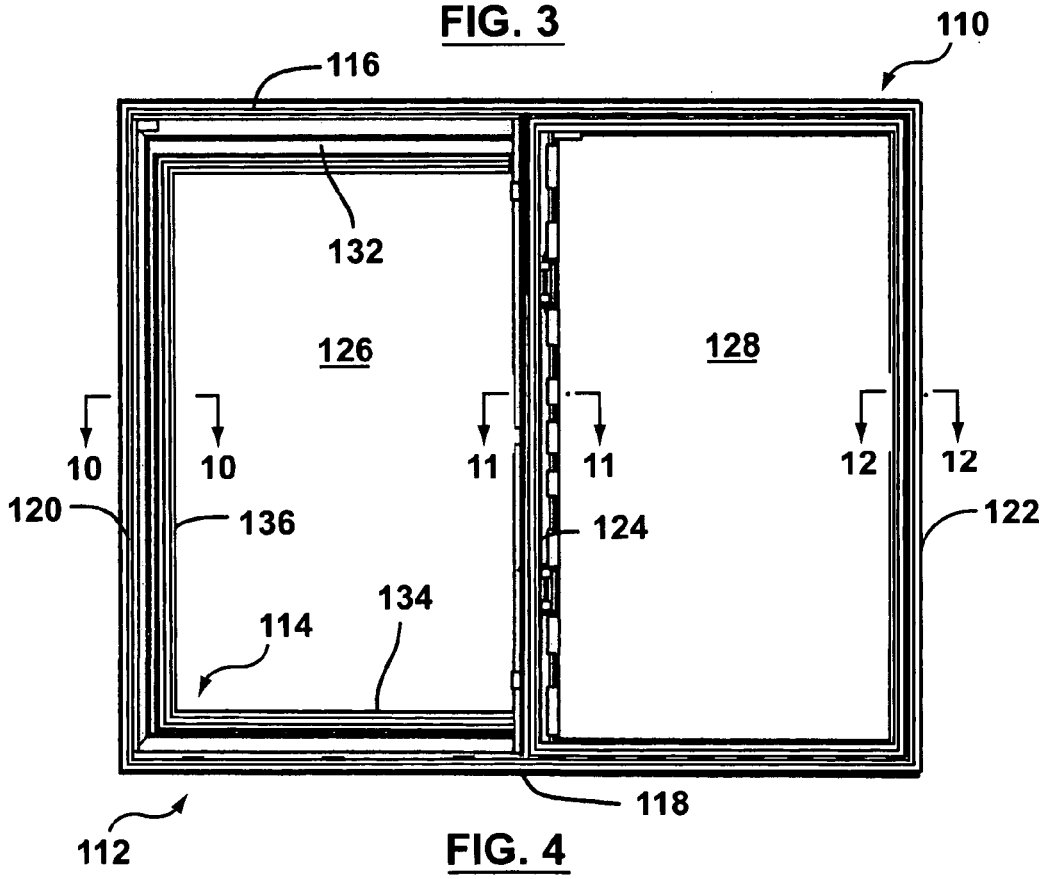
FIG. 4 is a front view of the frame assembly shown in FIG. 1, with the sash frame in the closed position.

Front views of the exterior face 121 of the frame assembly 110 can be seen in FIGS. 3 and 4. In FIG. 3, the sash frame 114 is shown in an intermediate position, between the vent side jamb 120 and fixed side jamb 122. In FIG. 4, the sash frame 114 is shown in the closed position, in which the vertical member 136 of the sash frame 114 generally abuts the vent side jamb 120 of the master frame 112.

As best seen in FIG. 3, in the embodiment illustrated, the sill 118 has a first portion 118*a* generally provided along the vent side 126 of the master frame 112, and a second portion 118*b* generally provided along the fixed side 128 of the master frame 112. As well, the header 116 has first and second portions 116*a*, 116*b* generally provided along the vent and fixed sides 126, 128 of the master frame 112, respectively. The first portions 116*a*, 118*a* are contiguous with the respective second portions 116*b*, 118*b* but have some differences in cross-sectional profile, as described below.

Figure 5:
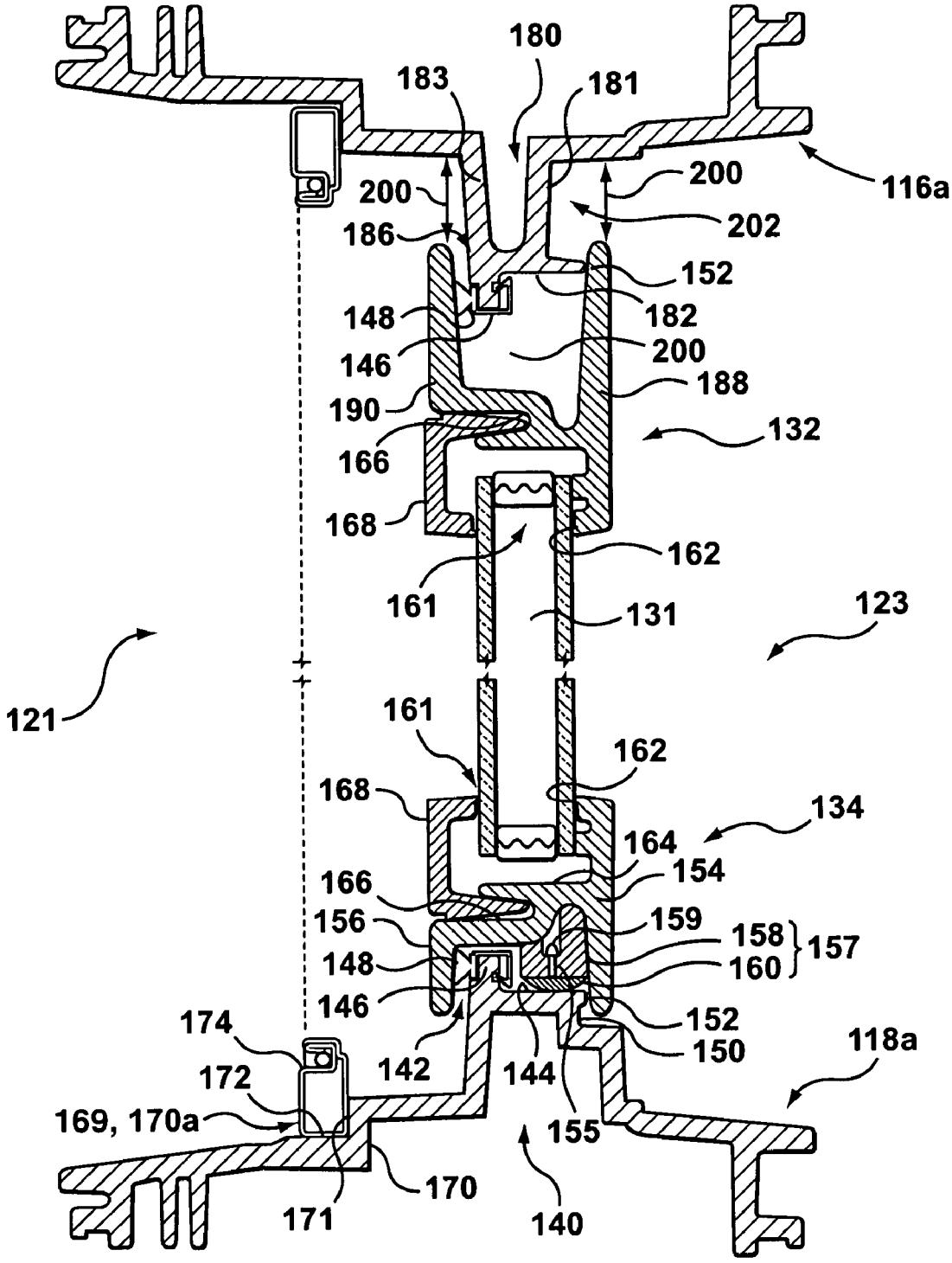
FIG. 5 is a vertical section of the frame assembly shown in FIG. 3 taken along the line 5-5.
Figure 6:
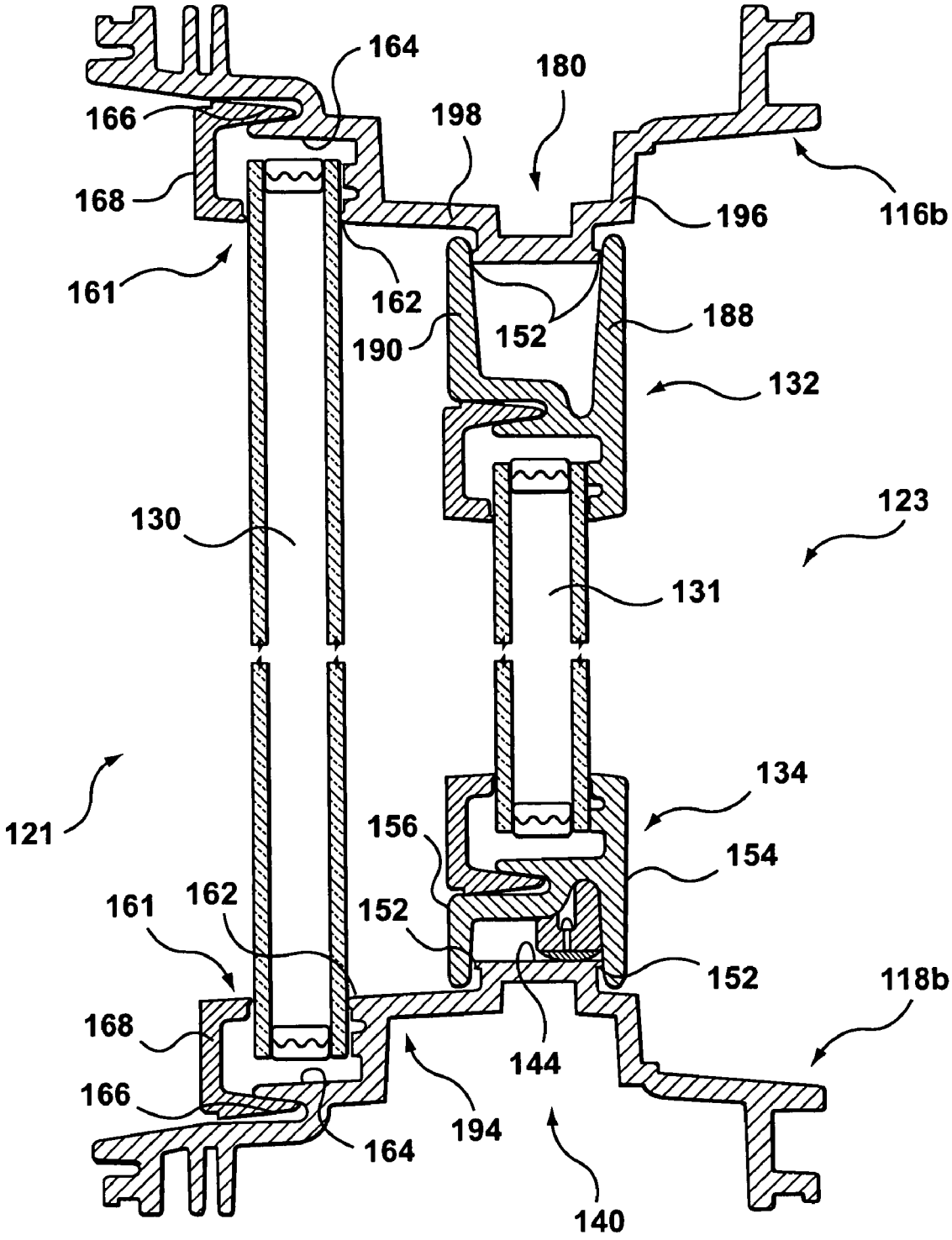
FIG. 6 is a vertical section of the frame assembly shown in FIG. 3 taken along the line 6-6.

As best seen in FIGS. 5 and 6, in the illustrated embodiment of the frame assembly 110 the first and second portions of the horizontal members of the master frame 112 and sash frame 114 are provided with channels and projections to slidably retain the sash frame 114 within the master frame 112.

Referring to FIG. 5, which shows a cross-section of the frame assembly 110 taken along the line 5-5 of FIG. 3, the first portion 118*a* of the sill 118 has a generally upwardly directed projection or tongue 140, which is received within a downwardly directed channel or groove 142 provided in the lower horizontal member 134 of the sash frame 114. The tongue 140 has a generally flat upper surface or runner 144 along which the sash frame 114 glides. A vertically projecting strip mount 146 extends along the runner 144, along the edge nearest the exterior face 121 of the master frame 112, for supporting a length of weather-stripping 148 in a snap-on arrangement. Opposite the strip mount 146, the runner 144 of the tongue 140 has a step 150 which is undercut, providing a horizontally projecting nub 152 for laterally stabilizing the sash frame 114, as further described hereinafter.

The groove 142 of the lower horizontal member 134 of the sash frame 114 is disposed between interior and exterior sidewall portions 154 and 156 of the lower horizontal member 134 of the sash frame 114. The sidewall portions 154 and 156 extend downward past the nub 152 and weather-stripping 148, respectively, to support the sash 114 above the sill 118 in a lateral direction.

A glider 157, comprising a glider housing 158 and gliding element 160, is provided within the groove 142 at either end of the lower horizontal member 134 (see also FIG. 2). In the embodiment illustrated, the glider housing 158 is advantageously integrally moulded with the sash frame 114, and positioned adjacent the interior sidewall portion 154 of the lower horizontal member 134. The glider housing 154 has recesses 155 which are shaped to receive attachment fingers 159 extending from the gliding element. When assembled, the gliding element 160 bears against the runner 144 of the tongue 140 to slidably support the sash frame 114 above the sill 118 of the master frame 112.

Figure 16A:
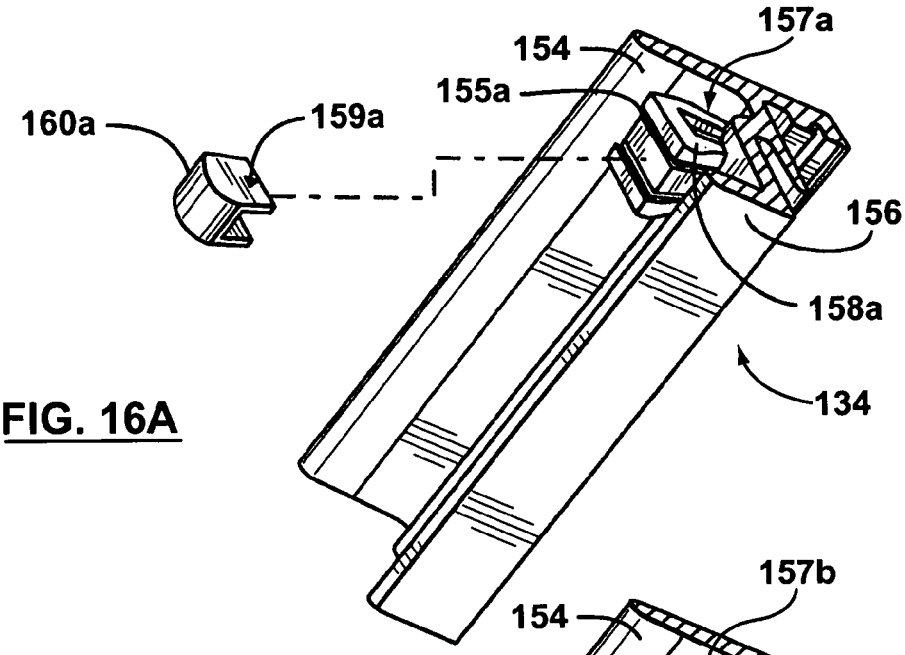
FIGS. 16*a*, 16*b*, and 16*c* are perspective views of alternate embodiments of gliders provided in the sash frame of FIG. 2.
Figure 16B:
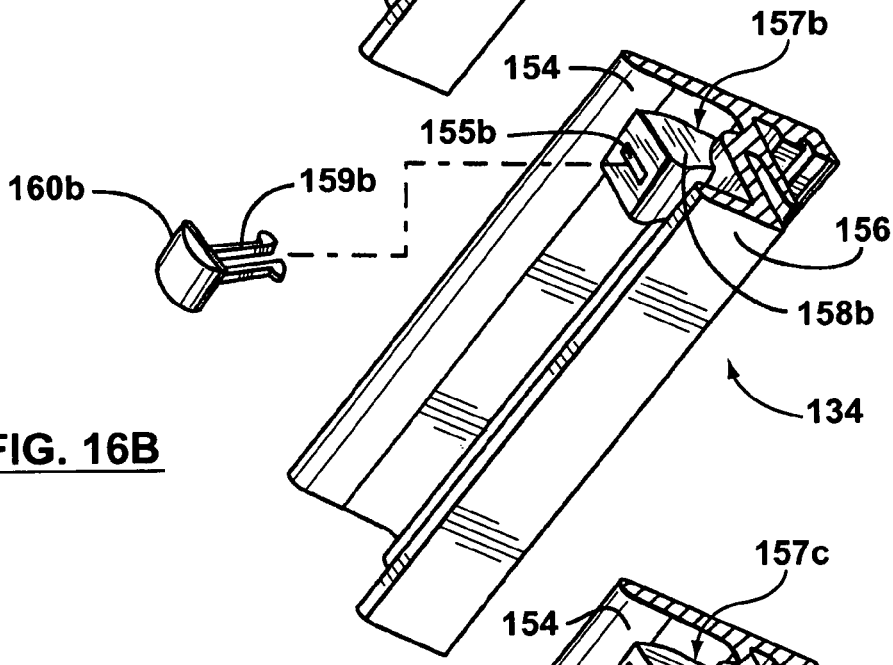
Figure 16C:
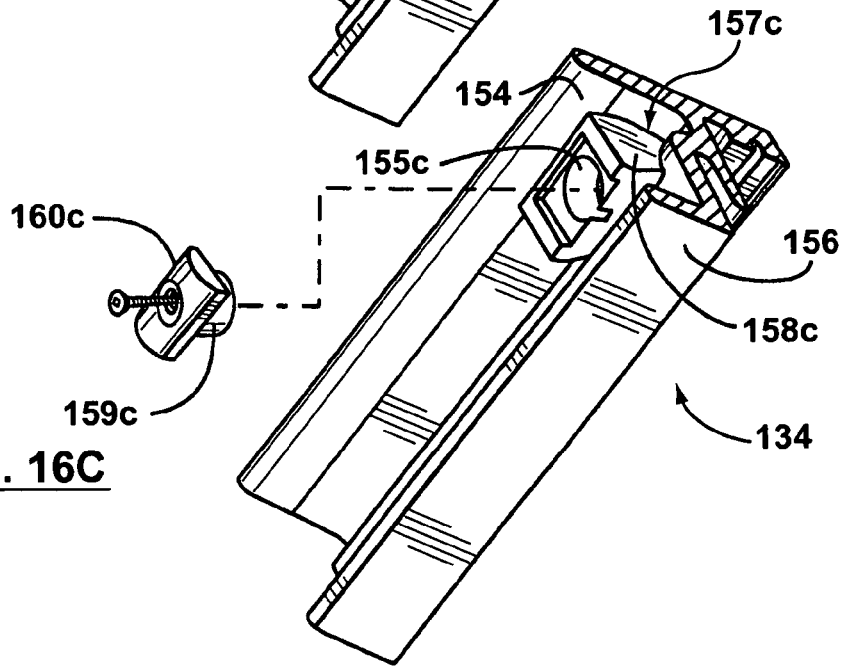

Referring to FIGS. 16*a*, 16*b*, and 16*c*, details of alternative gliders 157*a*, 157*b*, and 157*c*, respectively, can be seen. In each case, the glider housing 158*a*, 158*b*, 158*c* projects generally vertically from the inner surface of the groove, between the sidewalls 154 and 156. Each housing 158*a*, 158*b*, 158*c* is adapted to receive the corresponding glider element 160*a*, 160*b*, 160*c*, generally by having a recess 155*a*, 155*b*, 155*c* which is shaped to receive attachment fingers 159*a*, 159*b*, 159*c* extending from the glider element 160*a*, 160*b*, 160*c*. The attachment between fingers 159 and recesses 155 may be secured by a snap-fit arrangement (157*a*, 157*b*) or by a separate fastener (157*c*).

Figure 15:
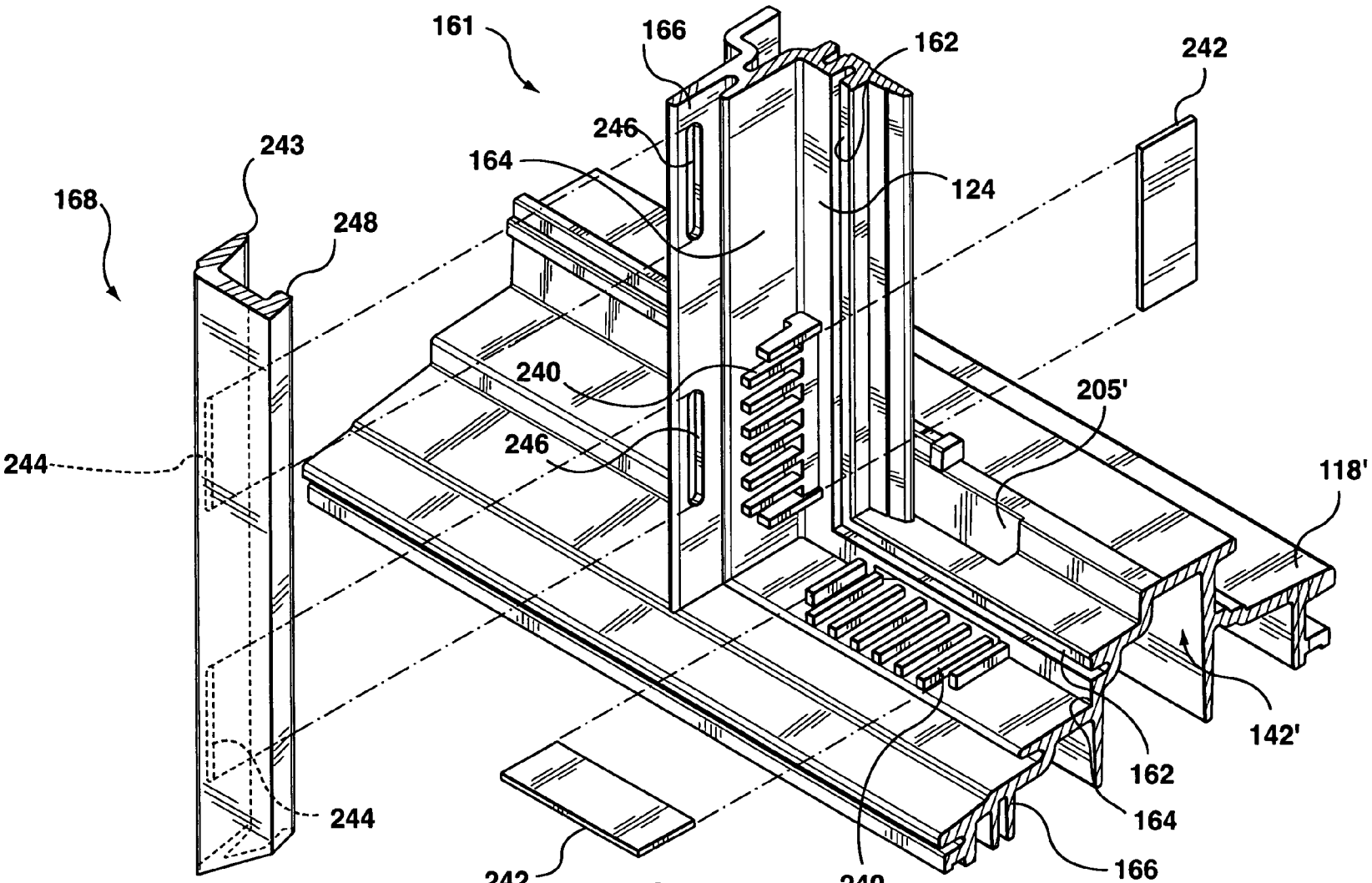
FIG. 15 is a perspective view of a portion of the frame assembly shown in FIG. 13*a;*

As seen in FIG. 5, the lower horizontal member 134 of the sash frame 114 may also be advantageously provided with integrally moulded glazing support features 161 to support the glazing 131 set in the sash frame 114. The glazing support features 161 can include a backstop surface 162 for supporting the interior surface of the glazing 131. The backstop surface 162 can be formed along a portion of the interior sidewall 154 extending vertically away from the groove 142. Furthermore, a generally planar support surface 164 is provided to extend adjacent an edge of the glazing 131 (below the lower edge of the glazing 131 in FIG. 5). The planar support surface can be used to frictionally support the glazing 131 within the sash frame 114, by means of setting block housings 240 and setting blocks 242 (as seen in FIG. 15 with respect to the glazing 130), described further hereinafter.

As well, the integrally moulded glazing support features can include an attachment recess 166 provided opposite the glazing support surface 164 and directed towards the exterior face 121 of the frame assembly 110. The attachment recess 166 is shaped to receive a length of glass stop 168, which bears against an exterior surface of the glazing 131. Further details of the glazing support features 161 are described hereinafter.

In the first portion 118*a* of the sill 118, screen-mounting details 170*a* can also be provided. In the embodiment illustrated, the screen mounting details 170*a* include a screen support step 170, providing in a generally vertical plane an abutment surface 171 against which the frame 174 of a screen 129 can be positioned. The screen mounting details 17*a* further include horizontal support surfaces 172 provided adjacent the vertical face 171, to support the screen 129 vertically.

Referring again to FIG. 5, details of the upper horizontal members 116 and 132 of the master frame 112 and sash frame 114 will now be described. The first portion 116*a* of the header 116 has a generally downwardly directed tongue 180 having a generally flat lower surface 182. In a similar arrangement as for the tongue 140, a strip mount 146 (to which a length of weather-stripping 148 may be attached) projects vertically from the surface 182, adjacent the end nearest the exterior face 121 of the frame assembly 110. A nub 152 extends horizontally from the surface 182, opposite the strip mount 146.

The upper horizontal member 132 of the sash frame 114 is provided with a channel or groove 186 which is directed upwardly and extends between generally vertical interior and exterior sidewall portions 188, 190, respectively, of the upper horizontal member 132. The interior sidewall portion 188 extends upwardly beyond the nub 152 of the tongue 180, and the exterior sidewall portion 190 extends upwardly beyond the strip mount 146 and the weather-stripping 148. Accordingly, the sidewalls 188, 190 of the groove straddle the horizontally outermost elements 152, 148, respectively, of the tongue 180, thereby providing lateral support for the sash frame 114.

Furthermore, the upper horizontal member 132 of the sash frame 114 can be advantageously provided with glazing support features 161 to support glazing 131 set within the sash frame 114. This includes the backstop surface 162, planar support surface 164, attachment recess 166, and glass stop 168, similar to those provided for the lower horizontal member 134.

Referring to FIG. 6, showing a section along the lines 6-6 of the FIG. 3, the second portion 118*b* and 116*b* of the sill 118 and header 116 will now be described. The second portion 118*b* of the sill 118 also comprises the tongue 140, having the runner 144, as provided in the first portion 118*a*. In other words, the runner 144 extends generally continuously across the master frame 112, from the vent side jamb 120 to the fixed side jamb 122. The width of the runner 144 of the sill profile 118*b* extends between nubs 152 provided at its edges facing both the interior face 123 and exterior face 121 of the frame assembly 110.

Towards the exterior face 121 of the frame assembly 110, the sill second portion 118*b* of the sill 118 is provided with integrally moulded glazing support features 161. The support features 161 again include the back stop surface 162, planar support surface 164, and attachment recess 166 for receiving a length of glass stop 168.

The second portion 116*b* of the header 116 includes the tongue 180, projecting downwardly from the header 116. The strip mount 146 and the weather-stripping 148 are generally not required along the header second portion 116*b*, and can be replaced by a second nub 152, extending towards the exterior face 121. The opposed nubs 152 are positioned between the interior and exterior sidewall portions 188 and 190 of the upper horizontal member 132 of the sash frame 114, providing lateral support for the sash frame 114.

Above the sidewall portions 188 and 190 of the horizontal member 132, and extending outwardly from the tongue 180, are interior and exterior shoulders 196, 198, respectively. The shoulders 196, 198 prevent the sash frame 114 from being lifted up, thereby ensuring that the groove 142 of the lower horizontal member 134 of the sash frame 114 remains properly engaged with the tongue 140 of the sill 118. Further details concerning lift-up of the sash frame 114 will be provided hereinafter.

Adjacent the exterior shoulder 198 and towards the exterior face 121, the header second portion 116*b* is provided with glazing support details 161 for supporting the fixed glazing 130. The glazing support details 161 again comprise the backstop surface 162, planar support surface 164, and the attachment recess 166 for receiving a length of glass stop 168.

Referring again to FIG. 5, vertical clearance 200 is provided between staggered surfaces of the header first portion 116*a* and the upper horizontal member 132 of the sash frame 114. More specifically, the vertical clearance 200 is provided between the surface of the header 116 and the adjacent upper ends of the interior and exterior sidewall portions 188, 190 of the upper horizontal member 132. As well, the vertical clearance 200 is provided between the base of the groove 186 and the lower-most extending portion (in this embodiment, the weather-stripping 148) of the tongue 180. The vertical clearance 200 is provided to permit lift-up of the sash frame 114 within the master frame 112, thereby facilitating installation and removal of the sash frame 114.

To provide the vertical clearance 200, in the illustrated embodiment of the frame assembly 110 the profile of the header 116 of the master frame 112 has a sash frame interlacing configuration 202 along at least a portion of the length of the header 116. The sash frame interlacing configuration 202 has a longitudinal extent along the length of the header 116 that is at least as long as the length of the upper horizontal member of the sash frame 114. The sash frame interlacing configuration 202 comprises channels and projections in the header 116 that match with corresponding projections and channels in the upper horizontal member 132 of the sash frame 114 to laterally support the sash frame 114 slidably within the master frame 112, while also providing the vertical clearance 200 for lift-out of the sash frame 114.

In the embodiment illustrated, the sash frame interlacing configuration 202 of the header 116, includes the tongue 180 having downwardly projecting exterior and interior sidewalls 181, 183, respectively, which are spaced sufficiently narrowly apart to fit within the sidewalls 188, 190 of the groove 186. No shoulders or other surfaces extend outward from the tongue sidewalls 181, 183 to interfere with lift-up of the upper edges of the groove sidewalls 188, 190. Furthermore, the extent to which the tongue 180 projects vertically from the header 116 is sufficiently short to fit substantially within the hollow depth of the groove 186.

Figure 7:
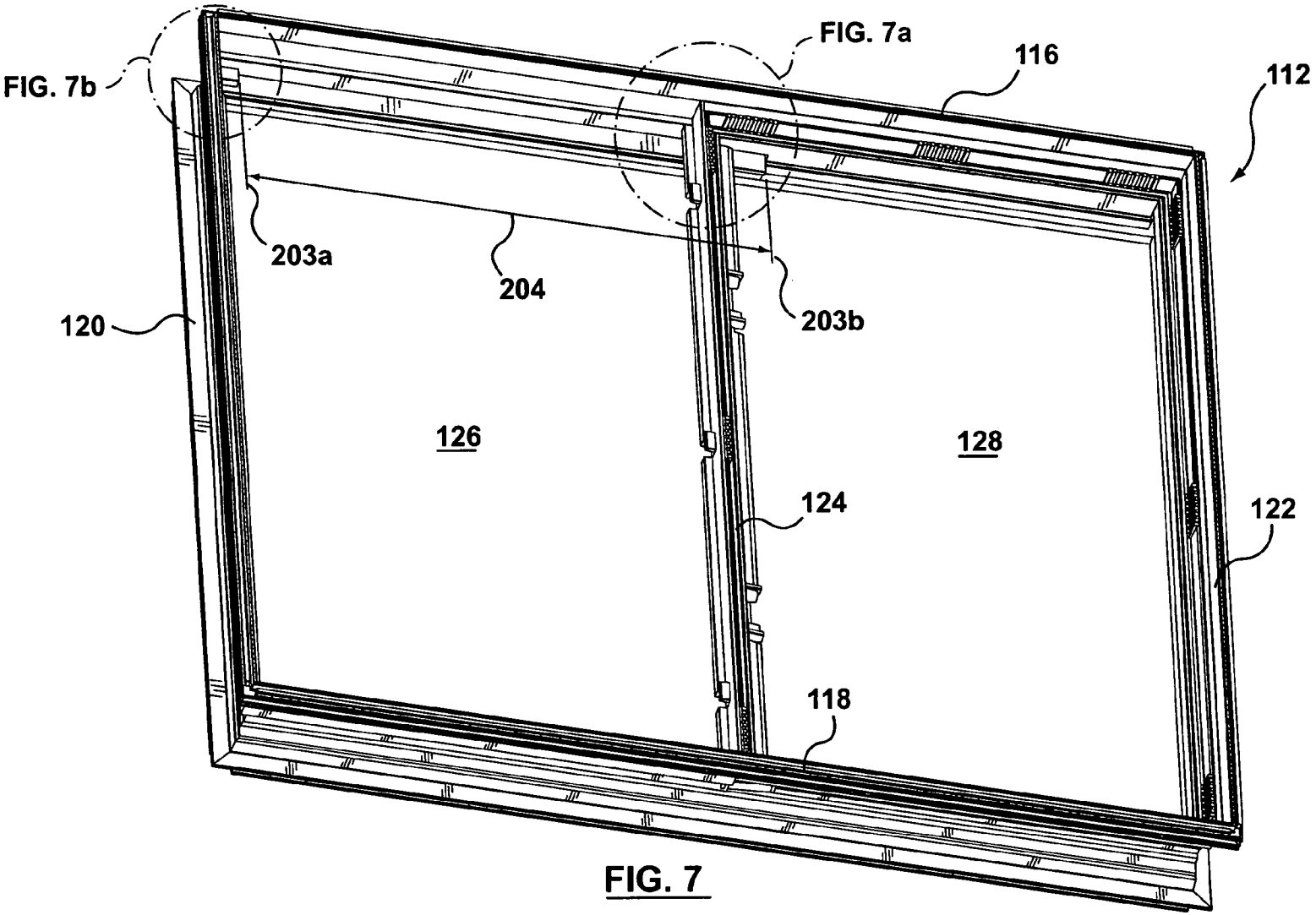
FIG. 7 shows the frame assembly of FIG. 1 viewed from a different, lower angle.
Figure 8:
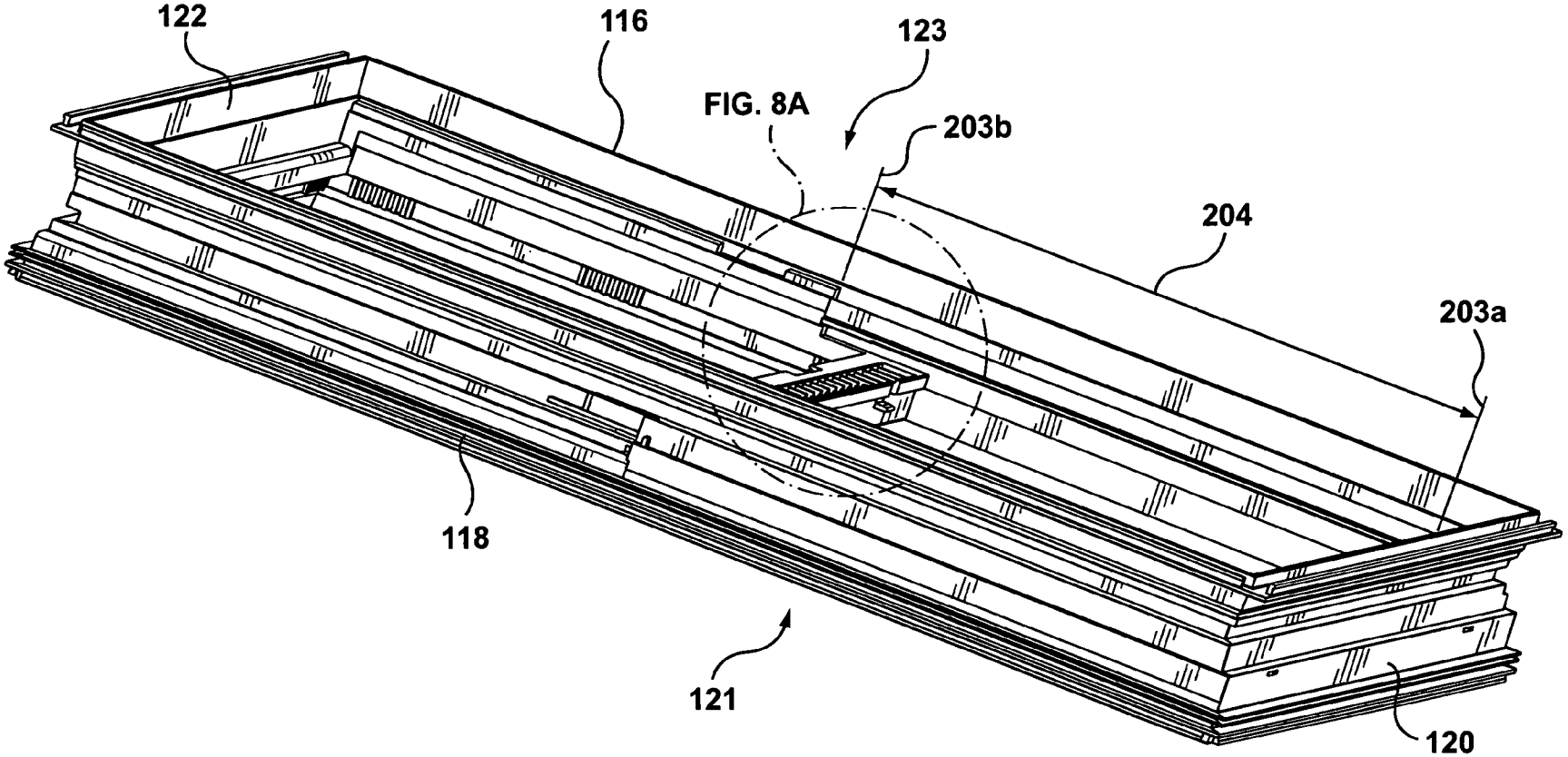
FIG. 8 is a perspective view of the frame assembly shown in FIG. 1, but viewed from below, and looking towards the opposite (interior) face of the frame assembly.

The sash frame interlacing configuration 202 need not be provided along the entire length of the header 116, but may advantageously be provided along only a portion thereof. In the embodiment illustrated, the sash frame interlacing configuration 202 is provided along only a portion of the header 116 that extends a length which is just slightly longer than the length of the upper horizontal member 132 of the sash frame 114. The portion of the header 116 along which the sash frame interlacing configuration 202 (and hence, vertical clearance 200) is provided defines a lift position 204 (see FIG. 7) with which the sash frame 114 must be aligned in order for lifting of the sash frame 114 to be possible (FIGS. 7 and 8). In the embodiment illustrated, the sash frame interlacing configuration 202 extends from a first end 203*a* on the header 116 adjacent the vent side jam 120 of the master frame 112, to a second end 203*b* along the header 116 which is above the fixed side 128 of the master frame 112. In particular, the sash frame interlacing configuration 202 of the header 116 extends behind (when viewed from the exterior face 121 of the frame assembly 110) the mullion 124, crossing from the vent side 126 to the fixed side 128 of the master frame 112.

Figure 7A:
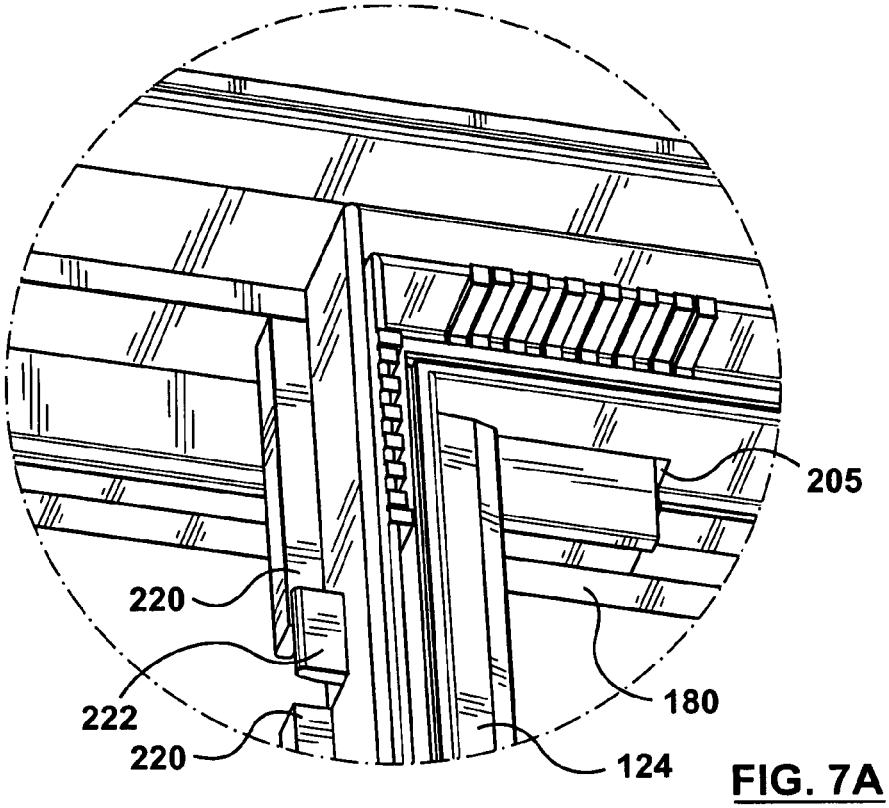
FIG. 7*a* is an enlarged view of a portion of the frame assembly shown in FIG. 7.
Figure 8A:
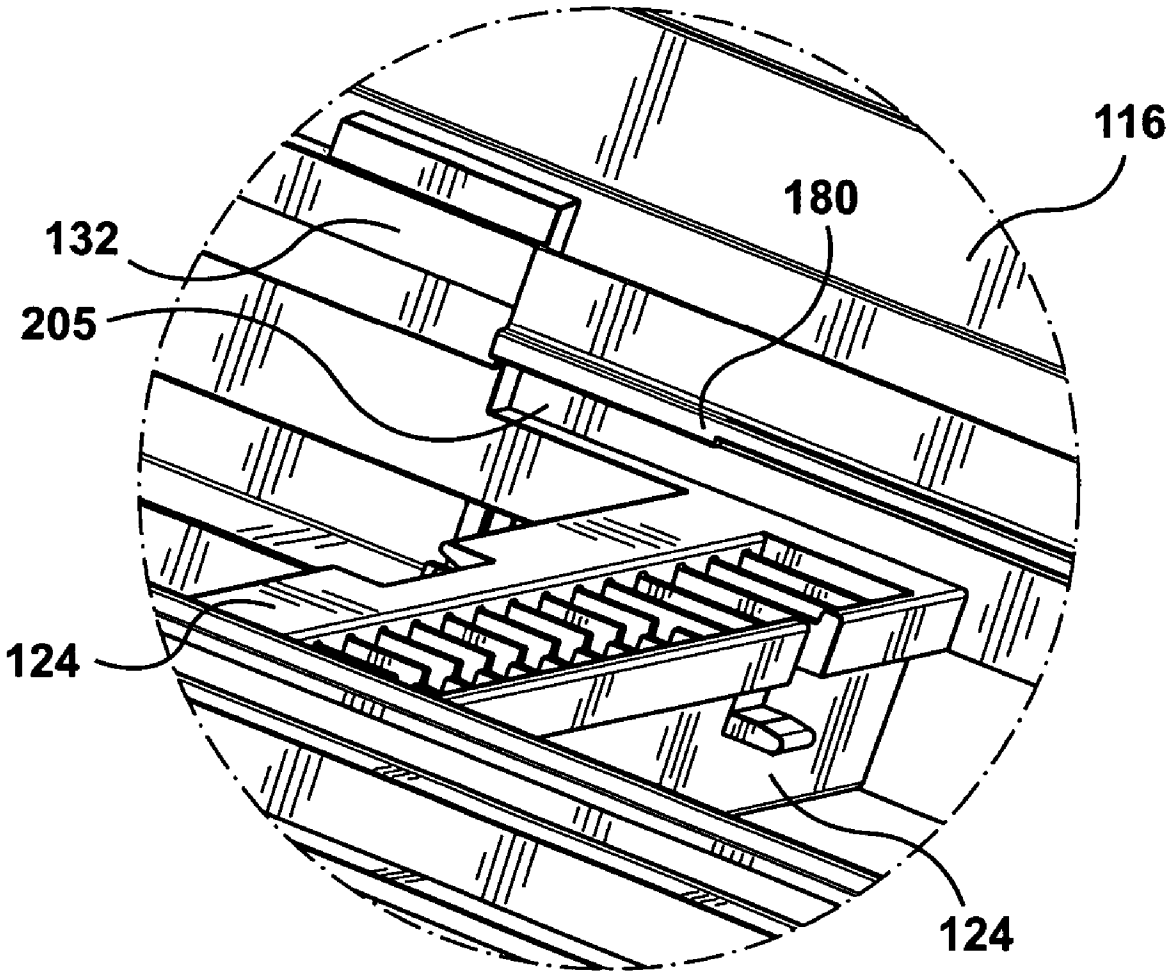
FIG. 8*a* is an enlarged portion of the frame assembly shown in FIG. 8.

To extend the sash frame interlacing configuration 202 behind the mullion 124, a recess or cavity 205 can be provided in the header 116 between the mullion 124 and the tongue 180 (FIGS. 7*a* and 8*a*). The present invention comprehends that providing the cavity 205 may not be in the line-of-draw with respect to a traditional moulding process. Accordingly, a slide or lift detail may be required in the die to mould this feature.

Between the second end 203*b* of the sash frame interlacing configuration 202 and the fixed side jamb 122 of the master frame 112, the header 116 is generally provided with the header profile 116*b* (as best seen in FIG. 6). Accordingly, the sash frame interlacing configuration 202 (and vertical clearance 200) is not provided along this portion of the header 116, since the shoulders 196 and 198 extend outwardly from the tongue 180 at a position directly above the upper ends of the sidewalls 188 and 190 of the upper horizontal member 132 of the sash frame 114.

Figure 7B:
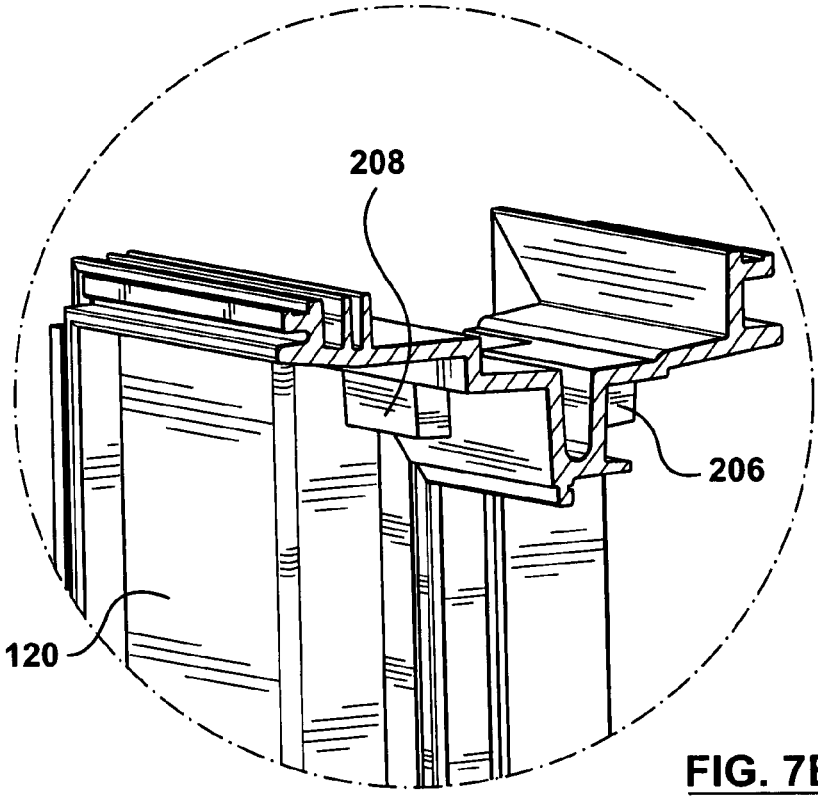
FIG. 7*b* is an enlarged view of another portion of the frame assembly shown in FIG. 7.

Between the first end 203*a* of the sash frame interlacing configuration 202 and the vent side jamb 120 of the master frame 112, integrally moulded interior and exterior shoulders 206, 208 can be provided (as best seen in FIG. 7*b*). Accordingly, the sash frame 114 cannot be lifted when any portion of the upper horizontal member 132 of the sash frame is in vertical alignment with the shoulders 206, 208. This can provide enhanced protection or security of the frame assembly 110, particularly when closed, and can also facilitate alignment of the sash frame 114 with the vent side jam 120 when sliding the sash frame 114 to the closed position.

Figure 9C:
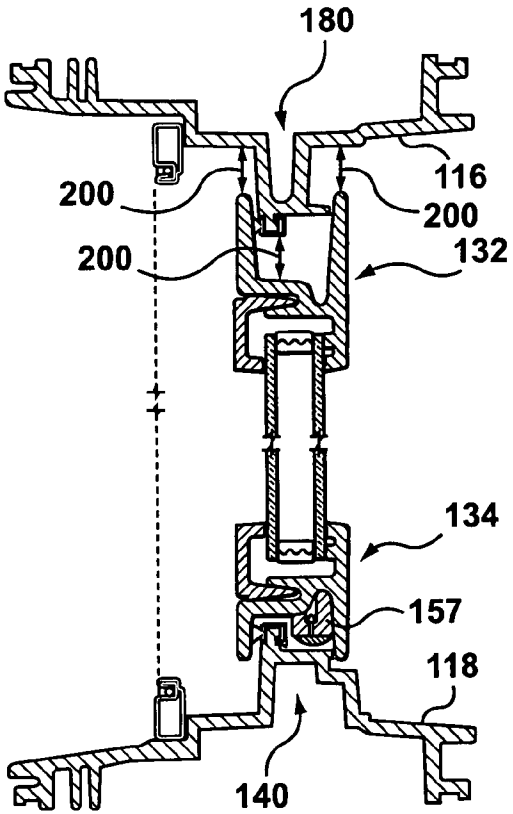
FIGS. 9*a*, 9*b*, and 9*c* are vertical section views of the frame assembly of FIG. 1 showing first second, and third positions, respectively, of the sash frame during installation into the master frame.

In use, to install the sash frame 114 in the master frame 112, the sash frame 114 is positioned adjacent the interior surface 123 of the frame assembly 110, and the upper horizontal member 132 of the sash frame 114 is aligned with the lift position 204, between the ends 203*a* and 203*b* of the interlacing configuration 202. The lower horizontal member 134 of the sash frame 114 is tilted away from the master frame 112, and the groove 186 can then be aligned with the tongue 180 of the header 116 (FIG. 9*a*).

Figure 9B:
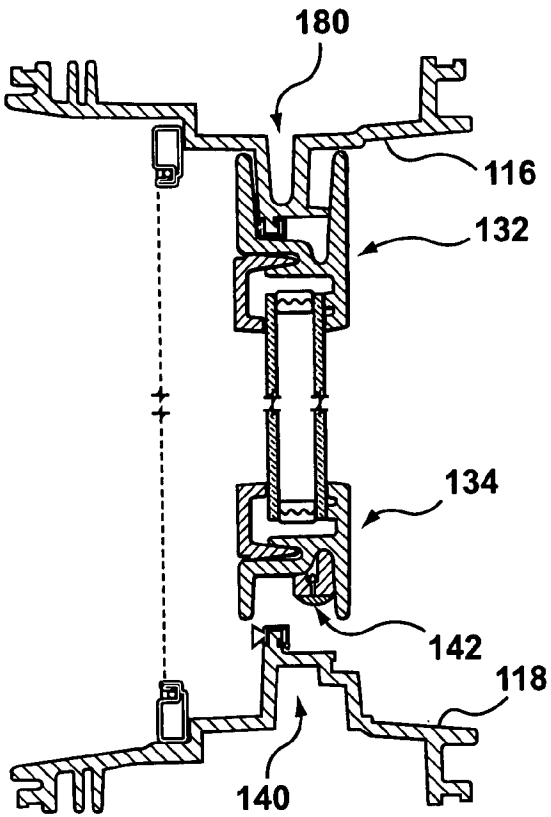
Figure 9A:
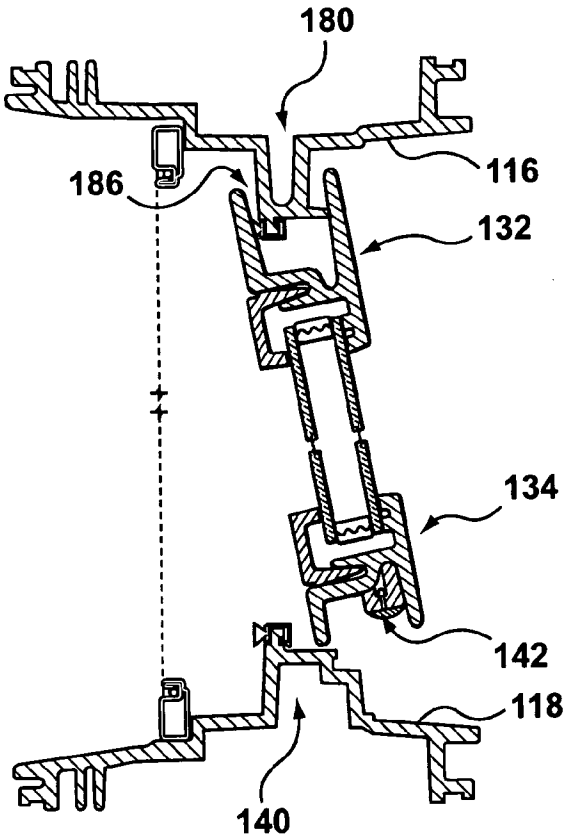

The sash frame 114 can then be lifted up, so that the vertical clearance 200 is occupied by the various elements of the tongue 180 and groove 186, and the lower horizontal member 134 of the sash frame 114 may then be swung over the tongue 140 of the sill 118, so that the groove 142 of the lower horizontal member 134 is aligned with the tongue 140 (FIG. 9*b*).

The sash frame 114 may then be lowered, until the glider 157 engages the runner 144 of the tongue 140 (FIG. 9*c*). At this point the sash frame 114 is in its operating position, and is free to slide back and forth along the sill 118.

Removal of the sash frame 114 from the master frame 112 is substantially the reverse operation. It will be understood that, to initiate the procedure, the sash frame 114 must first be aligned with the lift position 204, between the ends 203*a* and 203*b* of the interlacing configuration 202.

Figure 10:
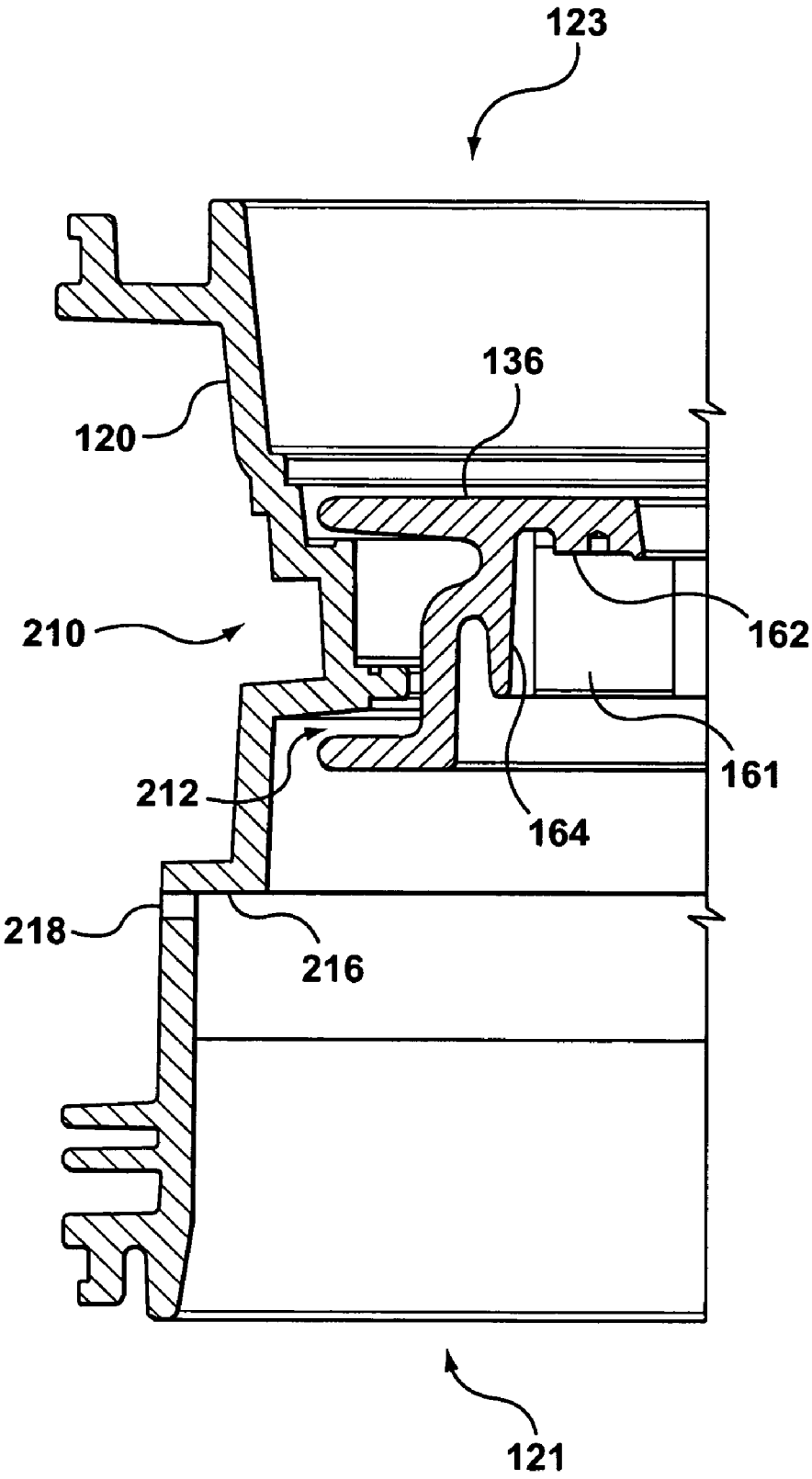
FIG. 10 is a horizontal section of the frame assembly shown in FIG. 4 taken along the line 10-10.

Additional members of the master frame 112 and sash frame 114 will now be described. Referring to FIG. 10 (section 10-10 of FIG. 4), the profiles of the vent side jam 120 of the master frame 112 and the vertical member 136 of the sash frame 114 are provided with vertically elongate channels and projections which co-operate to provide a generally weatherproof seal when the sash frame 114 is slid to the closed position. In particular, the vent side jam 120 has a projection or tongue 210 which is directed towards the mullion 124 and is shaped to be received in a channel or groove 212 provided in the vertical member 136 of the sash frame 114.

Between the tongue 210 and the exterior face 121 of the frame assembly 110, the vent side jam 120 may advantageously be provided with screen support details 169. In the embodiment illustrated, a step is positioned along the profile 120, providing a vertical surface 216 against which the frame 174 of a screen element 129 can bear. Furthermore, an aperture 218 is provided adjacent the step, for receiving a plunger or clip for retaining the screen 129 in the master frame 112.

Opposite the groove 212, the vertical member 136 of the sash frame 114 may be advantageously provided with integrally moulded glazing support features 161, for supporting the sash glazing 131. In the embodiment illustrated, the glazing support details 161 comprise the back stop surface 162, planar support surface 164, and the attachment recess 166 for receiving a length of glass stop 168.

Figure 11:
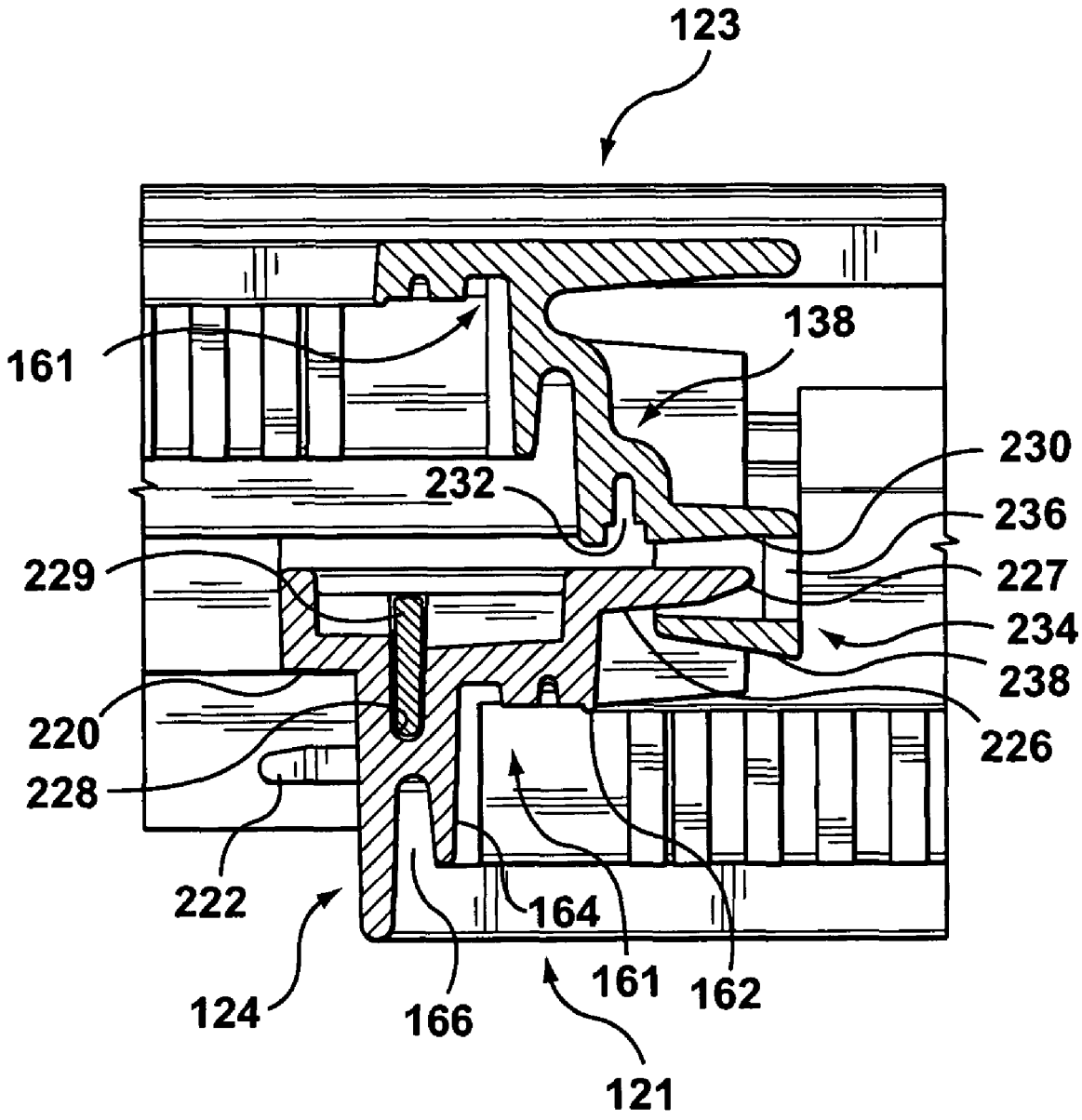
FIG. 11 is a horizontal section of the frame assembly shown in FIG. 4 taken along the line 11-11.

The cross-sectional profiles of the mullion 124 and check rail 138 can best be seen in FIG. 11, which shows a section of the frame assembly 110 taken along the line 11-11 of FIG. 4. Towards the exterior face 121 of the frame assembly 110, and adjacent the vent side 126, the mullion 124 can be advantageously provided with integrally moulded screen support features. These features can include a vertical abutment surface 220, and a series of retaining lugs 222 extending parallel to but spaced away from the vertical plane of the abutment surface 220 (see also FIG. 7*a*).

Also adjacent the front face 121 of the frame assembly 110, but directed towards the fixed side 128 of the master frame 112, the mullion 124 may be provided with integrally moulded glazing support features 161 for supporting the fixed glazing 130. The glazing support features 161 comprise the back stop surface 162, planar support surface 164, and the attachment recess 166 for receiving a length of glass stop 168 (not illustrated).

The mullion 124 further comprises an engagement flange 226. The engagement flange 226 extends from the mullion 124 opposite the back stop surface 162, and parallel to the direction along which the sash frame 114 can slide within the master frame 112.

A reinforcement recess 228 may optionally be provided in the mullion 124, for receiving metal reinforcement bars 229 or the like, which may be desired to limit the maximum deflection of the mullion 124. In the embodiment illustrated, a reinforcement recess 228 is provided in the mullion 124, opposite the attachment recess 166.

Figure 11A:
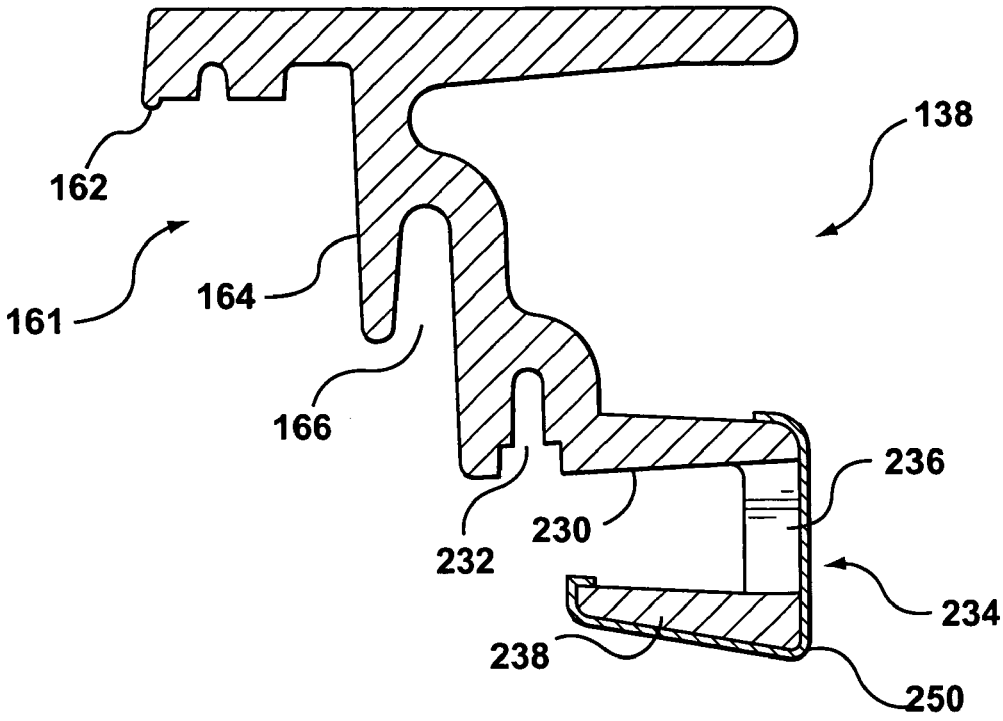
FIG. 11*a* is an enlarged view of the check rail shown in FIG. 11.

The cross-sectional profile of the check rail 138 of the sash frame 114 can also best be seen in FIG. 11 and in FIG. 11*a*. The check rail 138 is adapted to provide secure, sealed engagement with the mullion 124 when the sash frame 114 is slid to the closed position. In the embodiment illustrated, the check rail 138 is provided with a seal surface 230 which is aligned opposite to, and spaced slightly away from the engagement flange 226 of the mullion 124. The seal surface 230 is provided with a seal recess 232, which is shaped to receive a length of weather-stripping (not shown) in a press-fit arrangement. The weather-stripping can bear against the engaged flange 226 to provide a generally weather tight seal between the check rail 138 and the mullion 124 when the sash 114 is in the closed position.

A return bracket 234 extends from the seal surface 230 so as to engage the engagement flange 226 of the mullion 124. In particular, in the embodiment illustrated, the return bracket 234 has an offset portion 236 which extends from the seal surface 230 in a direction towards the exterior face 121 of the frame assembly 110, and at a position spaced slightly away from the terminal vertical edge 227 of the engagement flange 226 when the sash frame 114 is in the closed position. A catch portion 238 extends from the offset portion 236 in a direction towards the mullion 124, and, for the embodiment illustrated, in generally parallel alignment with the engagement flange 226.

Accordingly, when the sash 114 is in the closed position, the return bracket 234 provides a mechanical coupling between the check rail 138 and the mullion 124 in a direction perpendicular to the sliding operation of the sash frame 114. Forces such as, for example, wind loads that may tend to push the sash frame 114 laterally towards the interior face 123 of the assembly 110 are counteracted by the overlap of the catch portion 238 of the check rail 138 and the engagement flange 226 of the mullion 124. The overlap can increase the lateral stability of the sash frame 114 within the master frame 112, and can ensure that the weather-stripping provided in the check rail 138 remains satisfactorily engaged with the engagement flange 226 of the mullion 124.

To facilitate the integral injection moulding of the return bracket 234 of the check rail 138 when moulding the sash frame 114, the offest and catch portions 236, 238 of the return bracket 234 may advantageously be provided in a staggered arrangement. Such an arrangement can facilitate moulding by reducing the requirements for additional slides in the die, and can improve the flow characteristics of the plastic when filling the mould by reducing the overall die cavity volume.

The portion of the check rail 138 facing the opposite vertical member 136 of the sash frame 114 may be provided with integrally moulded glazing support details 161 for supporting the sash glazing 131. The glazing support details 161 comprise the backstop surface 162, planar support surface 164, and the attachment recess 166 for receiving a length of glass stop 168.

As best seen in FIG. 11*a*, the check rail 138 may be provided with a elongate cap 250 extending along the height of the return bracket 234. The cap 250 may advantageously be shaped to snap fit over the return bracket 234, and may be of vinyl, metal, or other suitable material. The cap 250 can serve to provide a smooth, finished appearance for the return bracket 234 of the check rail 138, and can also strengthen and reinforce the return bracket 234.

Figure 11B:
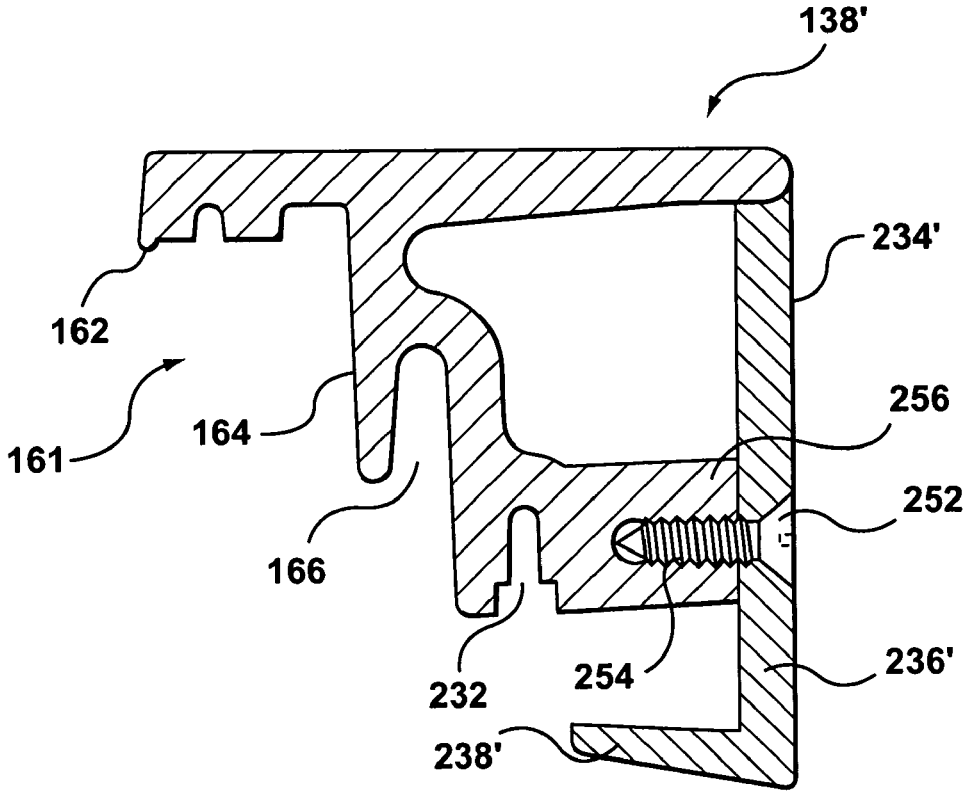
FIG. 11*b* shows an alternate embodiment of the check rail of FIG. 11*a;*

As best seen in FIG. 11*b*, a modified check rail 138' has a return bracket 234' separately attachable to the check rail 138', rather than being integrally moulded with the master frame 12. The return bracket 234' includes perpendicular portions 236' and parallel portion 238', and can be secured to the modified check rail 138' by means of a fastener 252 tightened into a fastener 256 recess 254 provided in a lug extending from the modified check rail 138'. Since the return bracket 234' can be separately manufactured from the check rail 138', the perpendicular and parallel portions 236', 238', need not be provided in a staggered arrangement, but can extend continuously along the height of the return bracket 234'.

Figure 12:
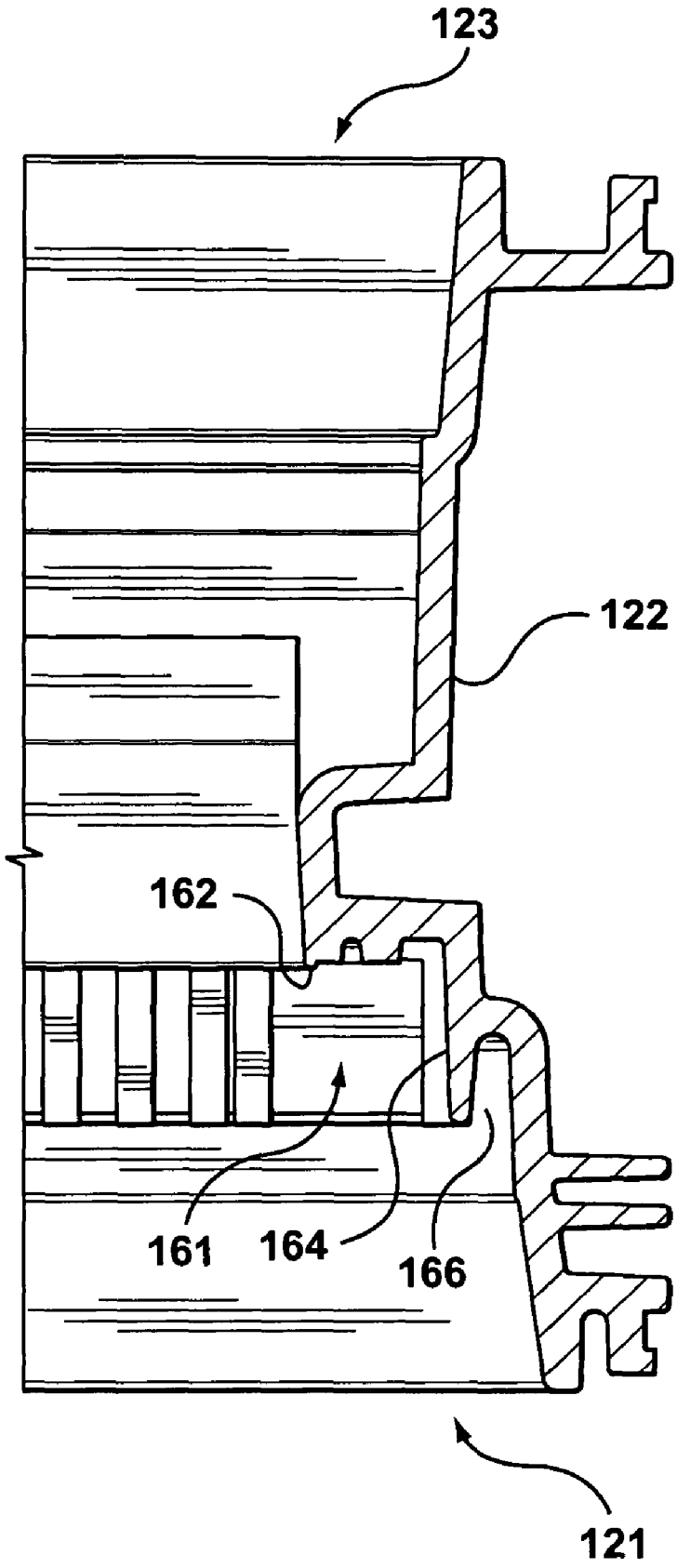
FIG. 12 is a horizontal section of the frame assembly shown in FIG. 4 taken along the line 12-12.

The cross-sectional profile of the fixed side jam 122 of the master frame 112 can be best seen in FIG. 12, which shows a section along the lines 12-12 of FIG. 4. The fixed side jamb 122 may also advantageously be provided with glazing support details for supporting the fixed glazing 130. The glazing support details comprise the back stop surface 162, planar support surface 164, and the attachment recess 166 for receiving a length of glass stop 168.

Figure 13A:
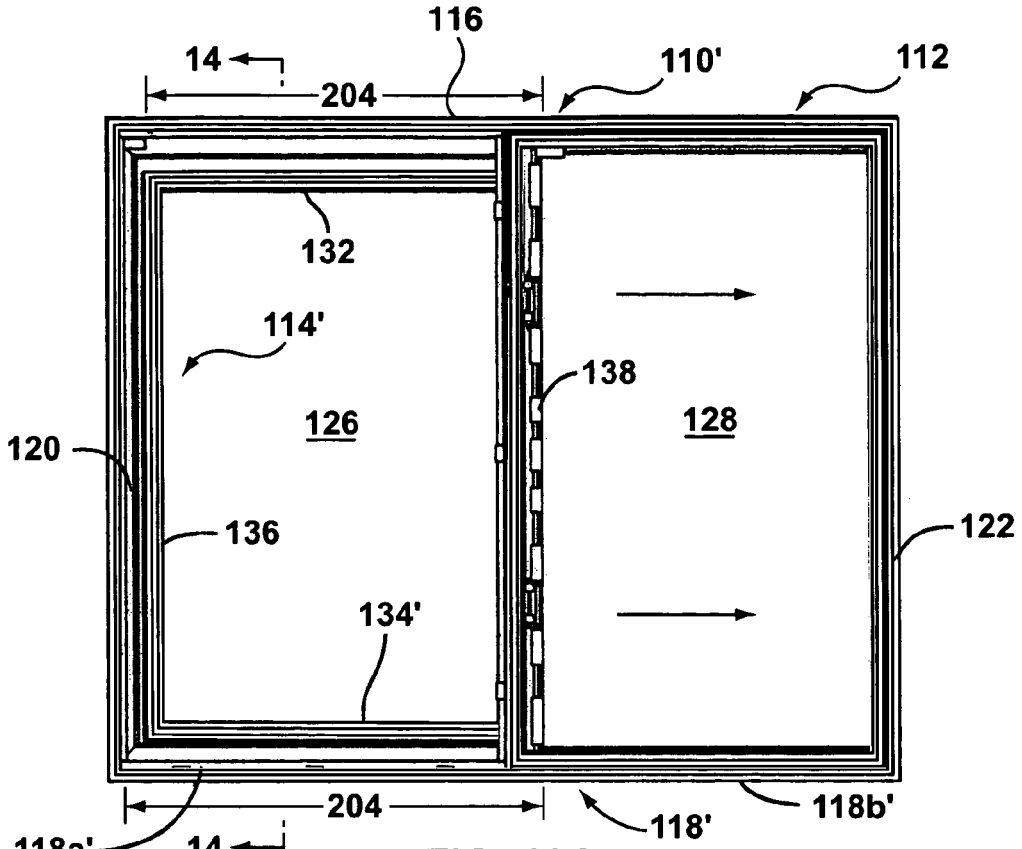
FIG. 13*a* is a front exterior view of a modified, reversible assembly in accordance with another embodiment of the present invention.
Figure 13B:
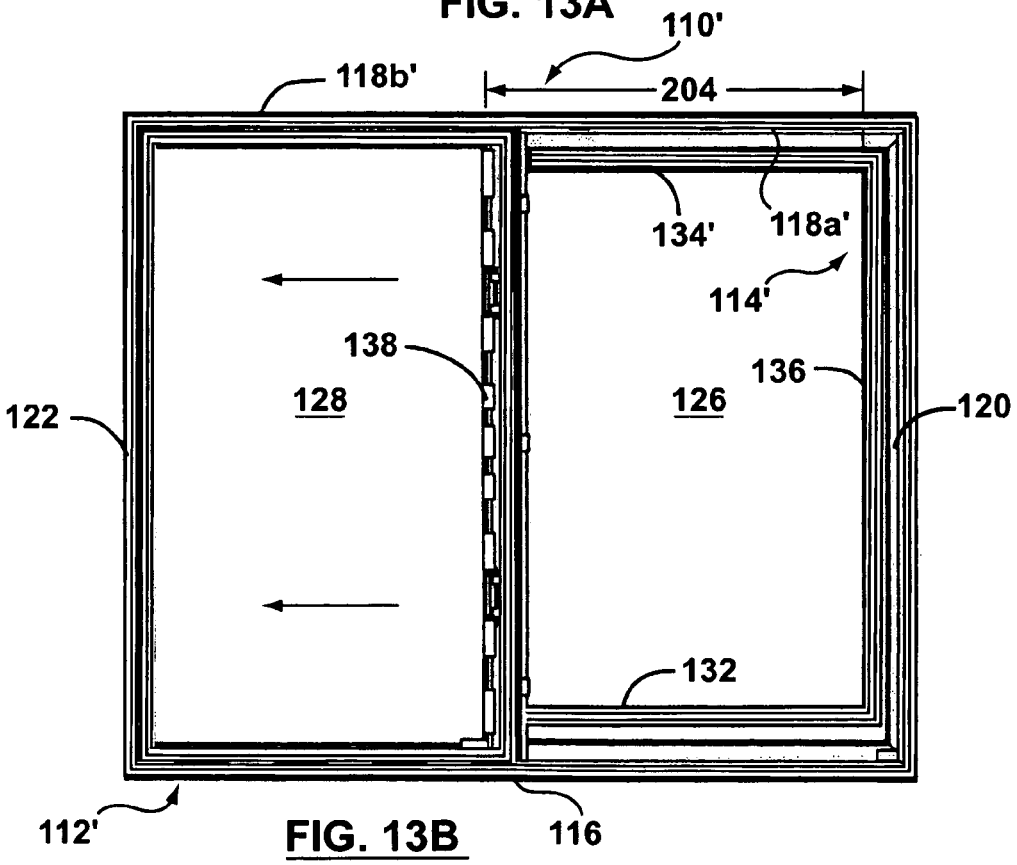
FIG. 13*b* is a front exterior view of the frame assembly of FIG. 13*a*, shown in a reversed position.

In accordance with the present invention, the frame assembly 110 may also be provided in a modified form, referred to as a reversible frame assembly 110'. The reversible frame assembly 110' is similar to the frame assembly 110, but is configured to be selectably installed in either a slide-right or slide-left configuration for opening the window, as best seen in FIGS. 13*a* and 13*b*, respectively. In other words, the frame assembly 110' can be inverted to reverse the relative positions of the vent side 126 and fixed side 128.

The reversible frame assembly 110' has a modified master frame 112' and a modified sash frame 114'. The modified master frame 112 has a modified sill 118' which is substantially a mirror image of the header 116. In particular, the sill 118' is provided with the same interlacing configuration 202 as provided in the header 116, thereby defining a second lift position 204' along the adjacent horizontal elements 118' and 134' of the master frame 112' and sash frame 114', respectively.

Figure 14:
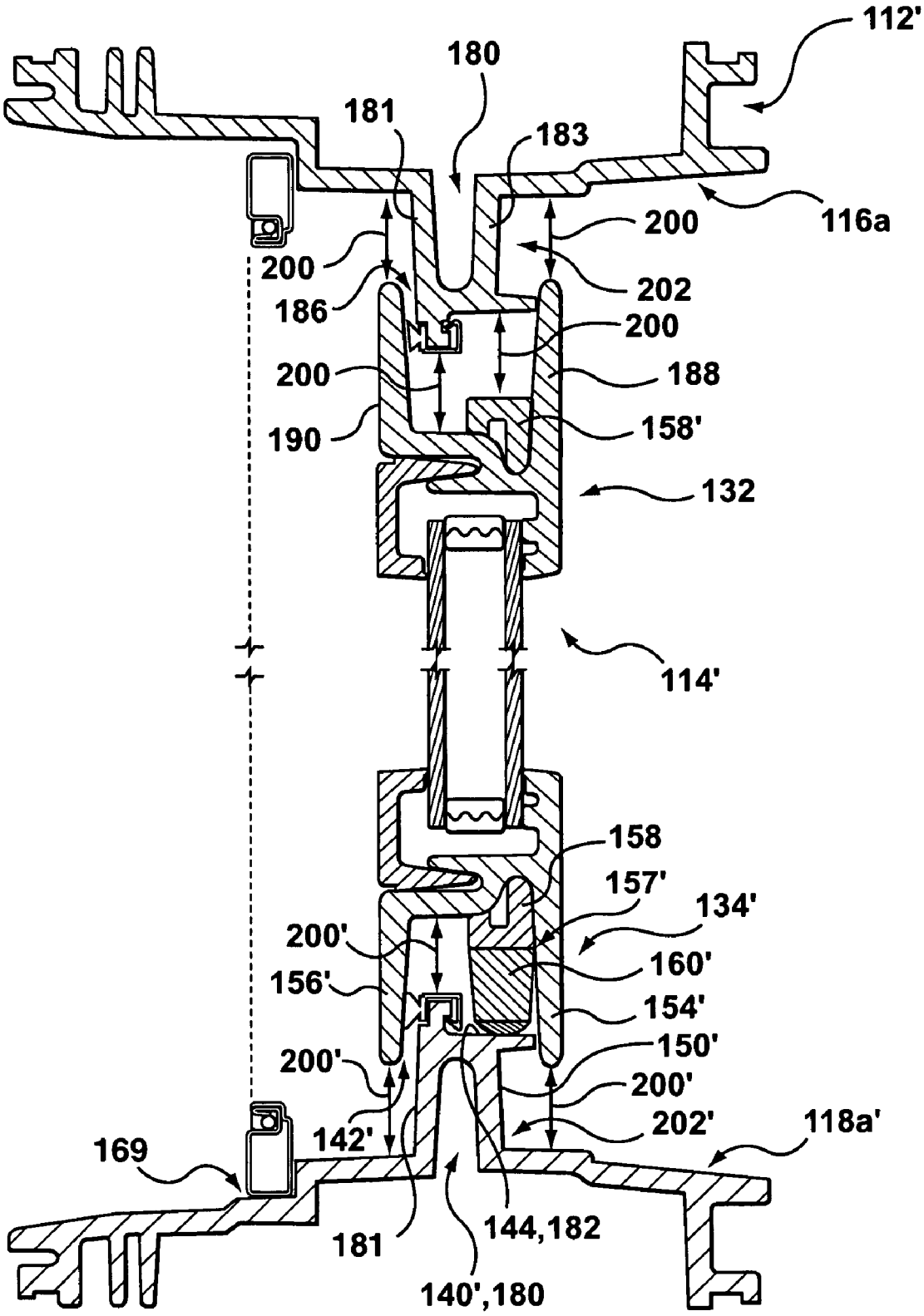
FIG. 14 is a section of the frame assembly shown in FIG. 13*a*, taken along the line 14-14.

Details of the modified sill 118' and horizontal member 134' of the modified frame 110' can best be seen in FIG. 14, showing a cross-section of FIG. 13*a* taken along the line 14-14. The first portion 118*a*' of the sill 118' has a modified tongue 140' which corresponds in mirror image to the tongue 180 provided in the header 116. Accordingly, the sash frame interlacing configuration 202' is provided along the modified sill 118', including the provision of the cavity 205' behind the mullion 124 (see FIG. 15).

Referring again to FIG. 14, the sash frame 114' has a modified lower horizontal member 134' which corresponds in mirror image to the upper horizontal member 132 of the sash 114. In particular, the modified lower horizontal member 134' has a deeper groove 142' (as compared to the groove 142 of the horizontal member 134 shown in FIG. 5), providing vertical clearance 200' between the modified sill 118' and the upper ends of the interior and exterior sidewalls 154', 156' of the lower horizontal member 134'.

To account for the vertical clearance 200' provided by the interlacing configuration 202' of the modified lower horizontal member 134', a modified glider 157' is provided within the groove 140' of the horizontal member 134' to operably support the sash frame 114' above the sill 118' of the master frame 112'. The modified glider 157' includes the glider housing 158 and a modified glider element 160'. The modified glider element 160' has a greater vertical height than the glider element 160, to compensate for the increased depth of the groove 142' provided in the lower horizontal member 135', as compared to the groove 142 provided in the lower horizontal member 134 (FIG. 5). When installed, the glider 157' engages the runner 144 of the tongue 140', and thereby supports the sash frame 114' above the sill 118'.

When the reversible frame 110' is installed as shown in FIG. 13*a*, a window having a vent side 126 to the left, and a fixed side 128 to the right, (when viewed from the exterior) is provided, similar to that described in the original frame assembly 110. To install the reversible window frame assembly 110' with the vent side 126 and fixed side 128 in reverse positions (FIG. 13*b*), the frame assembly 110' need merely be rotated 180 degrees in a vertical plane, and the glider element 160' attached to the glider housing 158' provided in the horizontal member 132, rather than in the horizontal member 134', of the sash frame 114'.

Referring now to FIGS. 11 and 15, further details of the integrally moulded glazing support features 161 will be described. The glazing support features 161 include a planar surface 164 which extends around the perimeter of the glazing (not shown) to be installed. At various locations along the planar surface 164, integrally moulded setting block housings 240 for holding setting blocks 242 are provided. The housings 240 can be a series of ribs on which the setting blocks 242 are placed, having taller outermost ribs for providing a press fit seat for the setting blocks 242. The setting blocks 242 may be constructed of a resilient material, providing a snug fit around the edge of the glazing and, offering a degree of compressibility to accommodate thermal expansion and contraction.

Furthermore, the glazing support features 161 include elongate recesses 166 extending generally parallel to and adjacent to the planar surfaces 164. The recesses 166 are shaped to receive a length of glass stop 168 (FIG. 15). In particular, the glass stop 168 has a nose portion 243 shaped to snugly fit in the recess 166. The glass stop 168 may also be provided with tabs 244, shaped to snap fit in corresponding recesses 246 provided along an inner surface of the recesses 166.

Once the length of glass stop 168 has been inserted, the glazing is securely fixed in the master frame 112 or sash frame 114 by being squeezed between the backstop surface 162 of the respective frame, and an opposed contact surface 248 provided on the length of glass stop 168. Furthermore, the glazing is constrained from moving in a direction parallel to the glazing by the setting blocks 242. It is again noted that according to the present invention, the backstop surface 162, planar support surface 164, recesses 166, setting block housing 240, and the recesses 246, can be advantageously integrally moulded with the respective frame elements 112 and 114.

Figure 17:
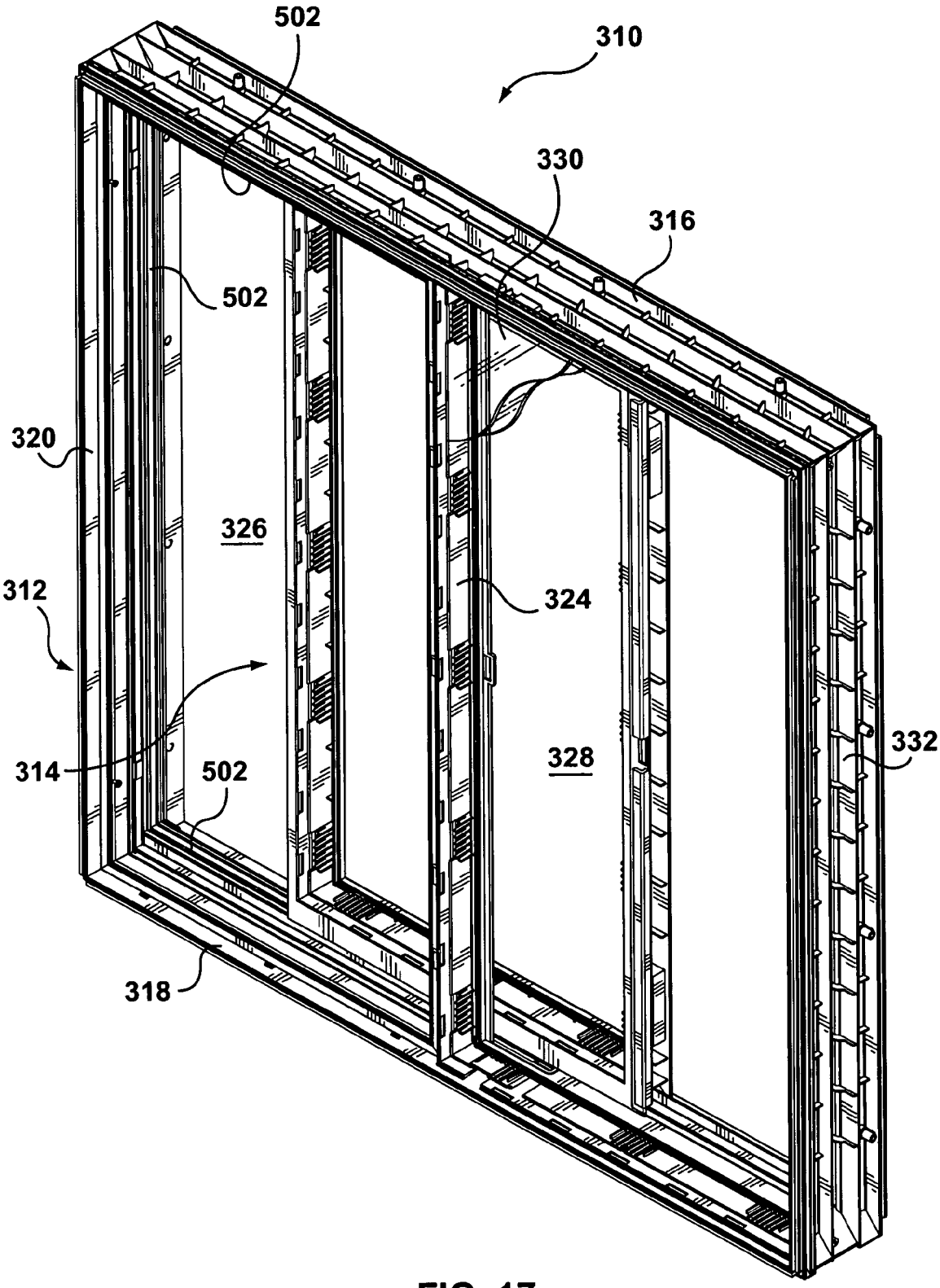
FIG. 17 is a perspective view of a frame assembly according to another embodiment of the present invention, looking at the exterior face.
Figure 18:
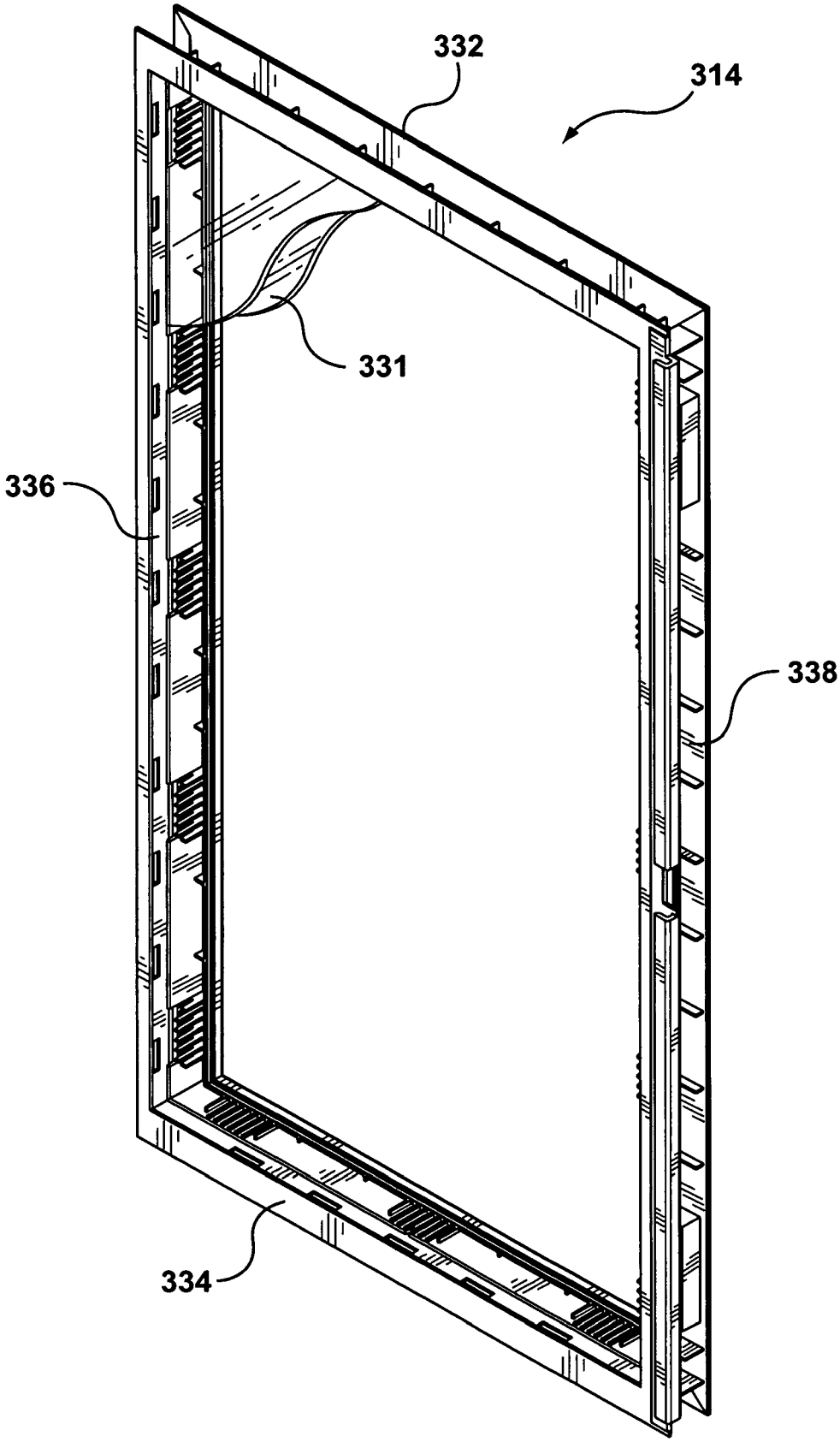
FIG. 18 is a perspective view of a sash frame shown in FIG. 17.

An alternate embodiment of a frame assembly 310 according to the present invention can be seen in FIG. 17. The frame assembly 310 is similar to the frame assembly 110, but has some features and modifications that can provide advantages such as, for example, but not limited to, improved performance ratings, better wind and water resistance, and improved ease of manufacture. Features of the frame assembly 310 corresponding to those of the frame assembly 110 have been identified by the same reference numerals, incremented by 200.

Referring to FIGS. 17-20, the general construction of the window frame assembly 310 with its master frame 312 and sash frame 314 can be seen. The master frame 312 is of one-piece, integrally moulded construction, devoid of any seams or joint lines between contiguous vertical and horizontal members 316, 318, 320, and 322, and the mullion 324.

The members of the master frame 312 are shaped and sized to facilitate manufacturing the master frame 312 by a moulding process, such as, for example, injection moulding. The master frame 312 can be constructed of a suitable plastic material, such as polypropylene or a recycled plastics material.

The sash 314 is similarly of one piece, integrally moulded construction, having contiguous horizontal and vertical members 332, 334, 336, and 338. The sash 314 can be constructed of the same material as the master frame 312.

In the embodiment illustrated, the frame assembly 310 is reversible, similar to the frame assembly 110'. In other words, the frame assembly 310 can provide a sliding window or door with the fixed side 328 on either the left or the right side when looking at the exterior face 321. In the embodiment illustrated, the fixed side 328 is on the right side of the frame assembly 310 when viewed from the exterior.

Figure 19:
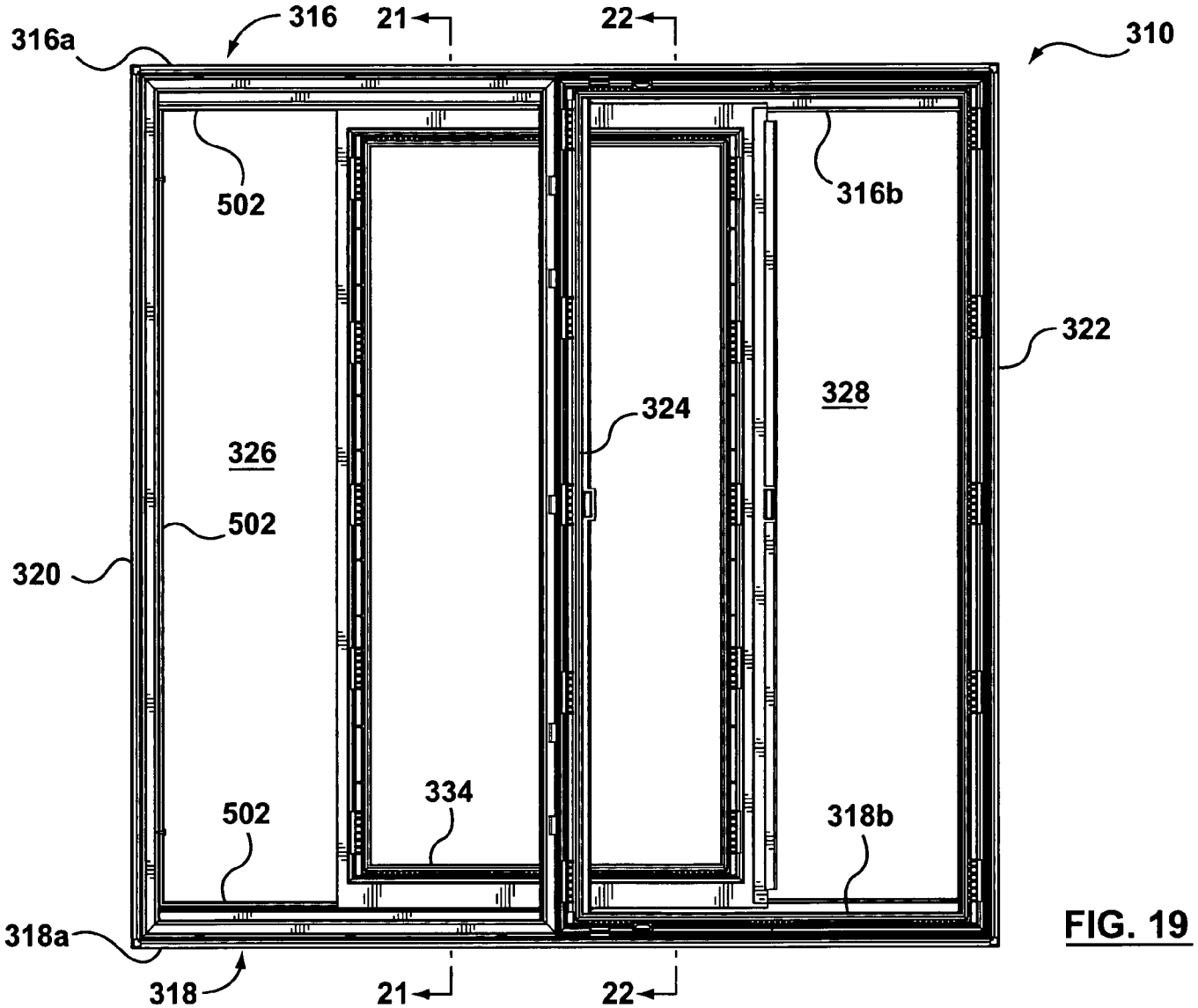
FIG. 19 is a front elevation view of the frame assembly shown in FIG. 17, with the sash frame positioned between open and closed positions.
Figure 20:
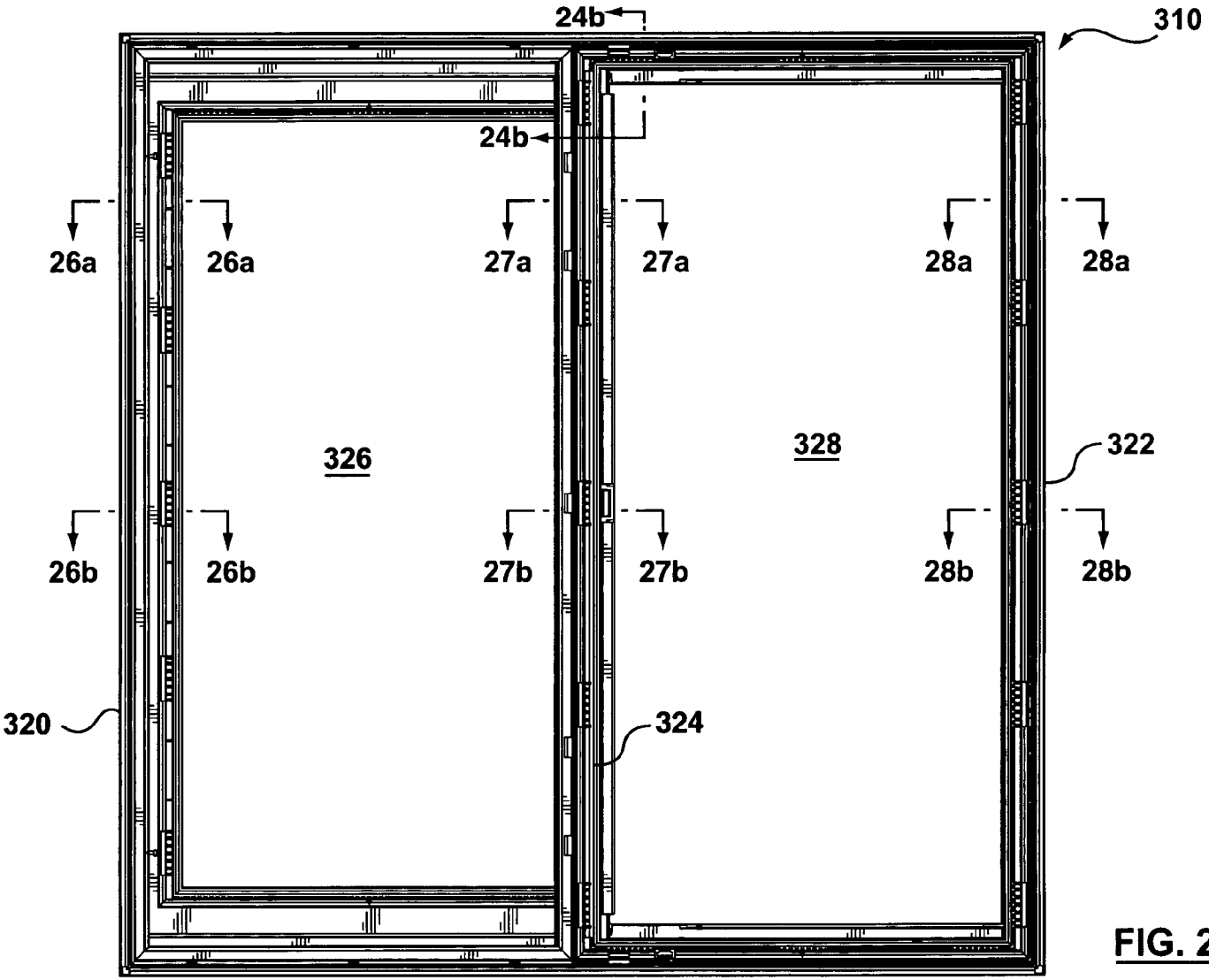
FIG. 20 is a front elevation view of the frame assembly shown in FIG. 71, with the sash frame in the closed position.

Referring to FIGS. 17 and 19, the frame assembly 310 is provided with track or carrier strips 502 that line a portion of the perimeter of the vent side 326 of the master frame 312. In the illustrated embodiment, the portion of the perimeter provided with the carrier strips 502 includes a portion of the header 316, the sill 318, and the vent side jamb 320 of the master frame 312.

Figure 21:
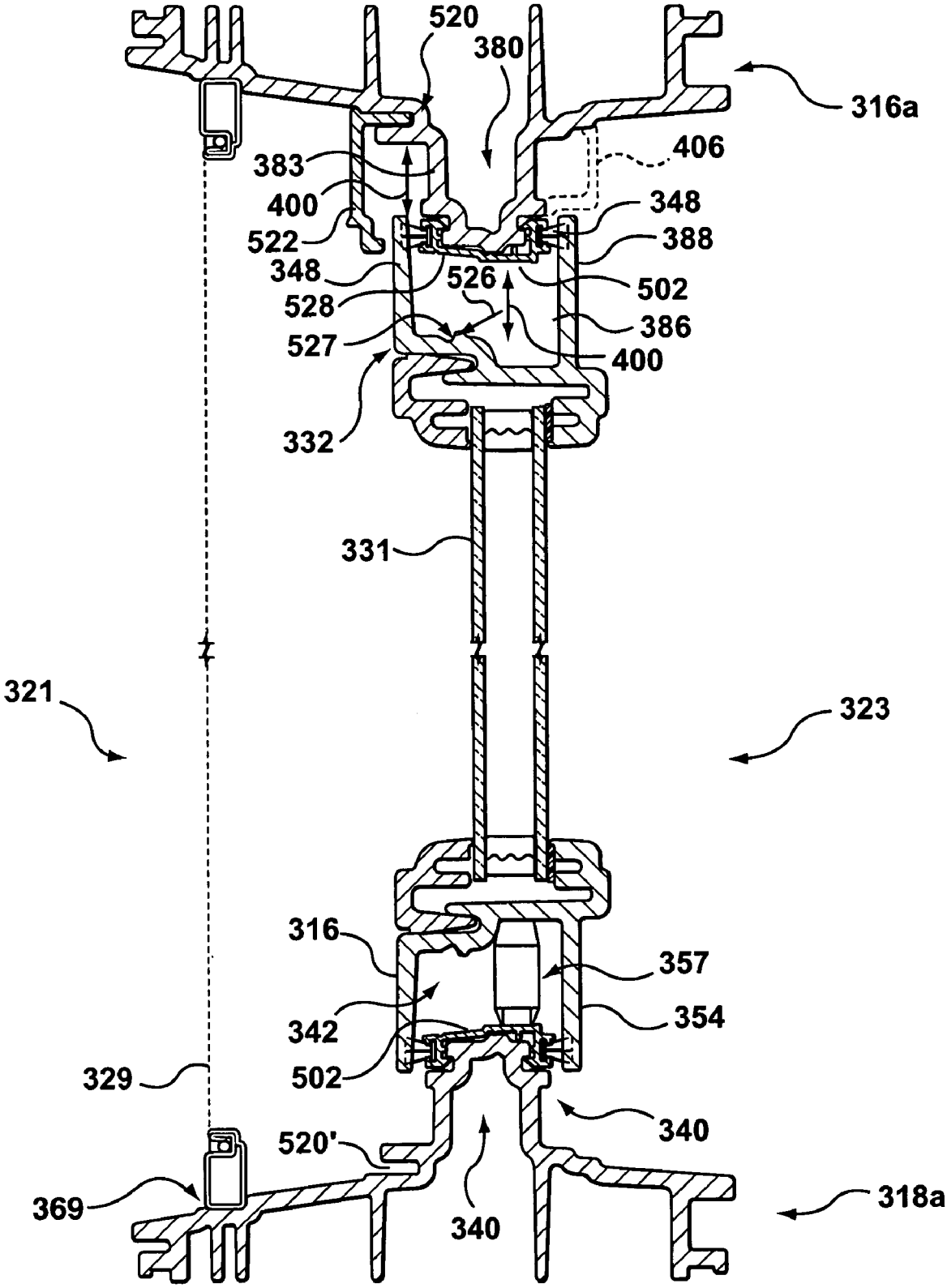
FIG. 21 is a vertical section of the frame assembly shown in FIG. 19 taken along the line 21-21.
Figure 26A:
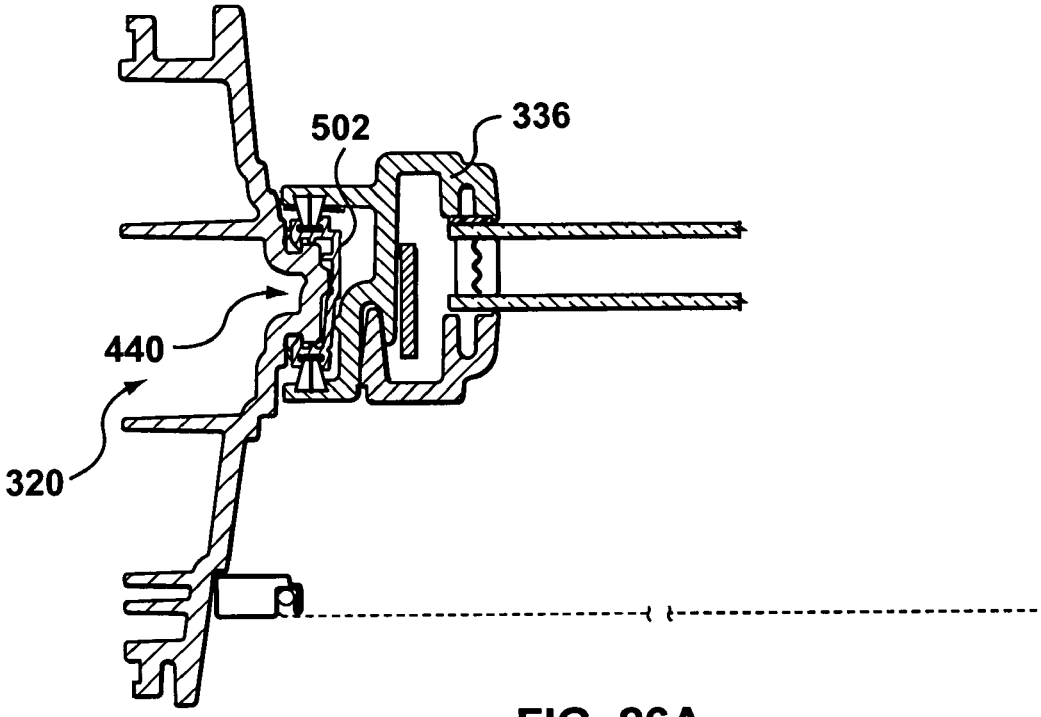
FIGS. 26*a*, 26*b*, 27*a*, 27*b*, 28*a*, and 28*b* are horizontal section views of the frame assembly shown in FIG. 20 taken through the lines 26*a*-26*a*, 26*b*-26*b*, 27*a*-27*a*, 27*b*-27*b*, 28*a*-28*a*, and 28*b*028*b*, respectively.
Figure 26B:
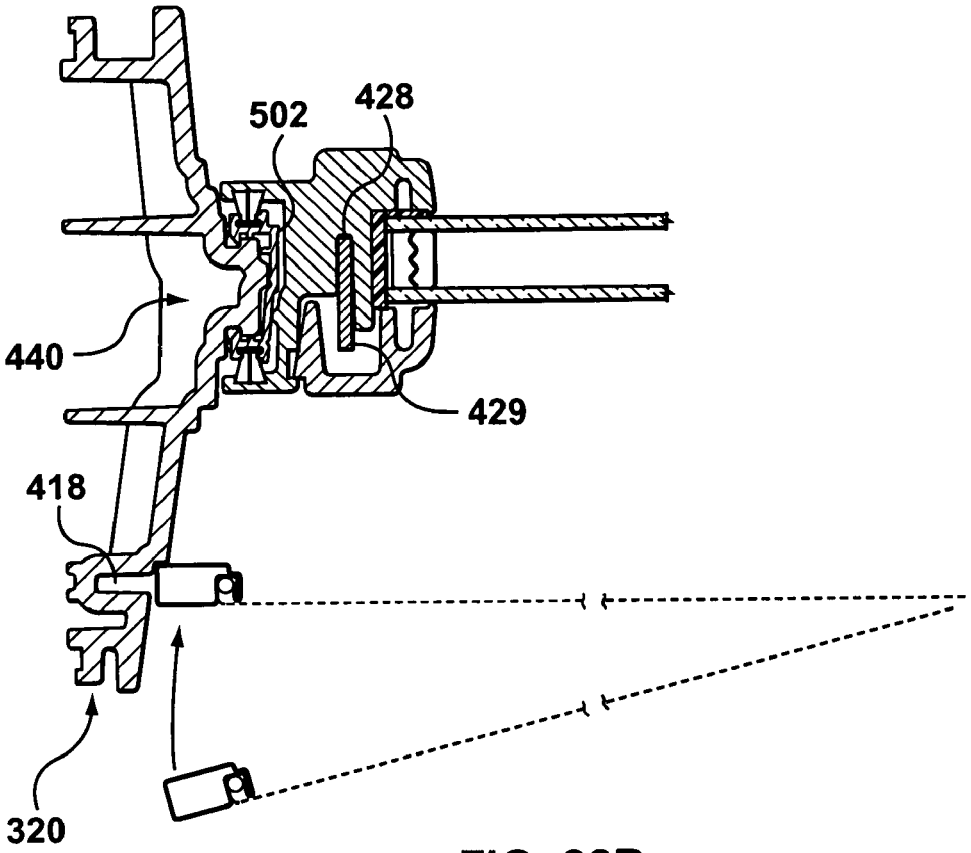
Figure 28A:
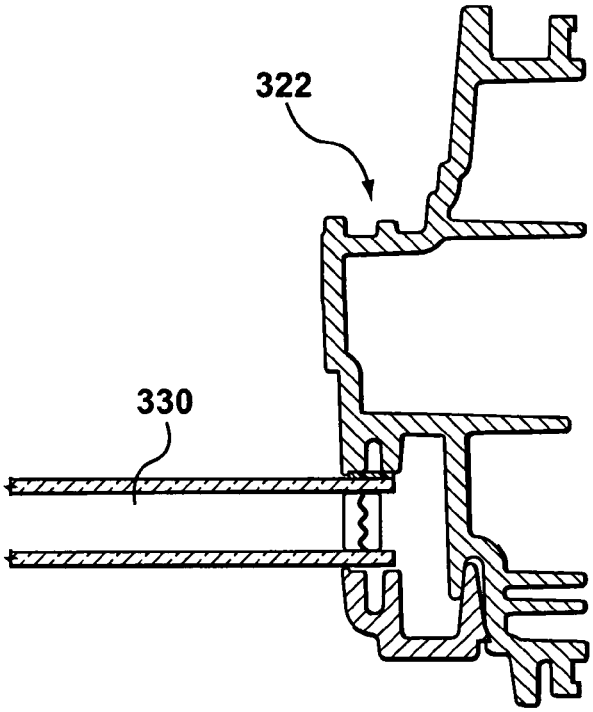
Figure 28B:
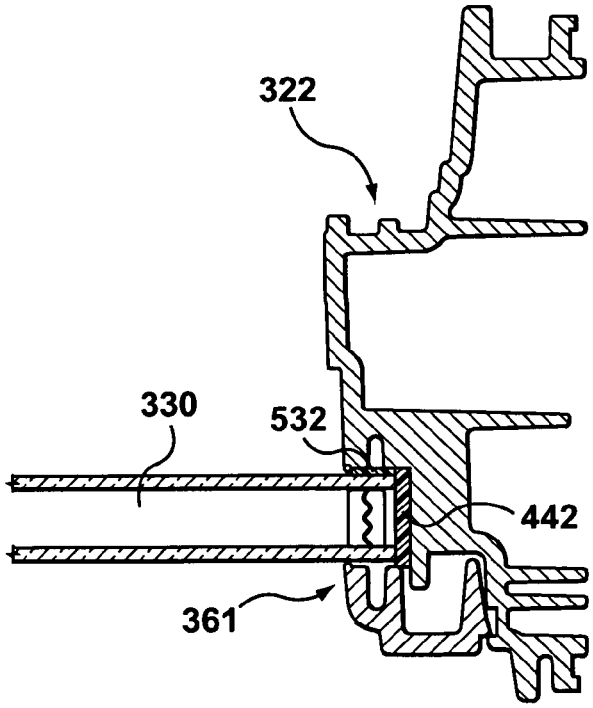

As best seen in FIG. 21, regarding the header and sill portions 316 and 318, the carrier strips 502 are provided along upper and lower surfaces, respectively, of the tongues 340 and 380 extending from the first portions 318*a* and 316*a* of the sill 318 and header 316. As best seen in FIG. 26*a* and 26*b*, regarding the vent side jamb 320, the carrier strip 502 is provided along the surface of the tongue 440 extending from the vent side jamb 320. The fixed side jamb 322 is without the carrier strips 502 (FIGS. 28*a* and 28*b*), as are the second portions 318*b* and 316*a* of the sill and header 318 and 316.

Figure 21A:
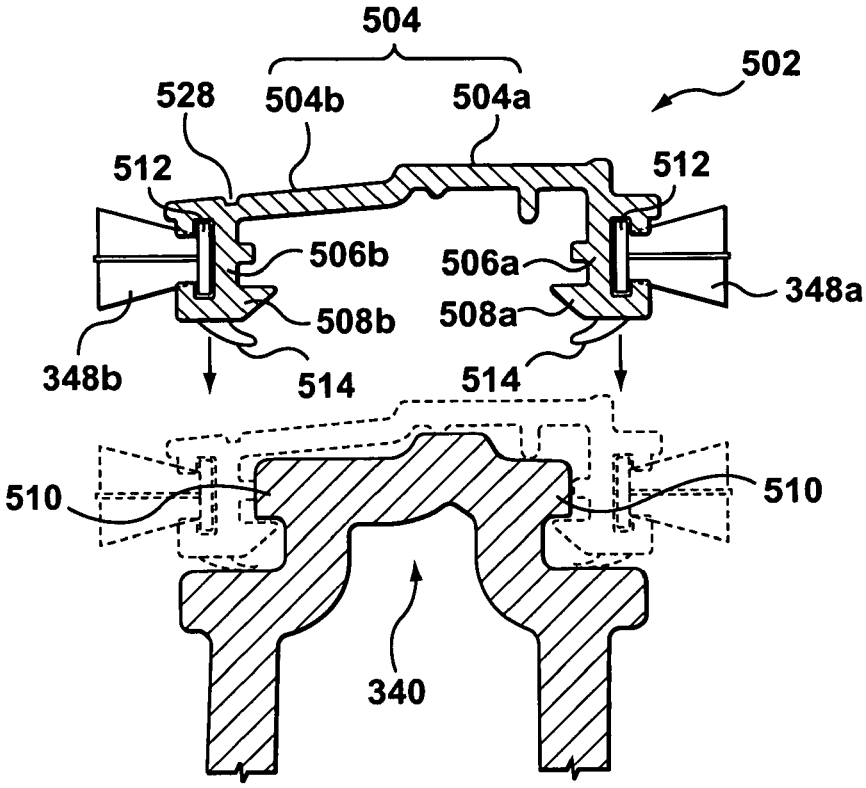
FIG. 21*a* is an enlarged end view of a carrier strip portion shown in FIG. 21.

Details of the carrier strips 502 and their attachment to the tongues 340, 380, 440 will be described by way of example with respect to the strip 502 mounted to the tongue 340 and referring to FIGS. 21 and 21*a*. The carrier strip 502 has a facing surface 504 that extends between two support legs 506*a*, 506*b*. The facing surface has across its width a generally orthogonal portion 504*a* and an inclined portion 504*b*. The opposed support legs 506*a*, 506*b* have inwardly directed clips 508*a*, 508*b*, respectively, to engage the underside of outwardly projecting tabs 510 that extend from the tongue 340.

The carrier strip 502 is adapted to support weatherstripping 348 that extends along the length of the carrier strip 502, providing a seal between the tongue 340 and the lower horizontal member 334 (Shown in FIG. 21) of the sash frame 314. In the embodiment illustrated, the opposed support legs 506 of the carrier strips 502 each have outwardly directed T-slots 512 extending along the length of the carrier strips 502. A length of weatherstripping 348 can be inserted in each T-slot, to provide seals between the tongue 340 and the lower horizontal member 334 of the sash frame 314 along both sides of the carrier strip 502. The weatherstripping 348 can be of a synthetic pile construction.

To install the carrier strip 502 onto the tongue 340, the support legs 506 can be pressed over the tabs 510 so that the clips 508 are spread apart and then snap back into place as the clips 508 are pressed past the tabs 510. The carrier strip can be constructed of a durable plastic material and can be manufactured by an extrusion process. The carrier strips 502 can be provided with rubber-like fins 514 extending downward from the ends of the support legs 506. The fins 514 can provide a seal between the tongue 340 and the strips 502, and can be coextruded with the strips 502. The seal provided by the fins 514 can inhibit penetration of weather elements underneath the carrier strips 502, so working their way from the exterior face 321 of the assembly 310 to the interior face 323

In use, the orthogonal portion 504*a* of the facing surface 504 of the strip 502 attached to the tongue 340 provides the runner 344 against which the roller/glider 357 of the sash 314 can bear (FIG. 21). The inclined portion 504*b*, which is disposed between the orthogonal portion 504*a* and the exterior face 321 of the frame assembly 310, can facilitate drainage of any water that may have worked its way between the groove 342 of the sash 314 and the tongue 340 (with the carrier strip 502) of the master frame 312.

Referring again to FIG. 21, the first portion 316*a* of the header 316 is, in the embodiment illustrated, provided with a skirt attachment recess 520 to which a skirt 522 is attached. The skirt 522 extends alongside the tongue 380 of the header 316, towards the exterior face 323 of the frame assembly 310. The skirt 522 extends generally vertically from the header 316, a sufficient distance to at least partially overlap the upper horizontal member 332 of the sash 314. The skirt 522 provides added protection against intrusion of water and wind past the weatherstripping 348 between the sash 314 and the tongue 380 of the header 316.

Any water that does make its way past the skirt 522 and exterior weatherstripping 348 is channeled to remain on the exterior side of the sash glazing 331, within the groove 386. In particular, the upper horizontal member 332 of the sash 314 has a protruding dam 526 that extends along the inside lower surface of the groove 386, and forms a drainage channel 527 between the dam 526 and the exterior sidewall 383 of the tongue 380. The channel 527 is positioned laterally between the exterior weatherstripping 348 and the position of the glazing 331. Water that does pass the weatherstripping 348 into the groove 386 is conveyed along the channel 527 to the vertical members 336 and 338 of the sash 314, where it is again channeled along the exterior side of the glazing 331. The water is then directed onto the inclined portion 504*b* of the carrier strip 502 on the tongue 340, and drains towards the exterior facing surfaces of the sill 318. The water may temporarily rest on top of the exterior weatherstripping 348*b*, but generally eventually works it sway through the piles of the weatherstripping and drains down the exterior sloped portion of the sill 318. Between the tongue 340 and the exterior edge of the sill 318, an attachment recess 520' can be provided, to receive the skirt 522 when the frame assembly 310 is in the inverted position, for reversing the vent and fixed sides 326, 328, respectively.

The inventors have found that in some cases, water that penetrates the exterior weatherstripping 348 along the tongue 380 could migrate, by capillary action, across the facing surface 504 of the carrier strip 502. Such water could thereby cross from the exterior side to the interior side of the glazing, and pose a risk of water intrusion. To eliminate such water migration, the carrier strip 502 is provided with a drip groove 528 positioned laterally between the exterior weather stripping 348 and the drainage channel 526. Any water traveling across the surface 504 beads up and falls down upon encountering the groove 528, landing in the channel 527. The drip groove 528 can also be seen in FIG. 21*a*.

Figure 22:
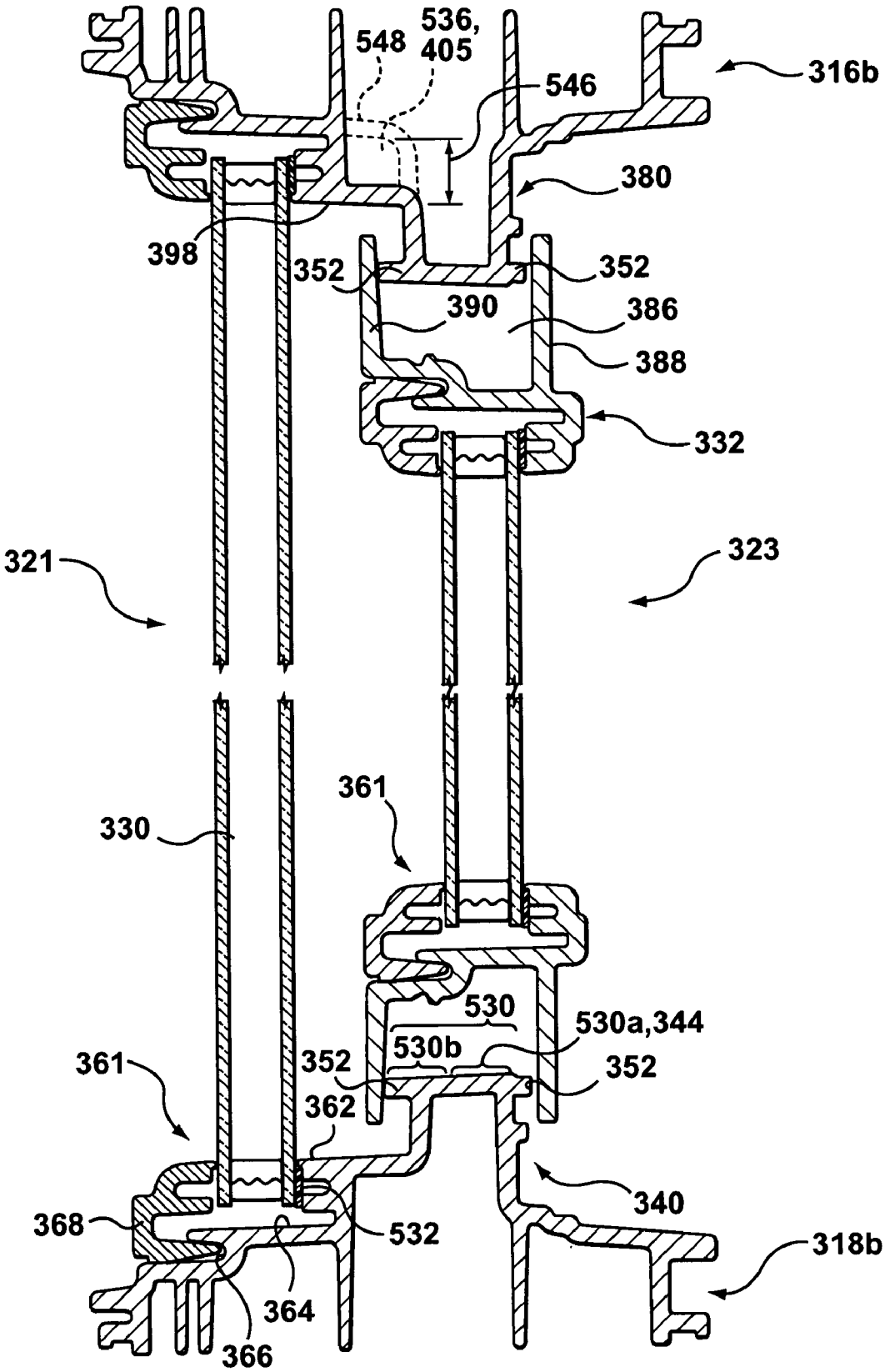
FIG. 22 is a vertical section of the frame assembly shown in FIG. 19 taken along the line 22-22.

Referring now to FIG. 22, the second portions 318*b* and 316*b* of the sill 318 and header 316 do not, in the embodiment illustrated, have carrier strips 502 attached to the tongues 340 and 380. The tongue 340 has an upper surface 530, which in the embodiment illustrated, has a generally orthogonal portion 530*a* and an inclined portion 530*b*.

The portions 530*a* and 530*b* are laterally adjacent each other, as best seen in FIG. 22, with the orthogonal portion 530*a* positioned nearer to the interior face 323 and the inclined portion 530*b* positioned nearer to the exterior face 321 of the frame assembly 310. The orthogonal portion 530*a* of the upper surface 530 of the tongue 340 provides the runner 344 along the fixed side 328 of the assembly 310 against which the roller/glider 357 of the sash 314 can bear.

Figure 21B:
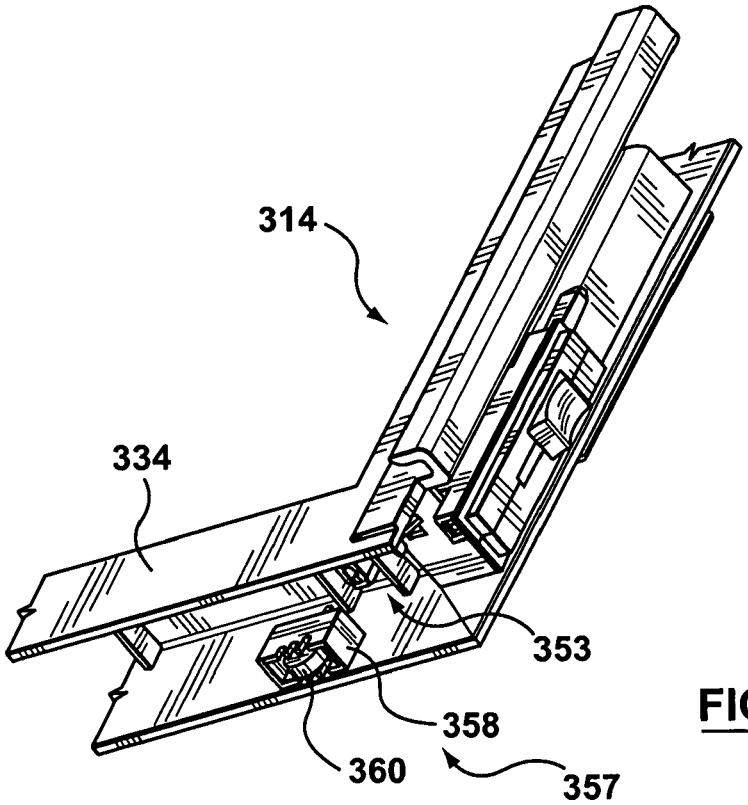
FIG. 21*b* is a perspective view of a lower portion of the sash frame shown in FIG. 2.
Figure 21C:
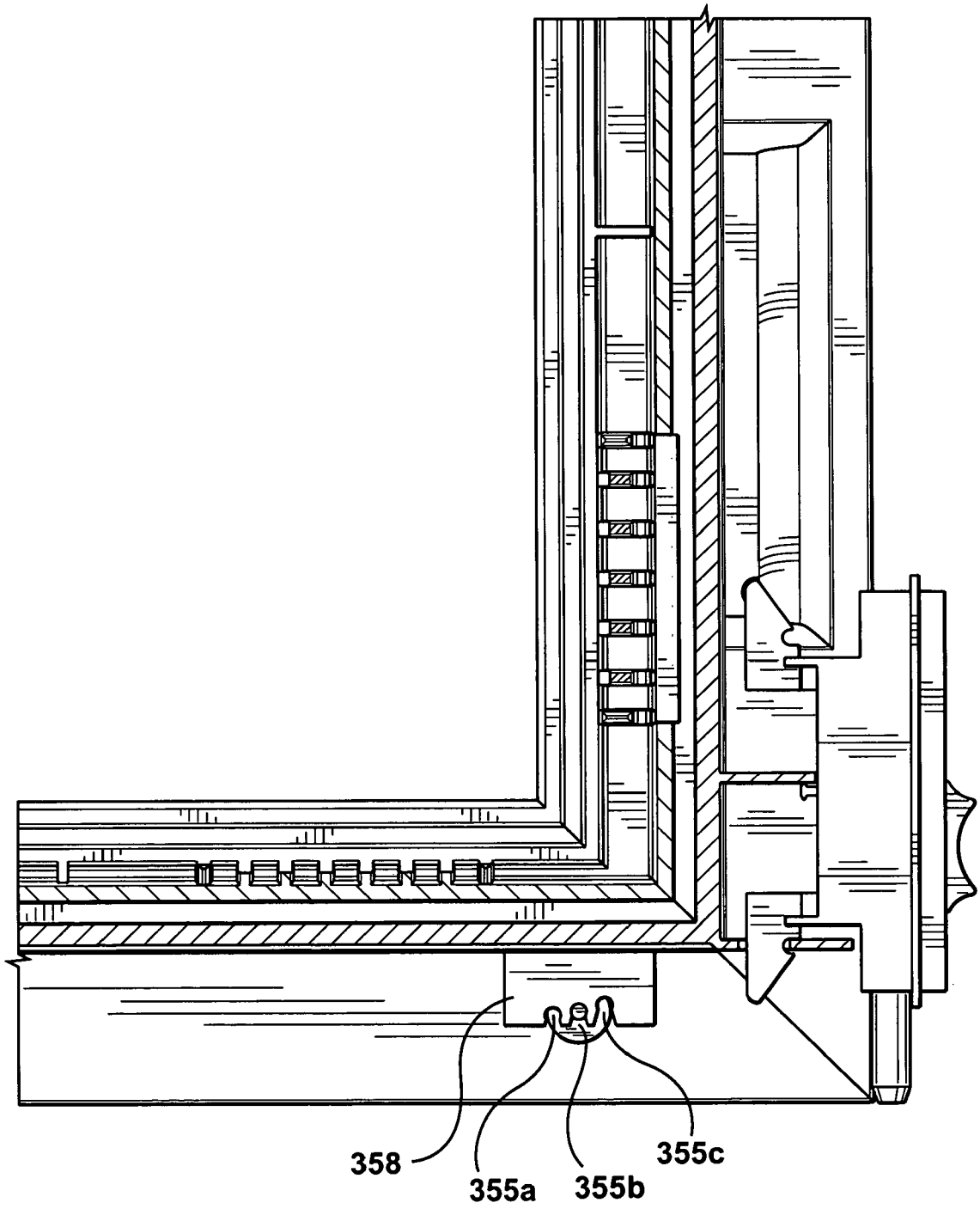
FIG. 21*c* is a front sectional view of the portion of the sash shown in FIG. 21*b;*

As best seen in FIGS. 21*b* and 21*c*, in the embodiment illustrated, the roller/glider 357 comprises a wheel 360 that can be snapped into one of three slots 355*a*. 355*b*. and 355*c* provided in a housing 358. The three slots 355*a-c* are of differing depths to provide for height adjustment of the sash 314 within the master frame 312. The housing 358 can be press fit into a pocket 353 provided in the underside of the lower horizontal member 334 of the sash 314. In the embodiment illustrated, the pocket 353 for receiving the glider/roller housing 358 is also provided in the upper horizontal member 332 of the sash 314, to permit inverted installation of the frame assembly 310, for reversing of the vent and fixed sides 326, 328 of the frame assembly 310.

The glazing support details 361 of the frame assembly 310 will now be described referring to FIG. 22. The glazing support details 361 include a planar support surface 364 that extends laterally beyond the width of the glazing 330 in the embodiment illustrated. This extra width can accommodate a wider glazing unit if desired, by providing adequate support beneath the entire width of glazing units that may range in width. Typical glazing unit width dimensions include ¾ and 1 inch widths. Glass stops 368 with shorter or longer arms can be used in combination with the wider or narrower glazing 330, to clamp the glazing 330 securely between the glass stops 368 and backstop surfaces 362. Also shown in the embodiment illustrated is the provision of double-sided glazing tape 532 that can be used to mount the glazing 330 against the backstop surface 362 of the glazing support features 361.

Figures 25A, 25B, 25C:
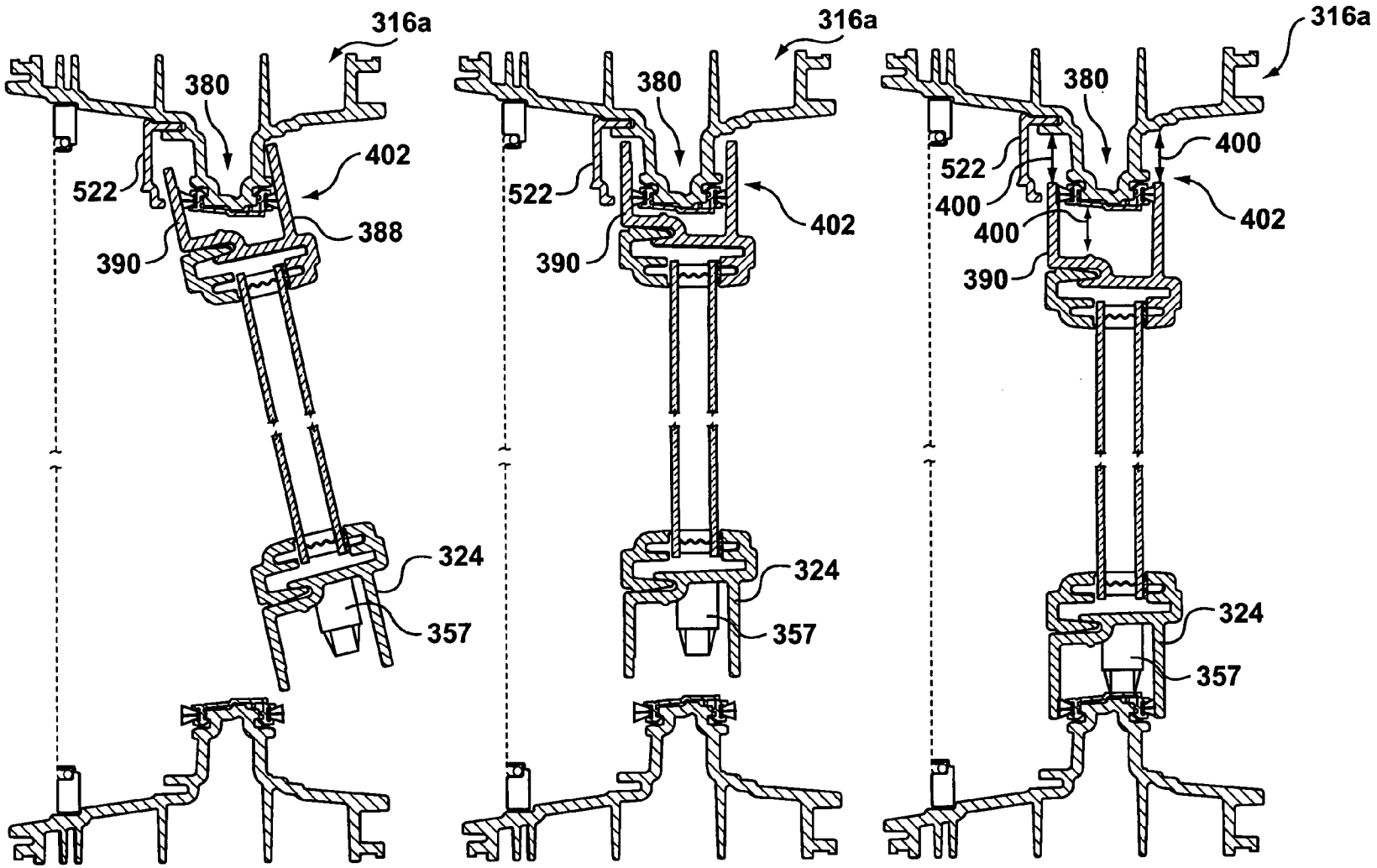
FIGS. 25*a*, 25*b*, and 25*c* are vertical section views of the frame assembly of FIG. 17 showing first, second, and third positions, respectively, of the sash frame during installation into (or removal from) the master frame.

Referring now to FIG. 21 and 25*a*-25*c*, the frame assembly 310 is also provided with vertical clearance 400 between the upper horizontal member 332 of the sash 314 and the header 316 of the master frame 312. More specifically, in the embodiment illustrated, the profile of the header 316 has a sash frame interlacing configuration 402 along a portion of the length of the header 316, that portion defining the lift position 404. When the sash 314 is aligned along its path of travel so that the upper horizontal member 332 is within the lift position 404, the sash frame 314 can be lifted upward relative to the master frame 312, so that the sash 314 can be installed in, and removed, from the master frame 312 (FIGS. 25*a* and 25*b*). The skirt 522 is spaced apart from the tongue 380 to accommodate the exterior sidewall 390 (FIG. 25*a*), when lifting the sash frame 314 for installation or removal.

Figure 23:
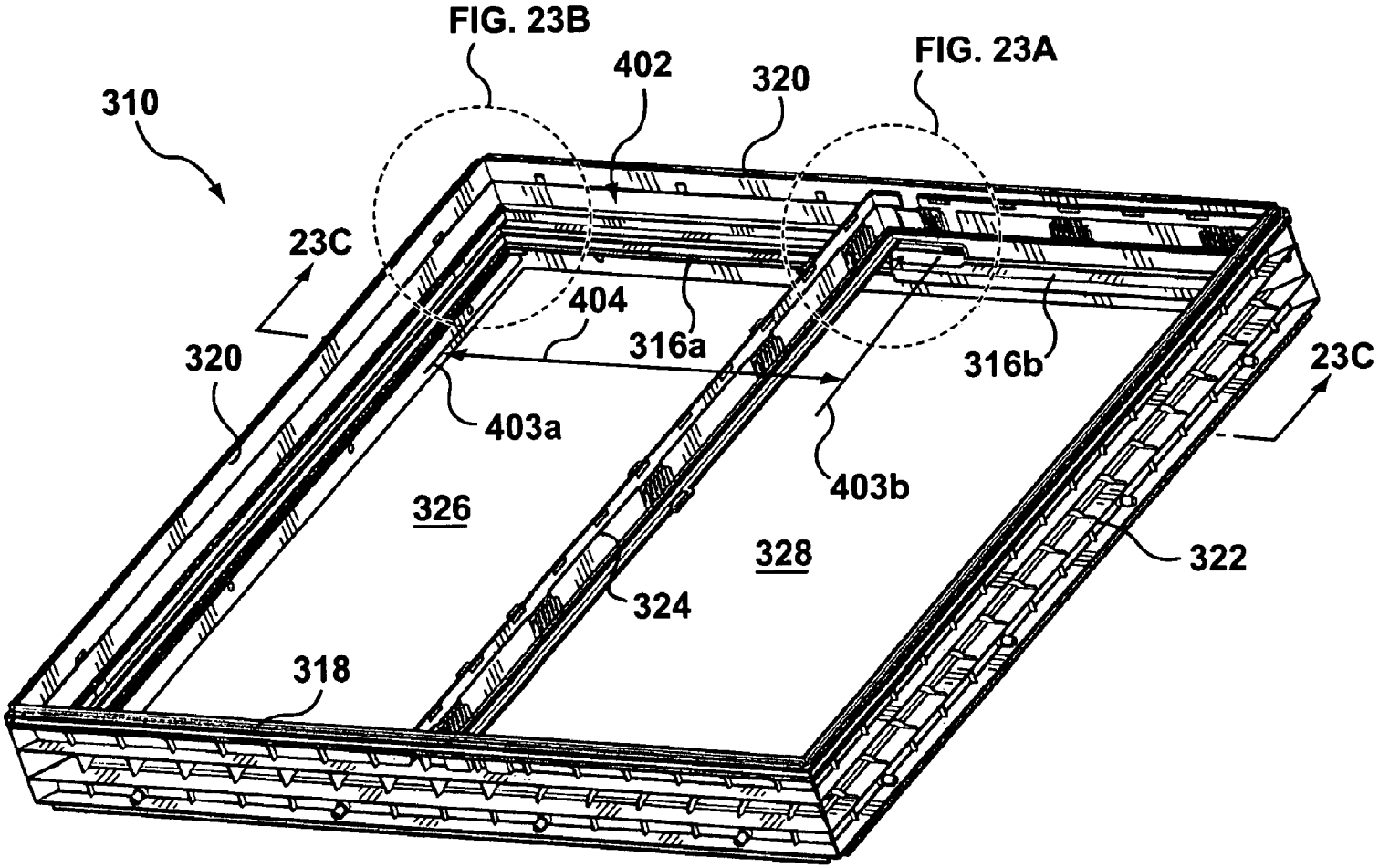
FIG. 23 shows the frame assembly of FIG. 17 viewed from a different, lower angle.
Figure 23A:
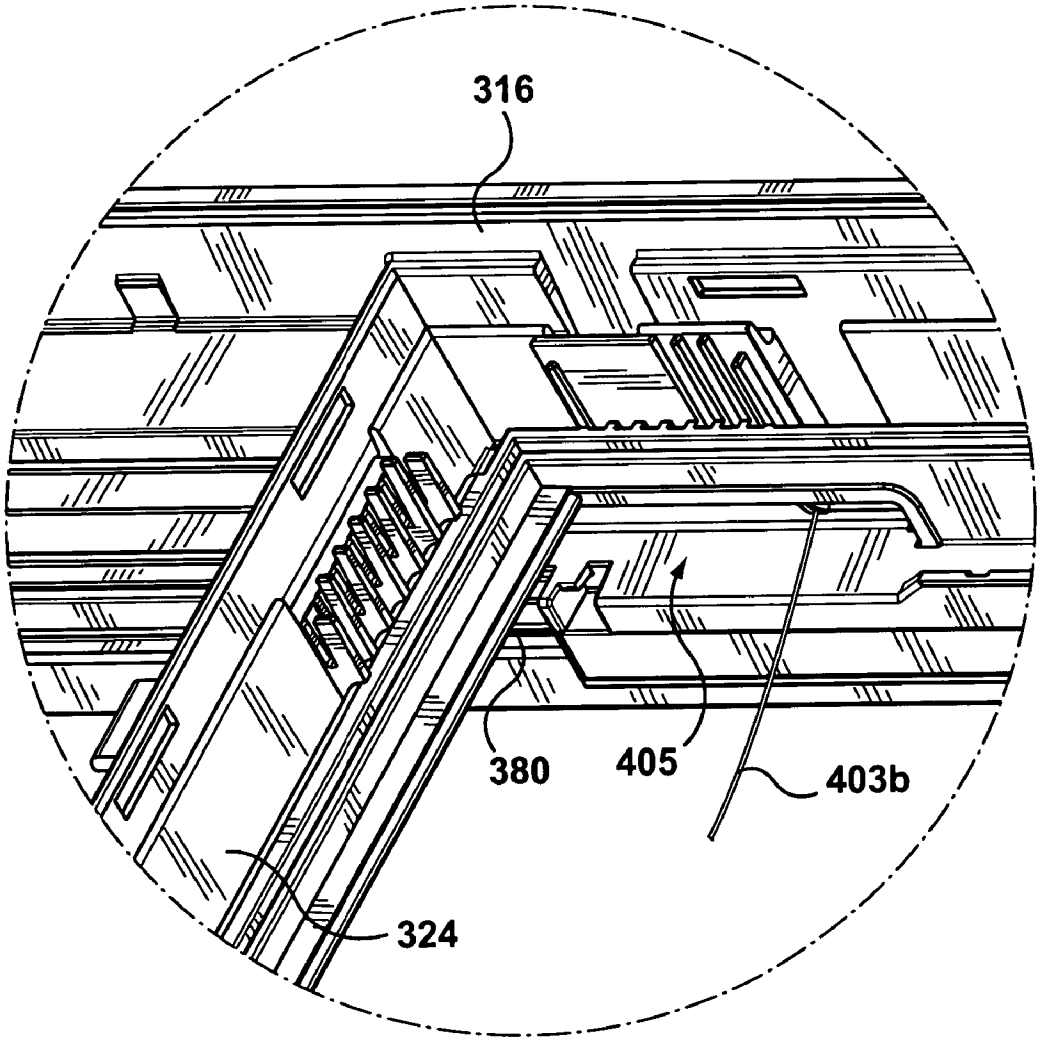
FIG. 23*a* is an enlarged view of a portion of the frame assembly shown in FIG. 23.
Figure 23B:
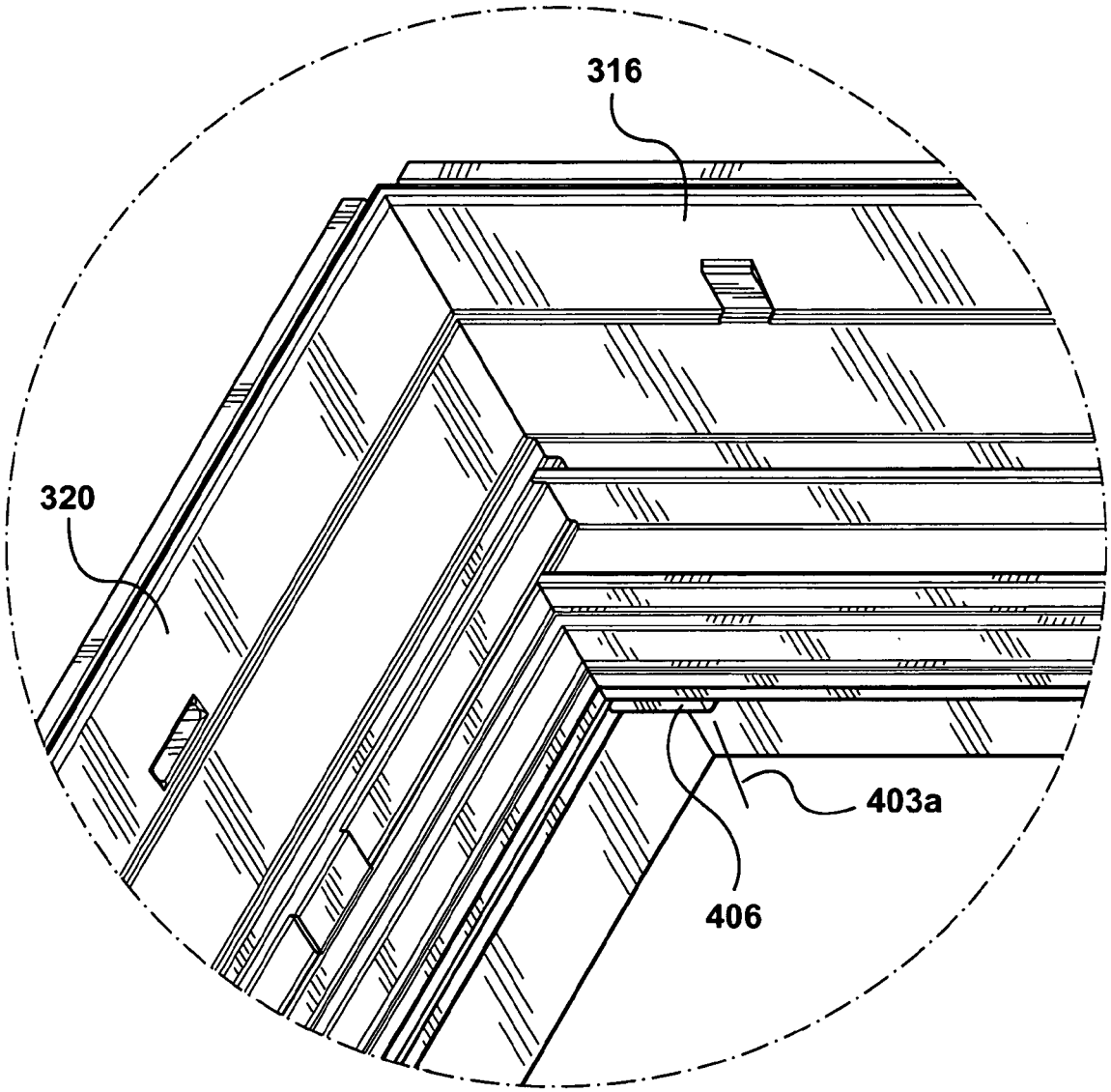
FIG. 23*b* is an enlarged view of another portion of the frame assembly shown in FIG. 23.

As best seen in FIGS. 23, 23*a*, and 23*b*, in the embodiment illustrated, the interlacing configuration 402 extends from a first end 403*a* adjacent the vent side jamb 320 to a second end 403*b* which is above the fixed side 328 of the master frame 312. Between the first end 403*a* of the interlacing configuration 402 and the vent jamb 320, the tongue 380 extending from the header 316 is provided with an integrally moulded interior shoulder 406 (FIG. 23*b*). The shoulder 406 generally occupies the space above the interior sidewall 388 of the groove 386 of the upper horizontal member 332 of the sash 314 (see FIG. 21). As a result, the vertical clearance 400 is no longer provided and lift out of the sash 314 is prevented when any portion of the sash 314 is positioned below the shoulder 406 (i.e., when the sash 314 is in or near the closed position).

Between the second end 403*b* of the lift position 404 and the fixed side jamb 322 of the master frame 312, the header 316 is generally provided with the second header portion profile 316*b*. The second portion 316*b* includes the exterior shoulder 398 above the exterior sidewall 390 of the groove 386 of the upper horizontal member 332 (see FIG. 22). As a result, the vertical clearance 400 is not provided between the sash 314 and the second portion 316*b* of the header 316.

Figure 24:
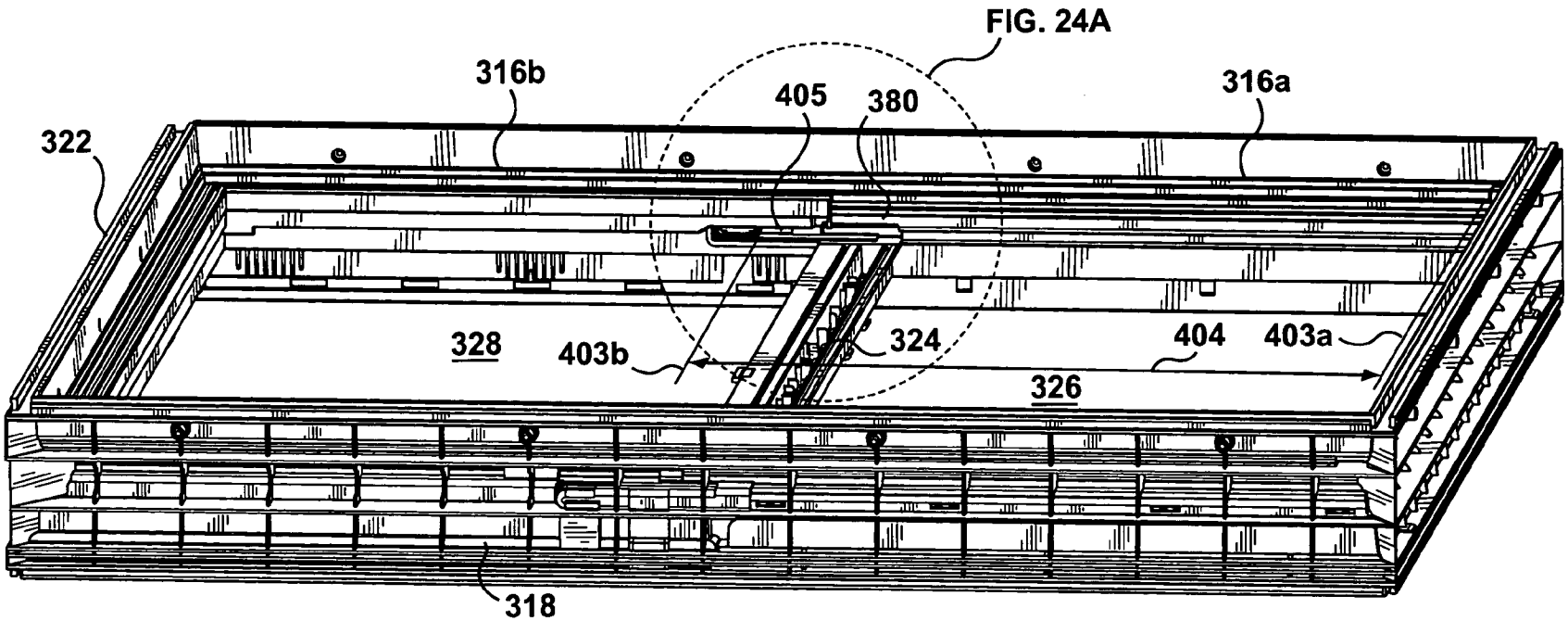
FIG. 24 is a perspective view of the frame assembly shown in FIG. 17, but viewed from below, and looking towards the opposite (interior) face of the frame assembly.

Referring now to FIGS. 23*a* and 24, a recess or cavity 405 is provided in the header 316 between the mullion 324 and the tongue 380, for extending the sash frame interlacing configuration 402 behind the mullion 324.

Figure 23C:
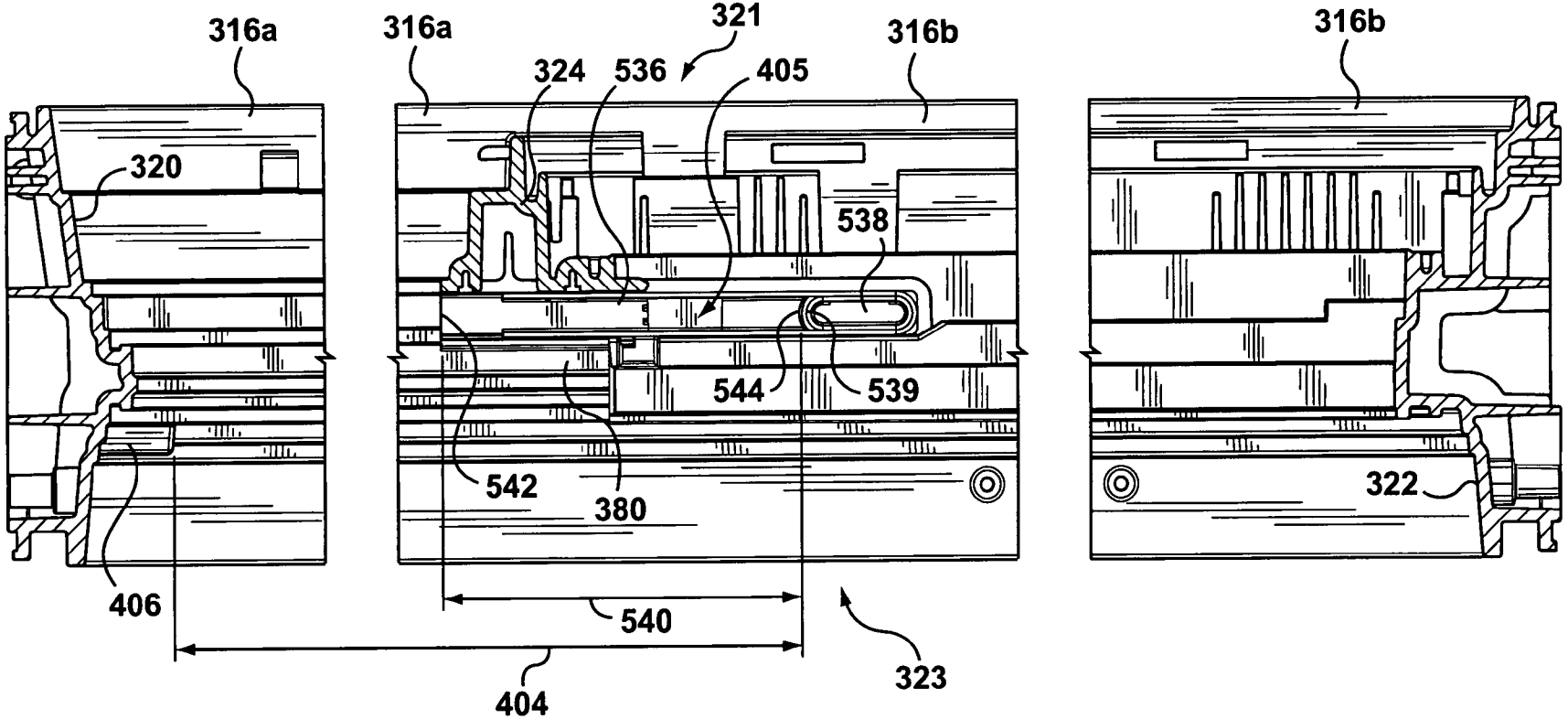
FIG. 23*c* is a sectional view of the assembly of FIG. 23, taken along the line 23*c*-23*c;*
Figure 24A:
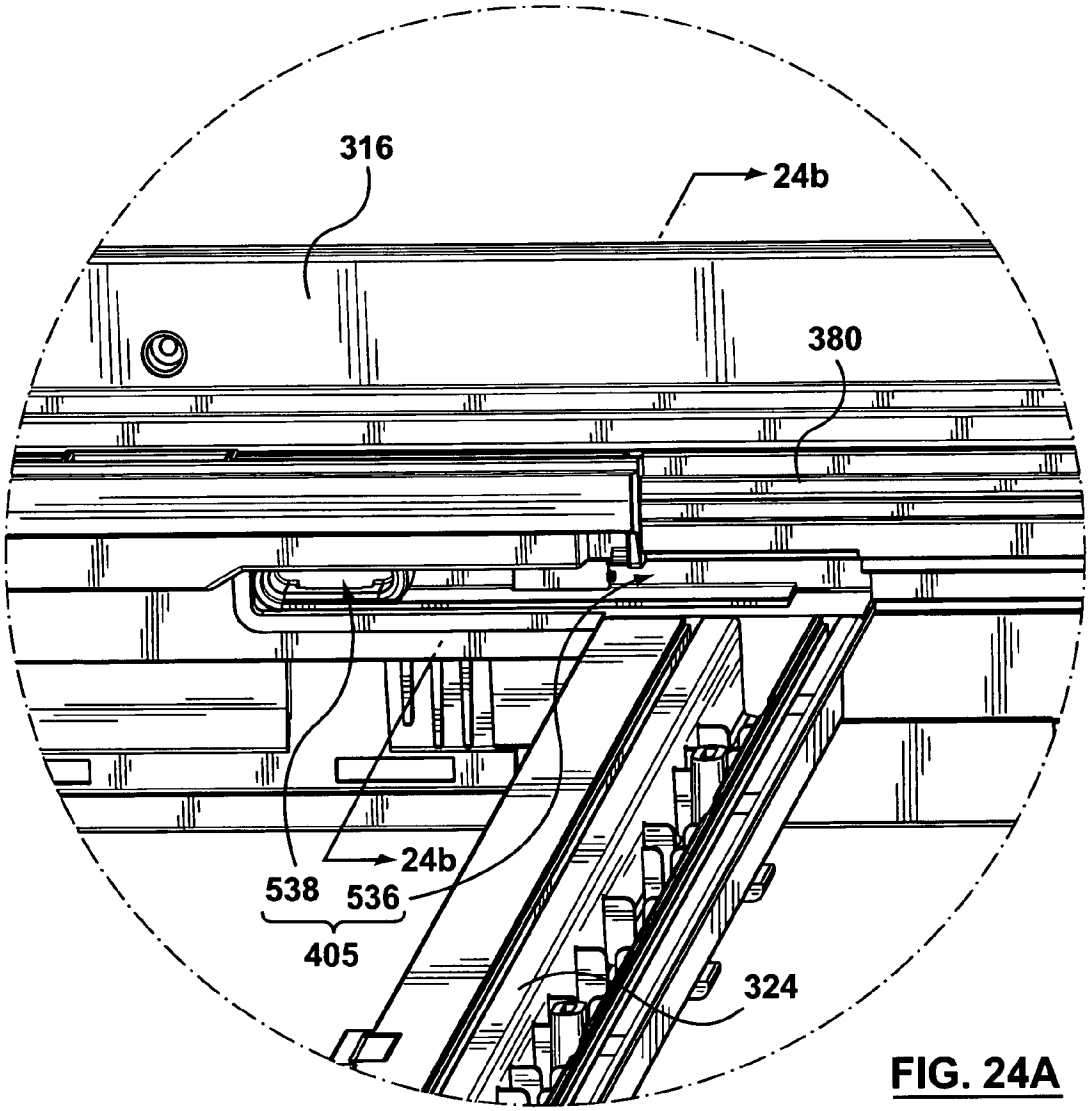
FIG. 24*a* is an enlarged portion of the frame assembly shown in FIG. 24.

As best seen in FIGS. 23*c* and 24*a*, the recess 405 has two portions, namely, a primary recess 536 and a secondary recess 538 that are separated from each other by a dividing wall 539. The primary recess 536 has a length 540 that extends from a first end 542 generally even with the edge of the mullion 324 nearest the vent jamb 322, to a second end 544 positioned along the second portion 316*b* of the header 316 and defined by the dividing wall 539. The second end 544 of the primary recess 536 is positioned to provide a space between the leading edge of the shoulder 406 and the second end 544 that corresponds to the lift-out position 404.

Figure 24B:
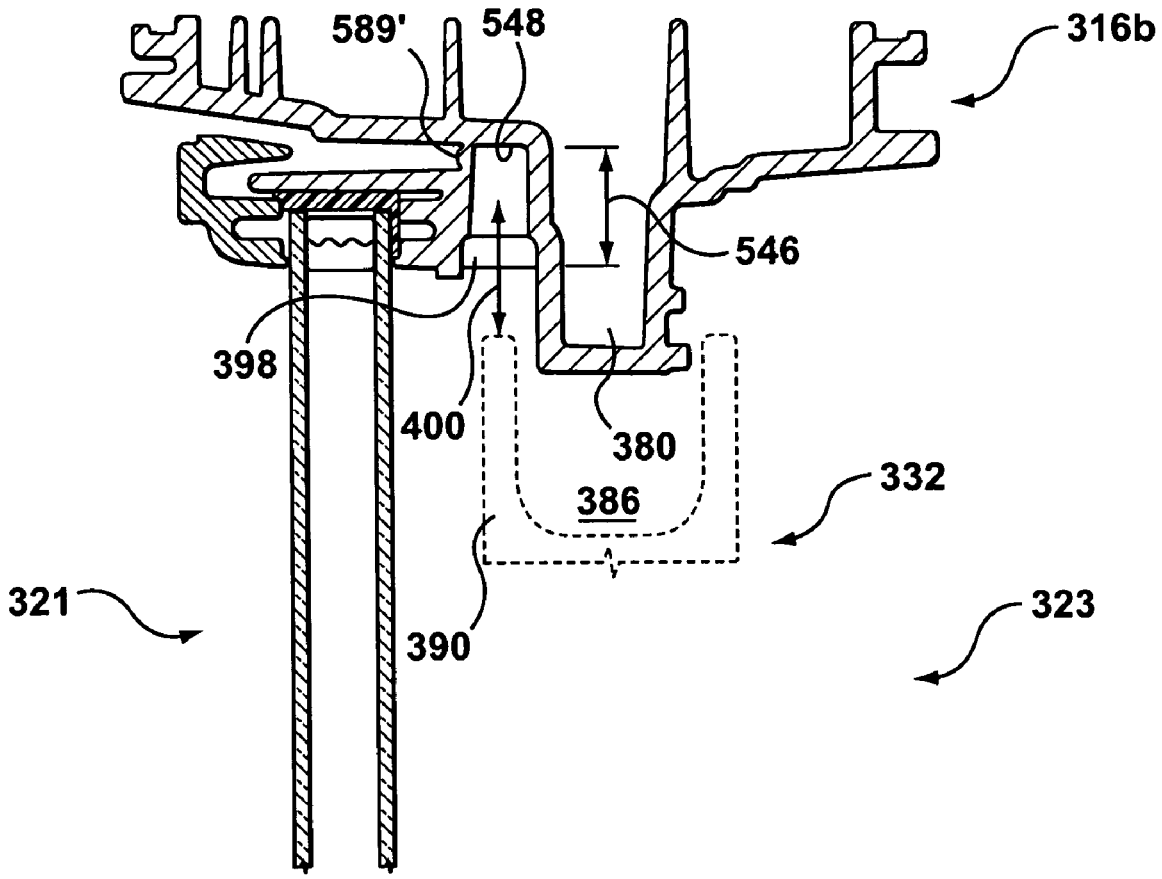
FIG. 24*b* is a sectional view of a portion of the frame assembly shown in FIG. 20, taken along the line 24*b*-24*b;*
Figure 24C:
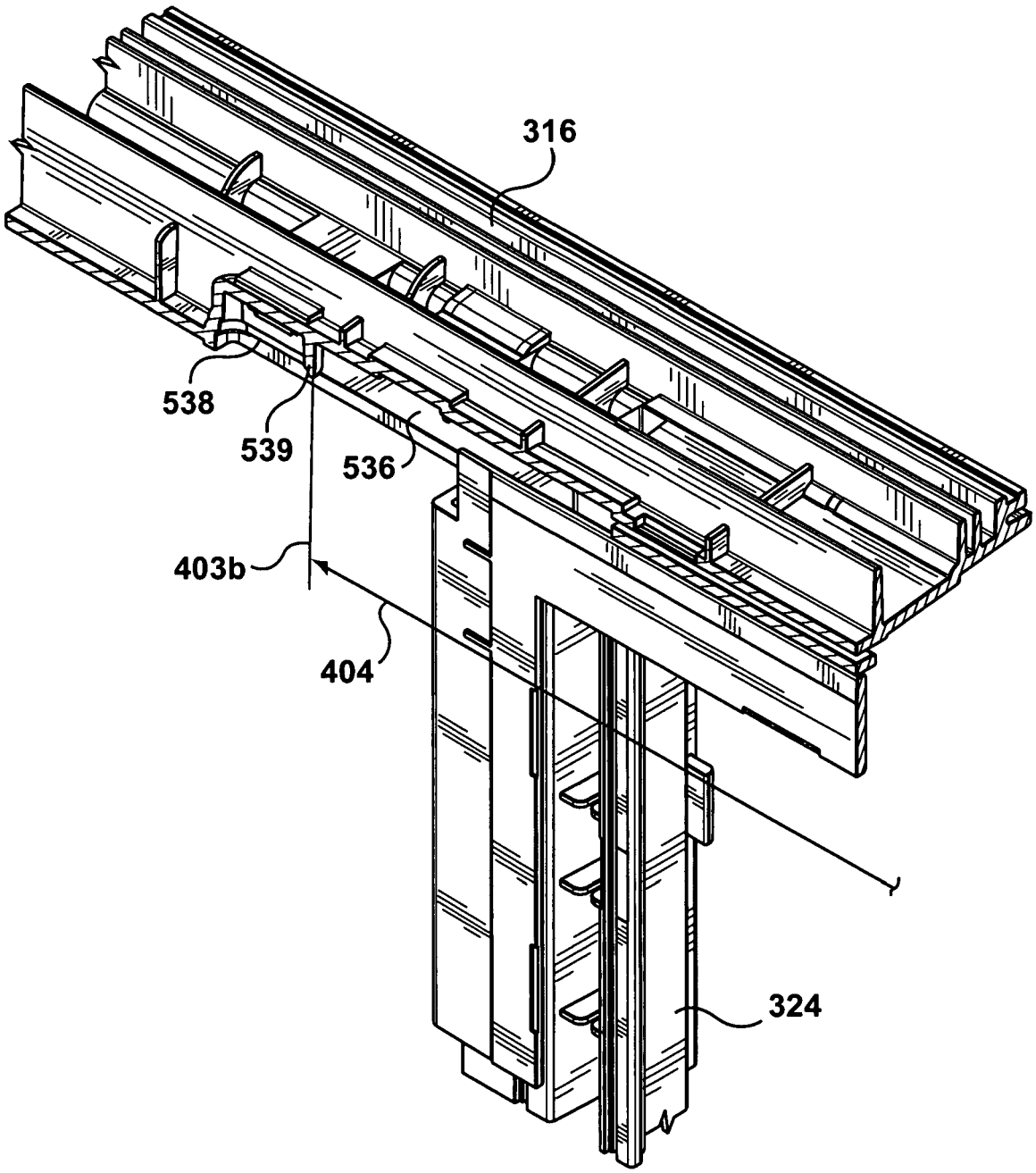
FIG. 24*c* is a perspective view of sectioned portion of the portion of the frame assembly shown in FIG. 24*b;*

Referring now to FIG. 24*b*, the primary recess 536 has a depth 546 that extends generally from the exterior shoulder 398 to a generally horizontal base surface 548. The depth 546 of the primary recess 536 is sufficient to provide the vertical clearance 400 between the base surface 548 and the exterior sidewall 390 of the groove 386 of the sash 314.

Figure 27A:
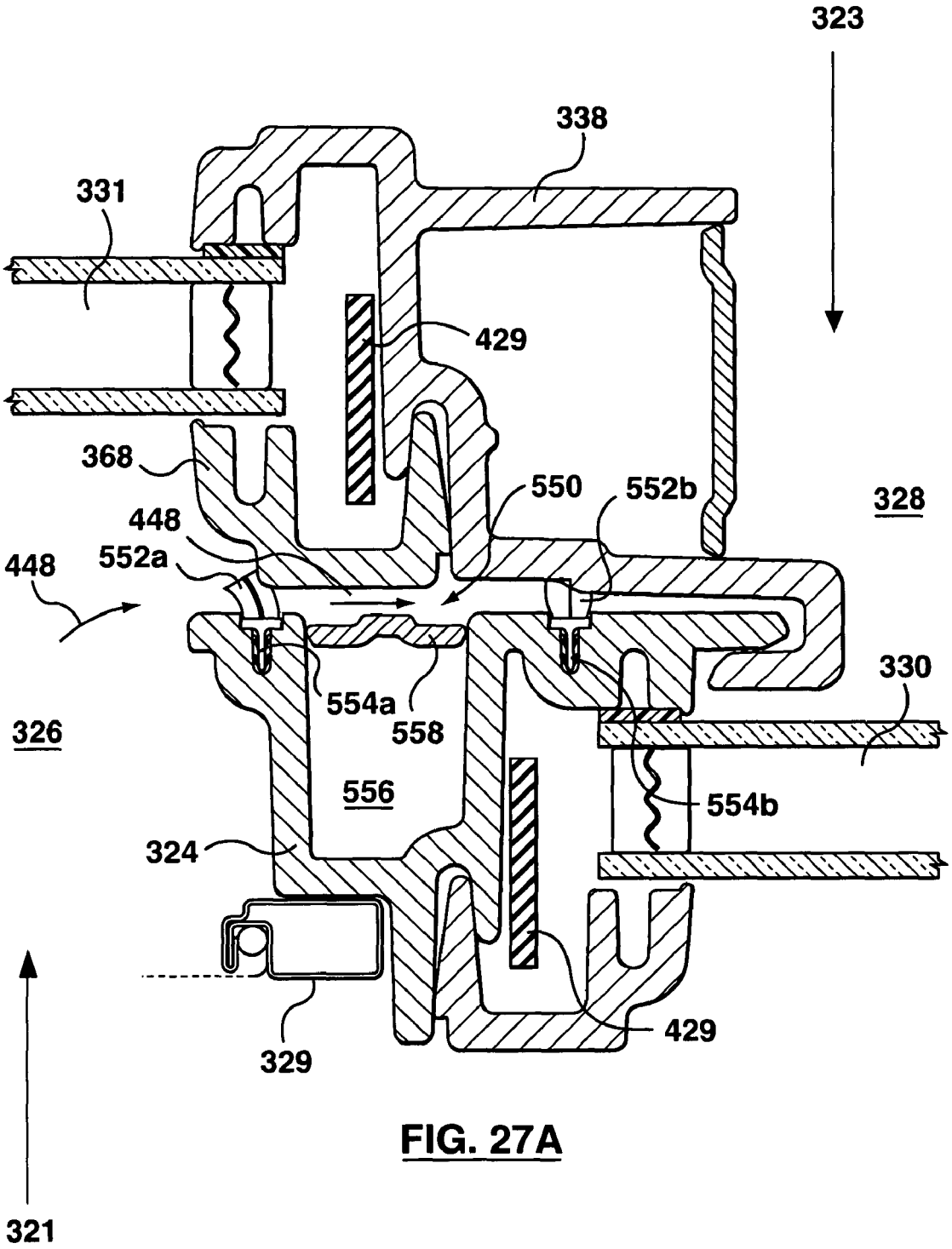
Figure 27B:
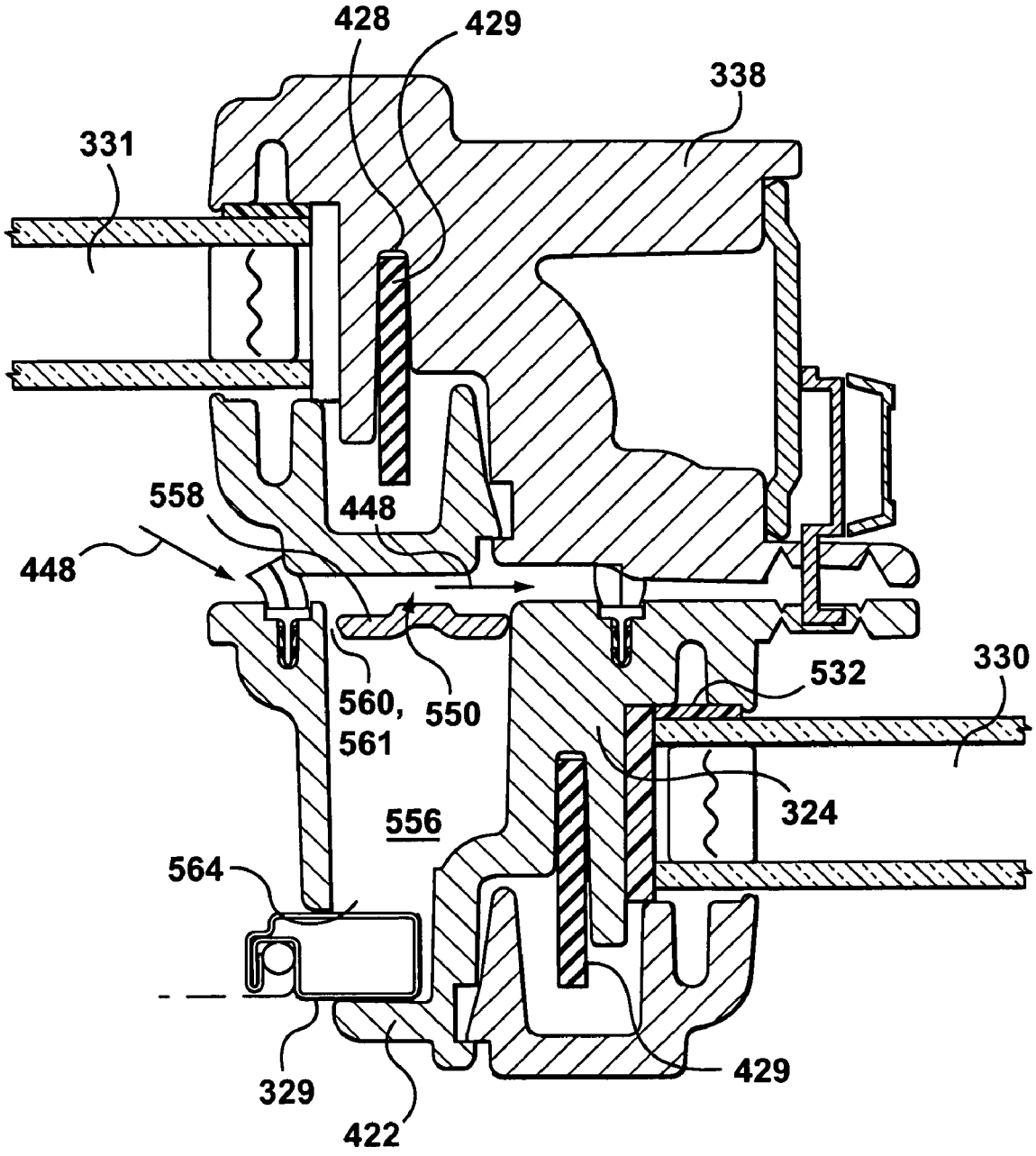

Referring now to FIGS. 27*a* and 27*b*, the frame assembly 310 is further provided with an optional weather buffering chamber 550 positioned in the pathway of air and water that may try to work its way from the exterior face 321 to the interior face 323 of the frame assembly 310 when in the closed position. Under certain weather conditions, relatively high pressure conditions caused by, for example, wind loads, can be applied to the exterior face 321 of the frame assembly 310, while the interior face 323 remains exposed to relatively low pressure conditions. This pressure differential across the frame assembly 310 can generate a suction-like effect, drawing the outside air, along with any water, to the interior side of the frame assembly 310, through any gaps or weaknesses in the seams between the sash frame 314 and the master frame 312.

The inventors have observed that one pathway along which air and water can be drawn through the frame assembly is between the mullion 324 and the sash checkrail 338. This pathway can be seen at arrows 448 in FIGS. 27*a* and 27*b*. To provide the weather buffering chamber 550, two spaced-apart strips of weatherstripping 552*a*, 552*b* are provided between the mullion 324 and the check rail 338.

The first strip of weatherstripping 552*a* extends along the height of the mullion 324, adjacent an edge of the mullion 324 near the vent side 326 of the frame assembly 310. The second strip of weatherstripping 552*b* extends generally parallel to the first strip, but is positioned nearer to the fixed side 328 of the frame assembly 310. In the embodiment illustrated, the strips of weatherstripping 552*a* and 552*b* can be press-fit into corresponding attachment slots 554*a* and 554*b* that extend along the height of the mullion 324. The slots 554*a* and 554*b* can be integrally moulded with the master frame 312. The space between the weatherstripping 552*a* and 552*b*, and between the mullion 324 and the checkrail 338 generally defines the weather buffering chamber 550.

The first strip of weatherstripping 552*a* has its upstream side (relative to the flow path 448) exposed directly to the exterior elements. The downstream side of the first strip 552*a* is exposed to the weather buffering chamber 550. The strip 552*a* acts as an exterior seal, serving as an initial wind and rain barrier, through which some penetration of wind or water can be tolerated. The first strip (exterior seal) 552*a* can be constructed of, for example, but not limited to, densely packed synthetic pile.

Any wind or rain that penetrates the external seal 552*a* ends up in the weather buffering chamber 550. The invading wind can elevate the air pressure in the chamber 550, so that the pressure is higher than interior conditions but lower than the exterior conditions. To manage the invading water, the chamber 550 can be provided with an exterior drain 555*a* for draining the invading water from the chamber 550 to the exterior 321 of the frame assembly 310. Further details of the exterior drain 555*a* are provided hereinafter.

The upstream side (relative to the flow path 448) of the second strip of weatherstripping 552*b* is not exposed directly to the exterior elements, but rather, is exposed to the weather buffering chamber 550. The downstream side of the second strip 552*b* is generally exposed to the interior 323 of the frame assembly 310. The second strip 552*b* acts as an "interior"

seal. It is generally undesirable to have significant amounts of wind or water penetrate the interior seal.

In use, the weather buffering chamber 550 reduces the air pressure and amount of water to which the interior seal 552*b* is exposed. This reduces the amount of air and water that ultimately penetrates from the exterior 321 to the interior 323 of the frame assembly 310. The inventors have found that in one aspect the buffering chamber divides the total pressure gradient across the assembly 310 into a first, exterior gradient across the exterior seal 552*a*, and a second, interior gradient across the interior seal 552*b*. By having two separate, discrete pressure gradients across each of the exterior and interior seals 552*a*, 552*b*, each of which is lower than the total pressure gradient across the frame assembly 310, the forces tending to draw air and water across these seals are reduced.

The inventors have observed that tuning or balancing the pressure gradients across the seals 552*a*, 552*b* can further enhance the overall wind and water resistance of the frame assembly 310. Having a very high pressure drop across one of the seals 552*a*, 552*b* relative to the other can reduce the effectiveness of the weather buffering chamber 550.

Figure 29:
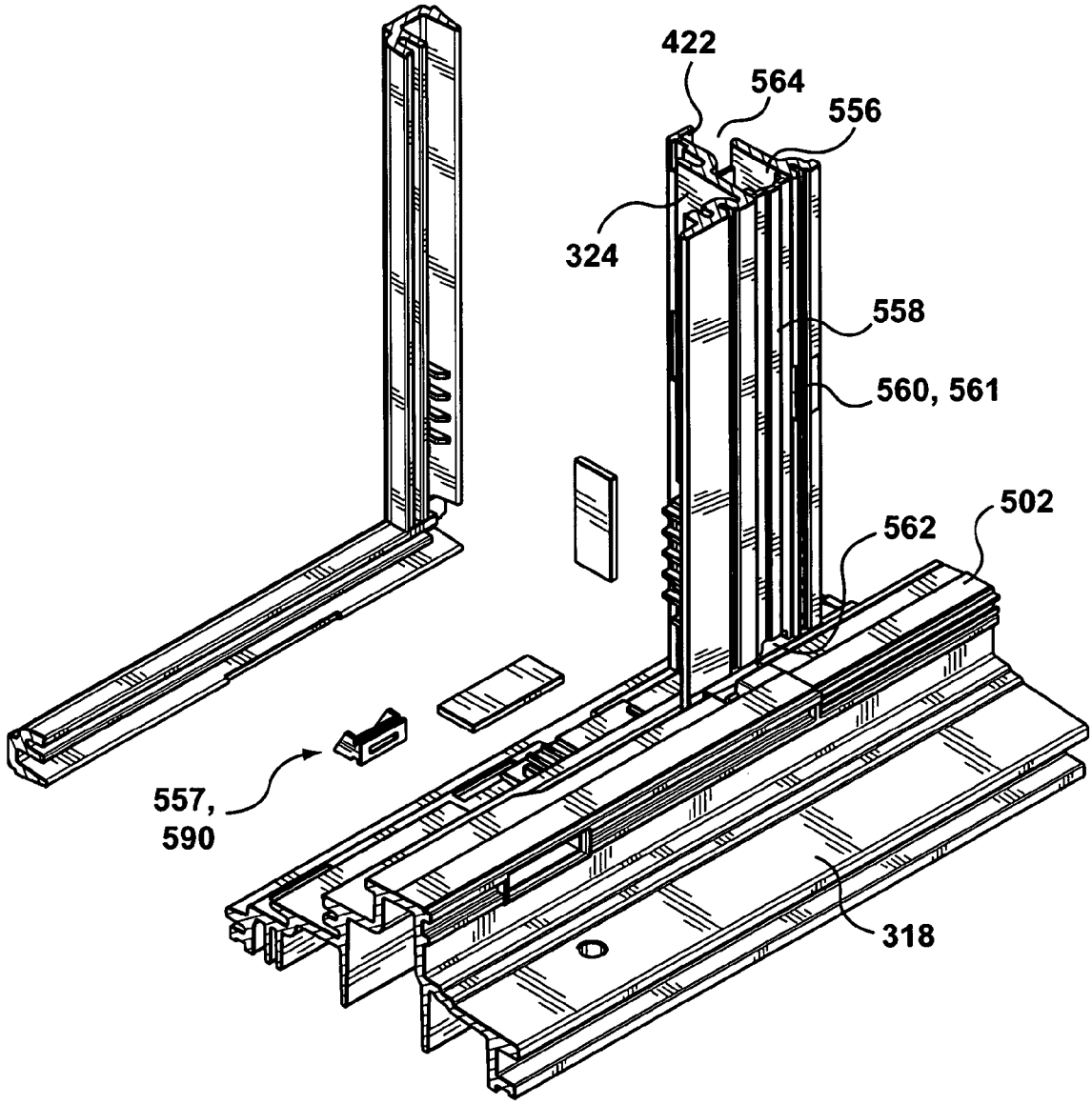
FIG. 29 is a perspective view of a portion of the frame assembly shown in FIG. 17, looking towards the interior face of the frame assembly.

Referring now to FIGS. 27*b* and 29, to facilitate tuning the external and internal pressure gradients, the weather buffering chamber 550 can be vented by providing ventilation apertures 560 between the chamber 550 and an adjacent air reservoir. This venting can, for example, reduce the pressure gradient across the exterior seal 552*a* by drawing air into the chamber 550 through the apertures 560, rather than through the exterior seal 552*a*. Preferably, the apertures 560 would draw on a supply of dry air (rather than a mixture of air and rain, for example), so that the amount of water to which the interior seal 552*b* is exposed is kept to a minimum.

In the embodiment illustrated, the mullion 324 has a generally hollow mullion cavity 556, which can serve as an air reservoir for supplying air to the chamber 550. The slots 554*a*, 554*b* for the seals 552*a*, 552*b* can be provided on opposite sides of the mullion cavity 556, so that the cavity 556 is in fluid communication with the chamber 550.

The mullion 324 can have a cover plate 558 that generally covers the cavity 556 and separates the mullion cavity 556 from the weather buffering chamber 550. The cover plate 558 can be assembled by means of a snap fit or press fit between the walls of the cavity 556.

To provide fluid communication between the cavity (or reservoir) 556 and the chamber 550 for venting the chamber 550, the cover plate 558 can have ventilation apertures 560 in the form of notches 561 along one edge. Alternatively, the notches 561 can be positioned along the walls of the mullion 324 adjacent the cover 558, to provide a gap between the mullion 324 and the cover 558. The cover 558 can also have cut-outs 562 at the upper and lower ends of the cover 558. The cut-out 562 at the upper end of the cover 558 can serve as an additional ventilation aperture 560. The cut-out 562 at the lower end of the cover 558 adjacent the sill 318 (see FIG. 29) can also act as a ventilation aperture 560, and can also allow any water that may be in the mullion cavity 556 to drain into the weather buffering chamber 550.

The mullion cavity 556 can be in fluid communication with the exterior atmosphere by means of external apertures 564 provided in the sidewalls of the mullion 324, on the opposite side of the cover 558 as the chamber 550. In the embodiment illustrated, the external apertures 564 are integrally moulded in the mullion 324 at a position behind the lugs 422 for retaining the window screen 329 (FIG. 27*b*). Although the screen, when installed, partially obstructs the external aperture 564, air can still easily flow through the gaps between the screen 329 and the adjacent surfaces of the mullion 324. This positioning of the external apertures 324 can help to keep rain from entering into the mullion cavity 556.

Details concerning the drainage of any water that may penetrate the exterior and interior seals 552*a*, 552*b* will now be described with reference to FIGS. 30 and 31. In accordance with the present invention, independent exterior and interior drains shown generally at 555*a* and 555*b* are provided for draining any water that makes its way to the downstream side of the exterior and the interior seals 502*a* and 502*b*, respectively. The exterior and interior drains 555*a* and 555*b* are formed from the cooperation of various surfaces of the master frame 312 and the sash frame 314 when the sash frame 314 is in the closed position, and provide separate exterior and interior water drainage flow paths 553*a* and 553*b*, respectively, as will hereinafter be described in greater detail.

The separate drains 555*a* and 555*b* can cooperate with, and enhance the function of, the weather buffering chamber 550. For example, the exterior drain 555*a* and interior drain 555*b* each drain water between environments having distinct pressure differentials between them. The pressure differential across the drains can be a significant factor in keeping water from penetrating to the interior face 323, since, particularly under high load conditions, the suction effect can draw water in through the drain, rather than discharging water to the exterior.

In the embodiment illustrated, the exterior drain 555*a* drains water from the weather buffering chamber 550 to the exterior face 321 of the frame assembly 310. The pressure differential across the chamber 550 and the exterior face 321 (and hence across the exterior drain 555*a*) is generally equal to the exterior pressure gradient across the exterior seal 552*a*, which is less than the total pressure gradient between the exterior and interior faces 321, 323. The interior drain 555*b*, however, drains water from the interior face 323 to the exterior face 321 of the frame assembly 310. The pressure differential across the interior drain is therefore equal to the total or maximum air pressure across the exterior and interior faces of the frame assembly 310, which will generally be equal to the sum of the pressure differentials across the exterior seal 552*a* and the interior seal 552*b*.

The exterior drain 555*a* discharges water from the chamber 550 directly to the exterior along the flow path 553*a*. The reduced pressure differeintial across the exterior drain 555*a* (i.e. from inlet end to outlet end of the drain 555*a*) permits direct discharge to the exterior face 321 without significant suction problems than inhibit drainage. The interior drain 555*b* discharges water from the interior to the exterior via a valve element 557 which is placed between upstream and downstream portions of the flow path 553*b*. The valve element is movable between an open position 557*a*, in which the interior and exterior environments are in fluid communication, and a closed position 557*b*, in which fluid communication through the interior drain 555*b* is sealed off.

In the embodiment illustrated, to provide the exterior and interior drains 555*a* and 555*b*, the inventors have made clever use of the recess 405 that is located in the sill 318. The recess 405 in the sill 318 is the same as the recess 405 in the header 316, and is provided in the sill 318 so that the frame assembly 310 can be inverted to reverse the relative positions of the vent and fixed sides 326 and 328.

Figure 30:
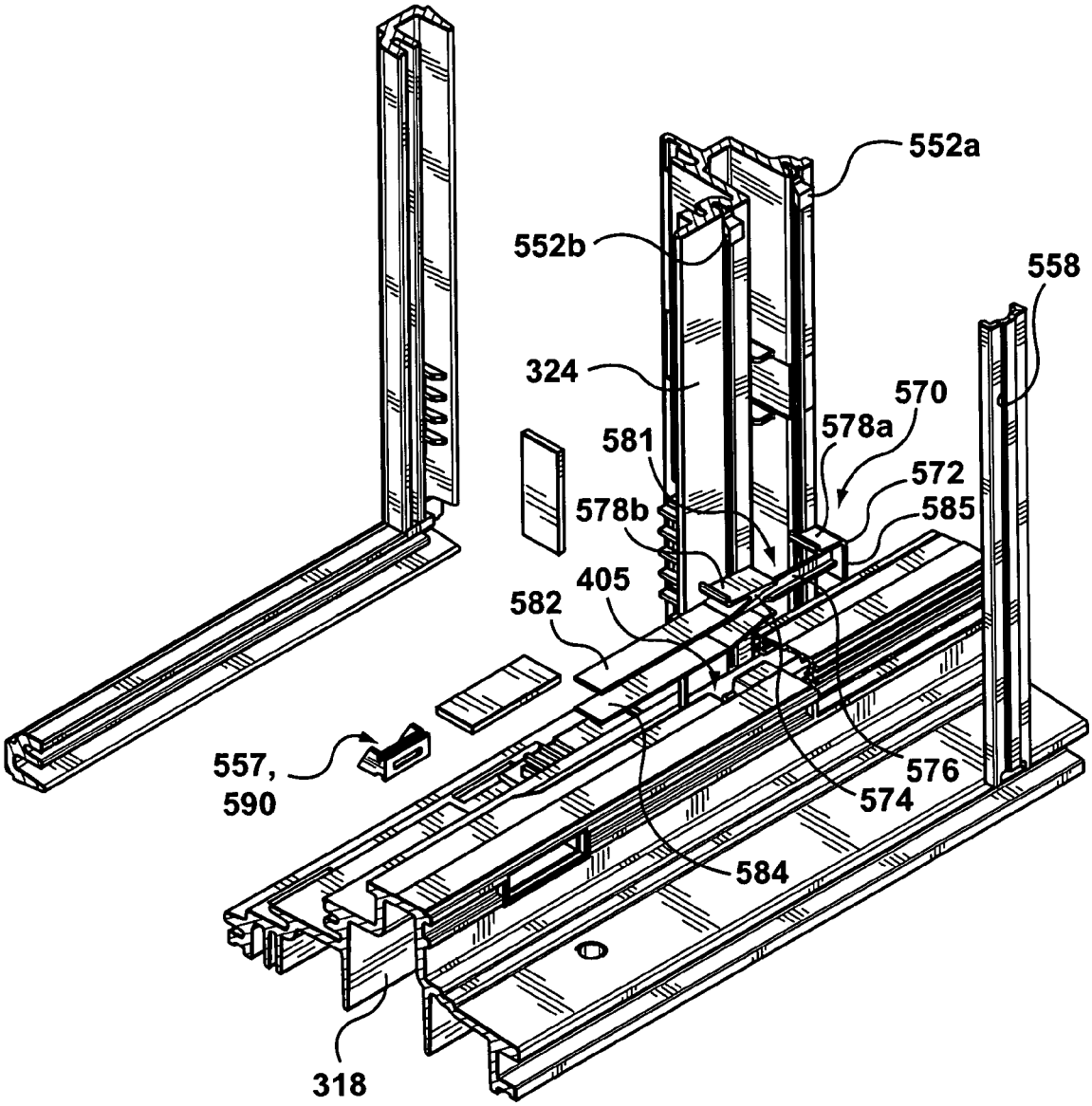
FIG. 30 is an exploded perspective view of the portion of the frame assembly shown in FIG. 29.
Figure 31:
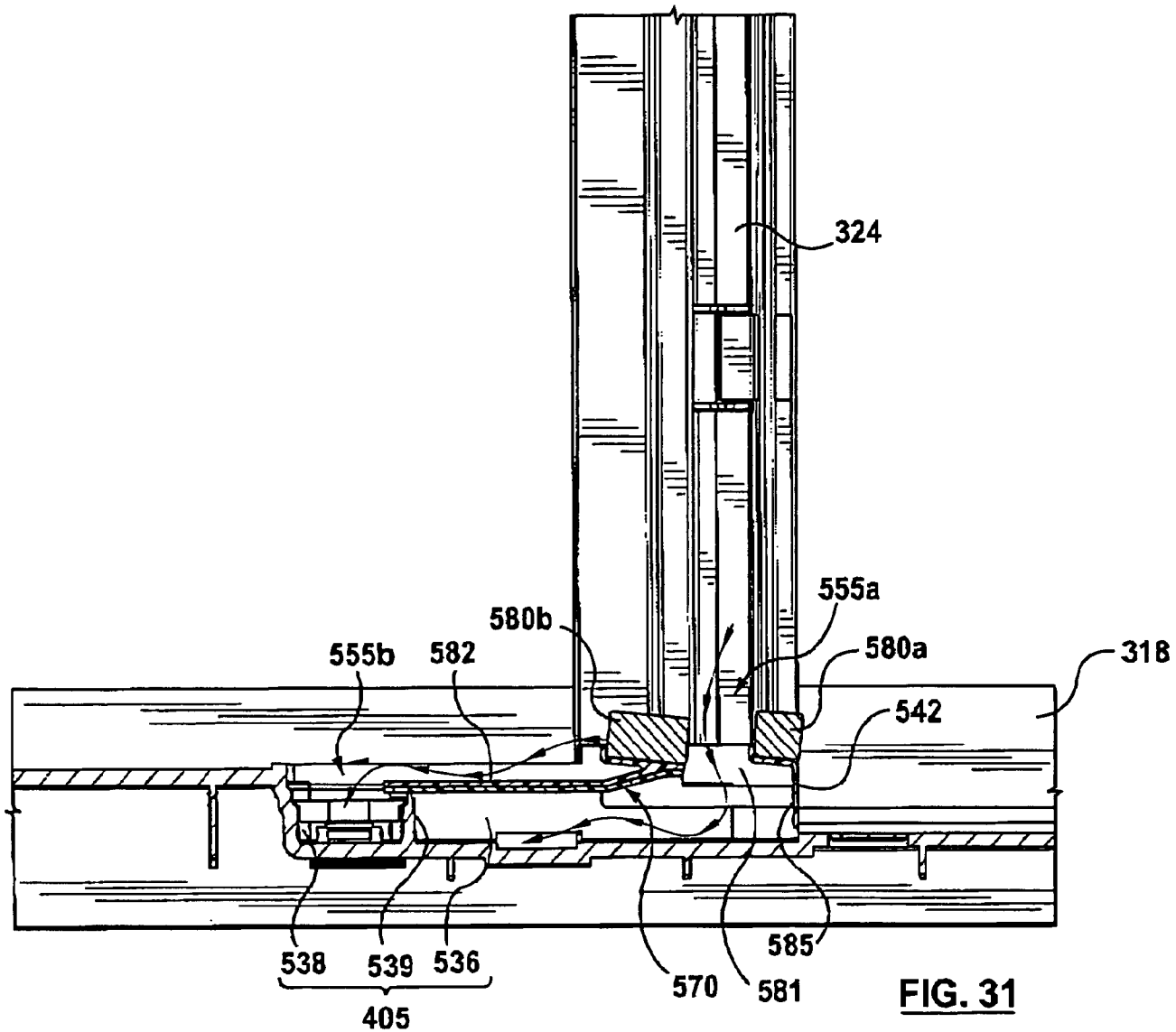
FIG. 31 is front elevation view of a sectioned portion of the portion of the frame assembly shown in FIG. 30.
Figure 31A:
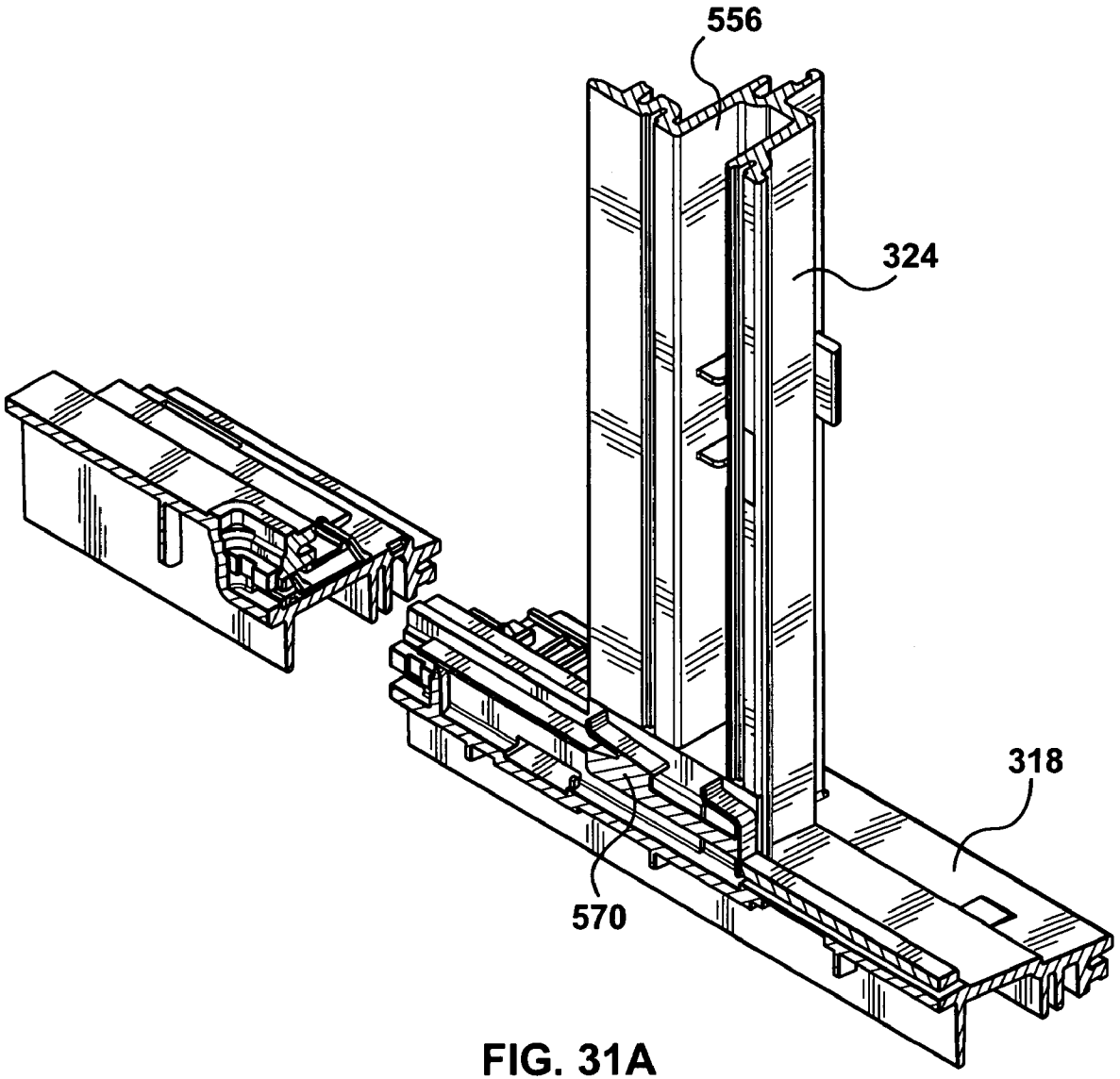
FIG. 31*a* is a perspective view of the sectioned portion of the frame assembly shown in FIG. 31.

The recess 405 in the sill 318 is generally covered by a diverter cap 570 (FIG. 30). The diverter cap 570 has an exterior portion 572 and an interior portion 574 connected to each other by a web 576. The exterior and interior portions 572, 574 each have dust plug supports 578*a*, 578*b* for supporting exterior and interior dust plugs 580*a*, 580*b*, respectively (FIG. 31).

The exterior and interior dust plug supports 578*a*, 578*b* (and dust plugs 580*a*, 580*b*) are spaced apart so that they are generally aligned with the exterior and interior seals 552*a* and 552*b* extending along the mullion 324. The supports 578*a*, 578*b* and dust plugs 580*a*, 580*b* generally fill the width of the recess 405, and form a continuous seal with exterior and interior seals 552*a* and 552*b*, respectively. The dust plugs 580*a* and 580*b* engage the underside of the sash 314. The supports 578*a*, 578*b* resiliently urge the dust plugs upwards into contact with the sash 314.

The space between the exterior and interior supports 578*a*, 578*b* and dust plugs 580*a*, 580*b* and around the narrow web 576 provides an opening 581, forming part of the exterior drain 555*a* and through which the flow path 553*a* extends. The diverter cap 570 further has a seal plate portion 582 (FIG. 31) extending from the exterior portion 574, to a length that reaches and extends beyond the divider wall 539, such that the seal plate portion 582 slightly overhangs above the secondary recess 538.

The diverter cap 570 can be secured in the recess 405 in the sill 318 by means of dual sided adhesive sealant tape 584 provided between the underside of the seal plate portion 582 of the diverter cap 570 and the upper periphery of the primary recess 536 and positioned towards the interior side 323 of the interior dust plug 580*b*. The interior portion 572 of the diverter cap 570 is supported by a leg 585 extending downward from the exterior dust plug support 578*a* and generally abutting the first end 542 of the primary recess 536.

As best seen in FIG. 31 and FIGS. 35-37, the diverter cap 570 with the exterior and interior dust plugs 580*a* and 580*b* provides a further part of the sealed exterior drain 555*a* that forms flow path 553*a*. The flow path 553*a*, for draining water from the weather buffering chamber 550, is sealed on the exterior side by the exterior seal 552*a* (see FIGS. 27*a* and *b*) and exterior dust plug 580*a*. The flow path 553*a* is sealed on the interior side by the interior seal 552*b*, interior dust plug 580*b*, and the seal plate portion 582 of the diverter cap 570. The drain 555*a* is in fluid communication with the chamber 550 at the upstream side, and with the exterior atmosphere on the downstream side.

Most of the water that makes its way into the buffering chamber 550 will generally be drained through the exterior drain 555*a*. Accordingly, the pressure differential across the interior seal 502*a* will generally draw only air to the interior face 323 of the frame assembly 310, rather than water and air. However, under high loads, some water may work its way to the downstream side of the interior seal 502*a*. Although this may be undesirable, such water penetration is acceptable provided it is contained along the sill 318. Typical rating standards generally require that interior water be contained to the extent that it can eventually drain back to the exterior side 321 of the frame assembly 310. Wind loads are typically cyclical, so that periods of high load and highly increased water penetration are punctuated by periods of lower loads in which little or no water penetrates, and any contained water can drain. Tests to determine window ratings initiate these fluctuations by cycling applied loads between higher and lower pressure ratings.

One method for containing water that penetrates to the interior of a window is to provide the frame with a vertical barrier along the inside of the sill 318, forming a well in which a volume of water can collect or build-up during the higher-load periods. To achieve high ratings, however, such barriers must be of significant size so that a well of sufficient volume is created. Large vertical barriers can increase the raw material cost of the window, and can be unsightly and reduce the proportion of viewing area of the window relative to the frame dimensions. Furthermore, having a substantial pool of water along the interior of a window can be undesirable.

Figure 34:
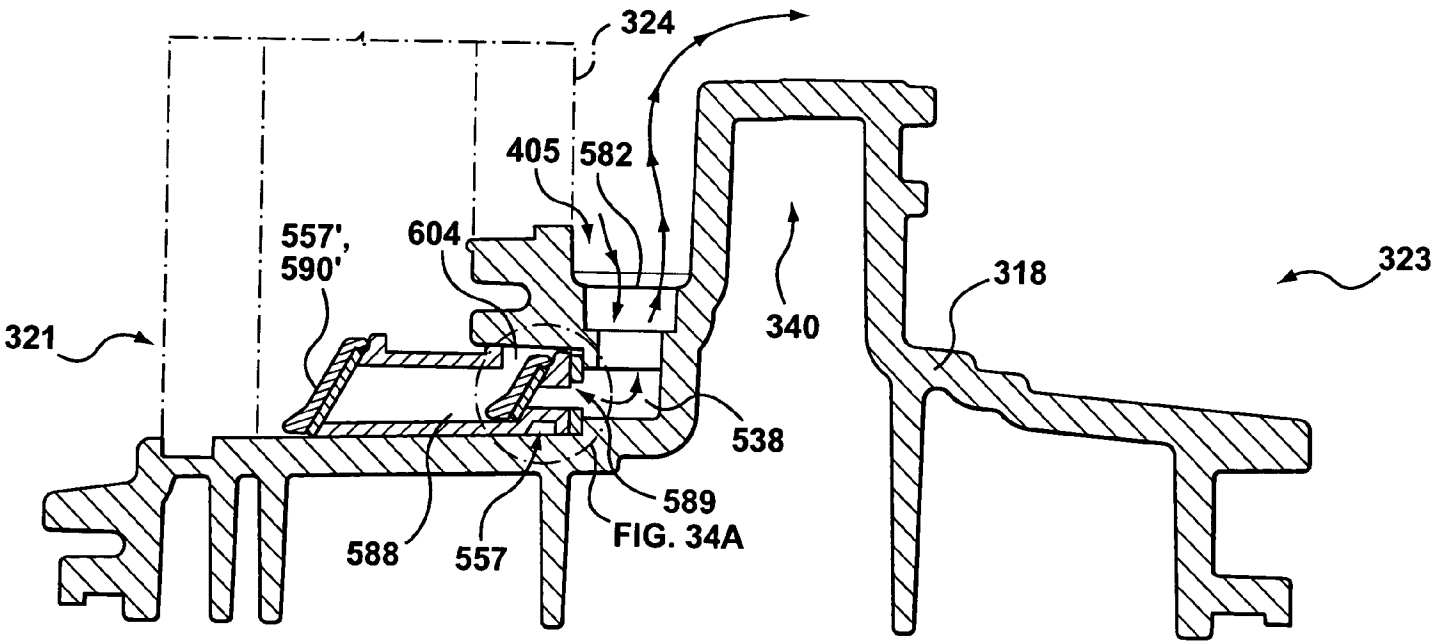
FIG. 34 is a vertical section view of a portion of the frame assembly shown in FIG. 32.
Figure 34A:
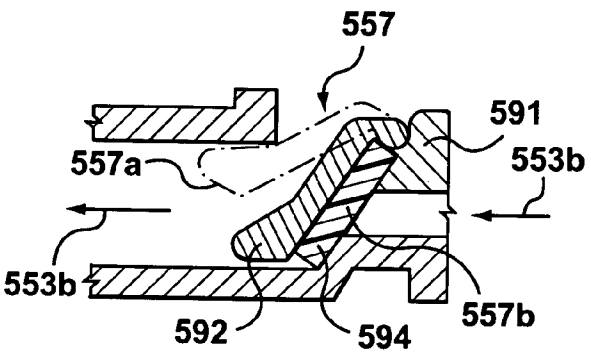
FIG. 34*a* is an enlarged view of a portion of FIG. 34 showing a sealed valve element in greater detail.
Figure 35:
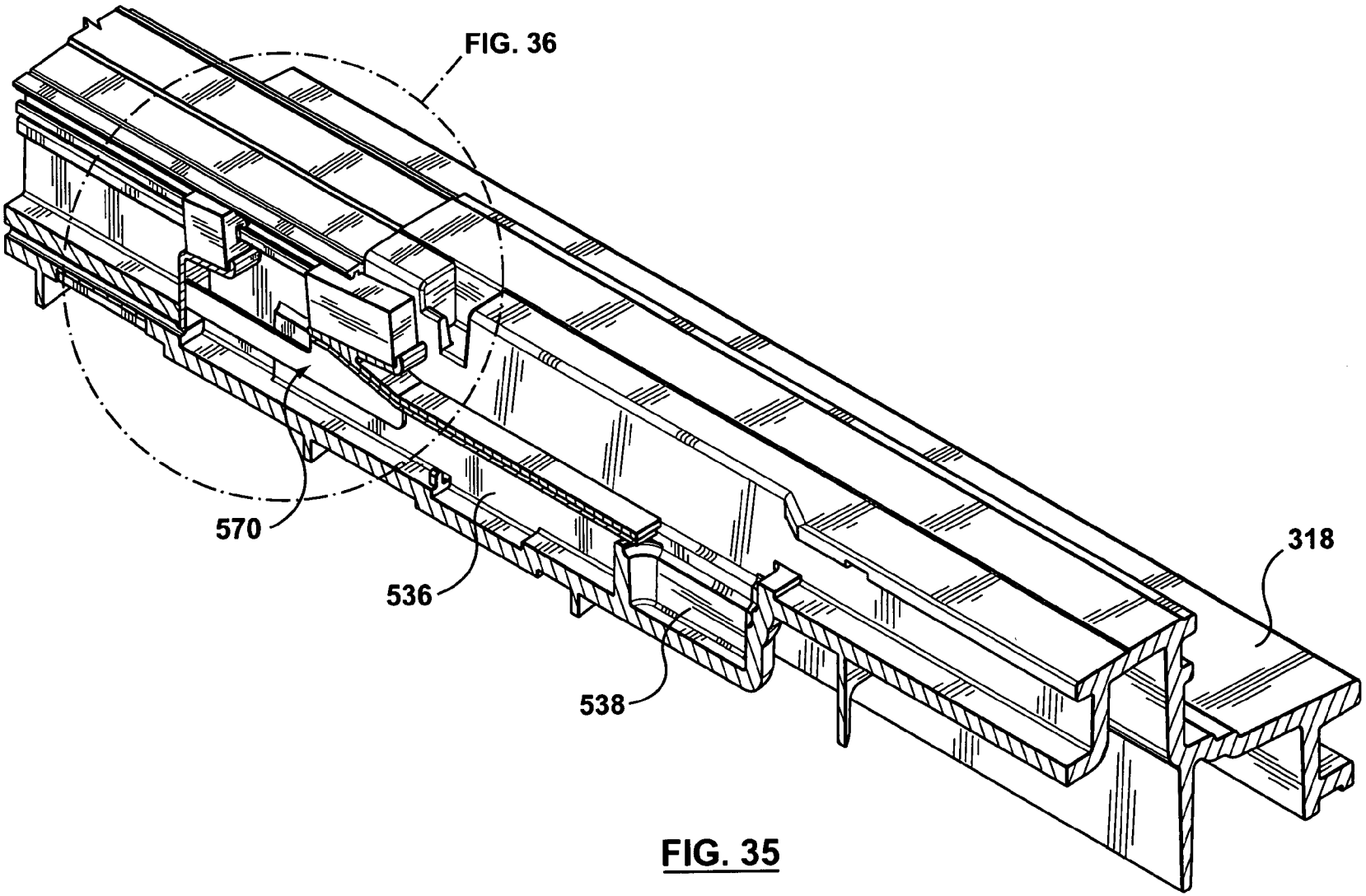
FIG. 35 is an enlarged perspective view of a portion of the frame assembly shown in FIG. 32.
Figure 36:
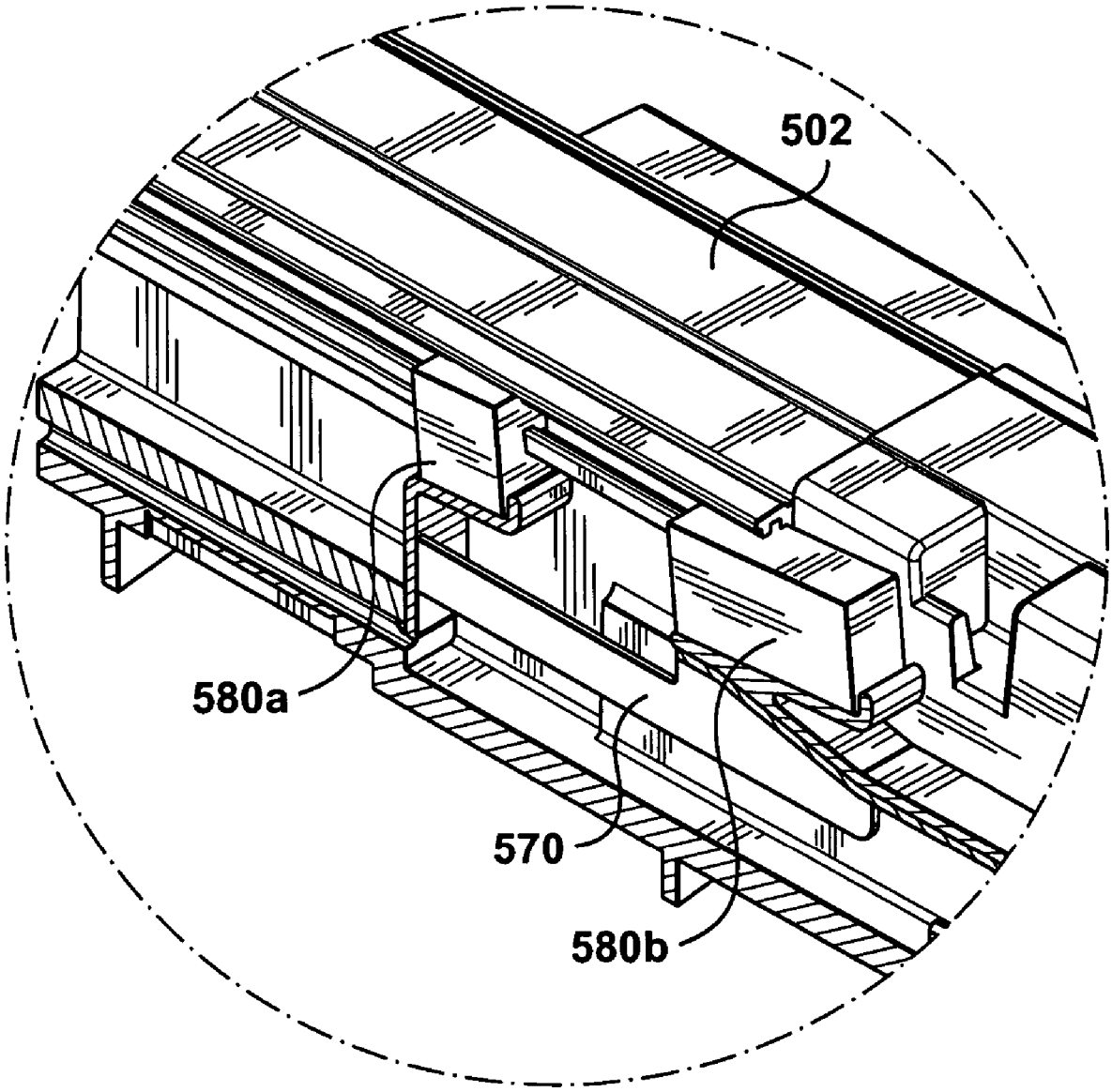
FIG. 36 is a further enlarged perspective view of a portion of the frame assembly shown in FIG. 35.
Figure 37:
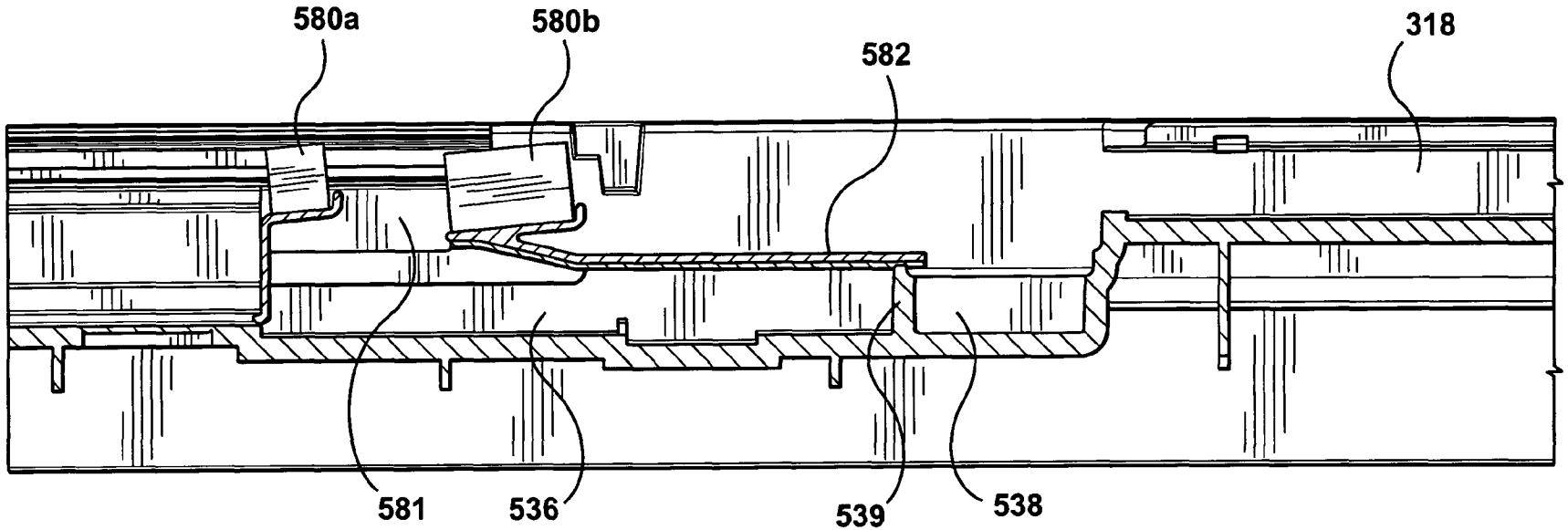
FIG. 37 is a front sectional view of the portion of the frame assembly shown in FIG. 35.

In the present invention, the weather buffering chamber 550 greatly reduces the amount of water that penetrates the interior seal for a given load. Water that does penetrate the interior seal is drained by means of the interior drain 555*b*. The interior drain 555*b* comprises the secondary recess 538 in the sill 318, along with an intake channel 586 and an outlet channel 588. The intake channel 586 is provided along the upper surface of the seal plate portion 582 of the diverter cap 570, between upper portions of the vertical sidewalls of the recess 405 that extend along either side of the seal plate portion 582 (FIG. 34). The intake channel extends between the interior dust plug 580*b* and the secondary recess 538.

Figure 33:
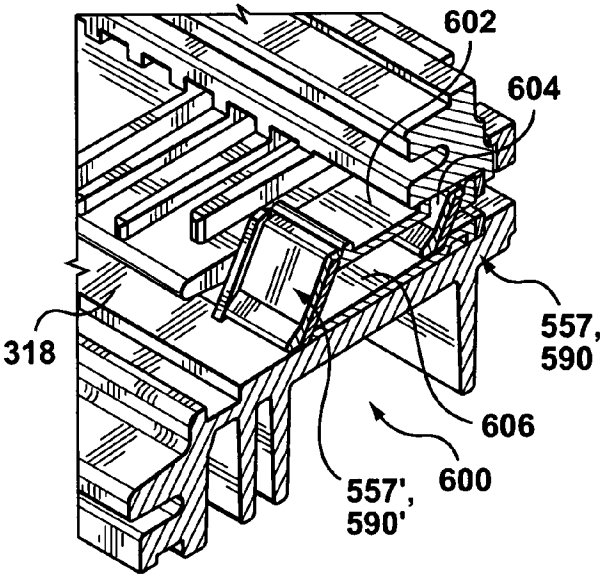
FIG. 33 is an enlarged perspective view of a portion of the frame assembly shown in FIG. 32.
Figure 32:
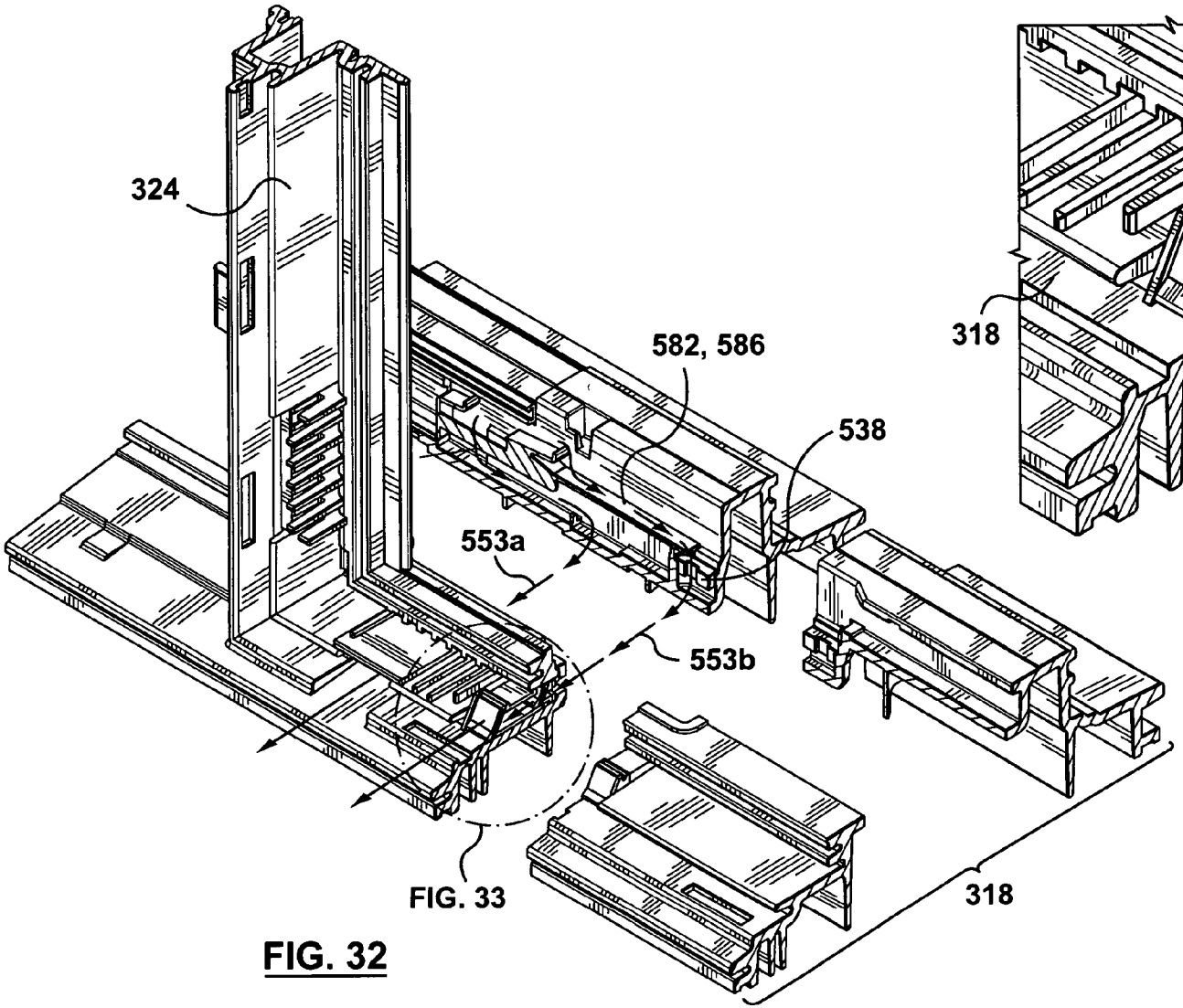
FIG. 32 is a perspective view of the portion of the frame assembly shown in FIG. 29 but looking at the exterior face of the frame assembly, and showing spaced-apart sections to better illustrate some inner features.

The outlet channel 588, as best seen in FIGS. 32-34, extends from the secondary recess 538 to the exterior face 321 of the frame assembly 310. An aperture 589 is provided between the recess 538 and the channel 588 (FIG. 34). The aperture 589 can be provided by removing a break at panel 589', which is left in tact in the header 316 (see FIG. 24*b*). In the embodiment illustrated, the outlet channel 588 is provided with the valve element 557 in the form of a sealed weep 590. The weep 590 has a frame 591 and a hinged flap 592 supported in the frame 591. The flap 592 has a gasketed upstream surface 594. During periods of high loads, the suction pulls the flap 592 tightly closed, so that the gasketed surface 594 is tightly sealed against the periphery of the frame 591. During low load conditions, the force of upstream water can push the flap 592 open to allow collected water to drain.

The valve element 557 can comprise a single sealed weep 590 (FIGS. 29 and 30), or alternatively, can comprise a regulator drain valve assembly 600 (FIGS. 32-34). The valve assembly 600 has a housing 602 with one sealed weep 590 positioned at an upstream end, and a second weep 590' positioned at a downstream end of the assembly 600. The second weep 590' can be the same as the sealed weep 590, or alternatively, can be unsealed devoid of the gasketing 594. Apertures 604 can be provided between the weeps 590 and 590' to permit some ventilation and entry of dry air into the space 606 between the weeps 590 and 590'.

Figure 38:
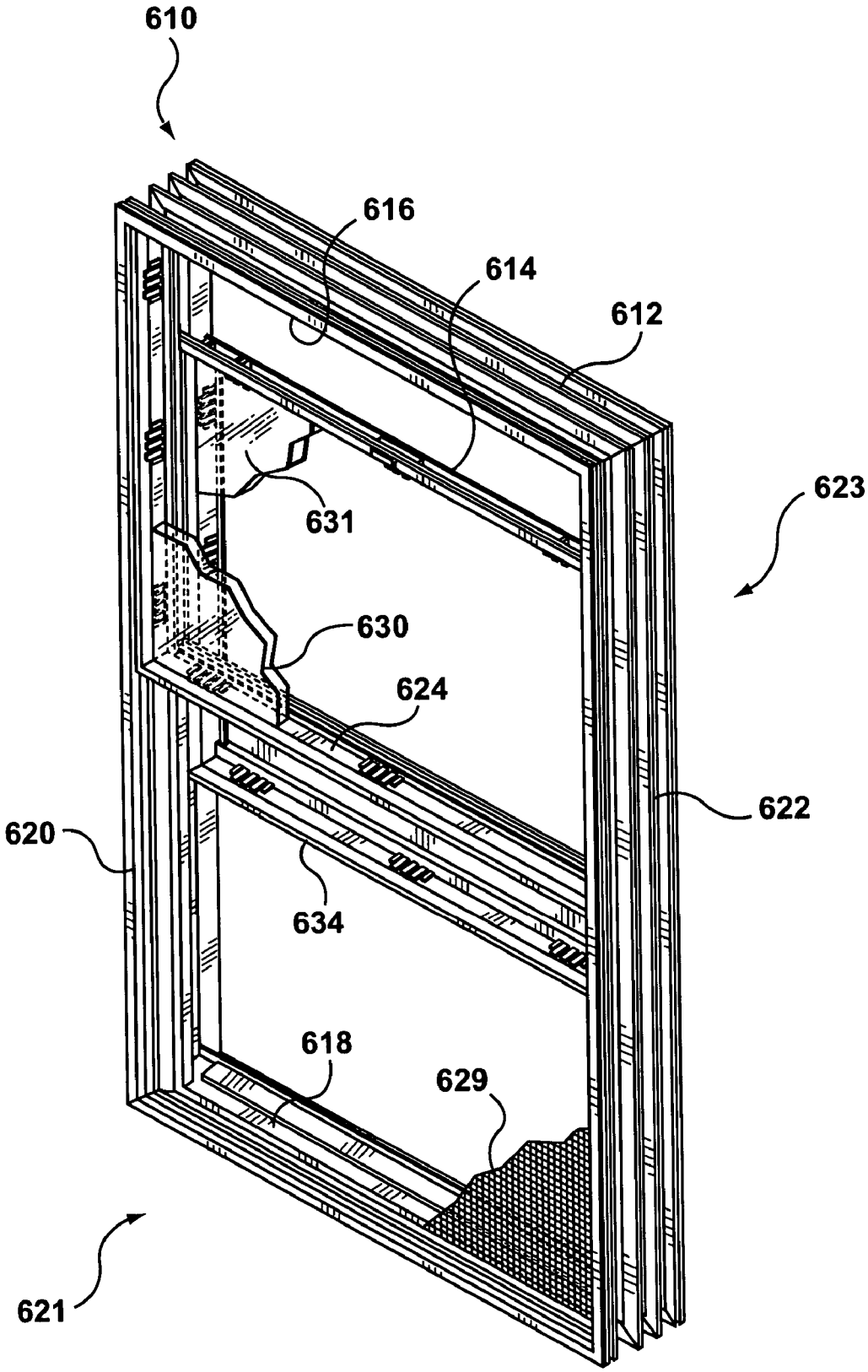
FIG. 38 is a perspective view of another embodiment of a frame assembly according to the present invention, viewed from the exterior.

Referring now to FIG. 38, another alternate embodiment of a frame assembly 610 according to the present invention is shown. The frame assembly 610 provides a vertically sliding sash rather than a horizontally sliding sash of the assembly 110. Features of the frame assembly 610 corresponding to those of the frame assembly 110 have been identified by like reference numerals, incremented by 500.

The general construction of the window frame assembly 610 with its master frame 612 and sash frame 614 can be seen in FIGS. 38-45. In the embodiment illustrated, the frame assembly 610 has only one slidable sash 614 and one fixed sash, in a configuration commonly known as a single hung window. Other configurations of a vertical sliding sash frame assembly, such as, for example, but not limited to, a double hung window, could also be provided.

Figure 39:
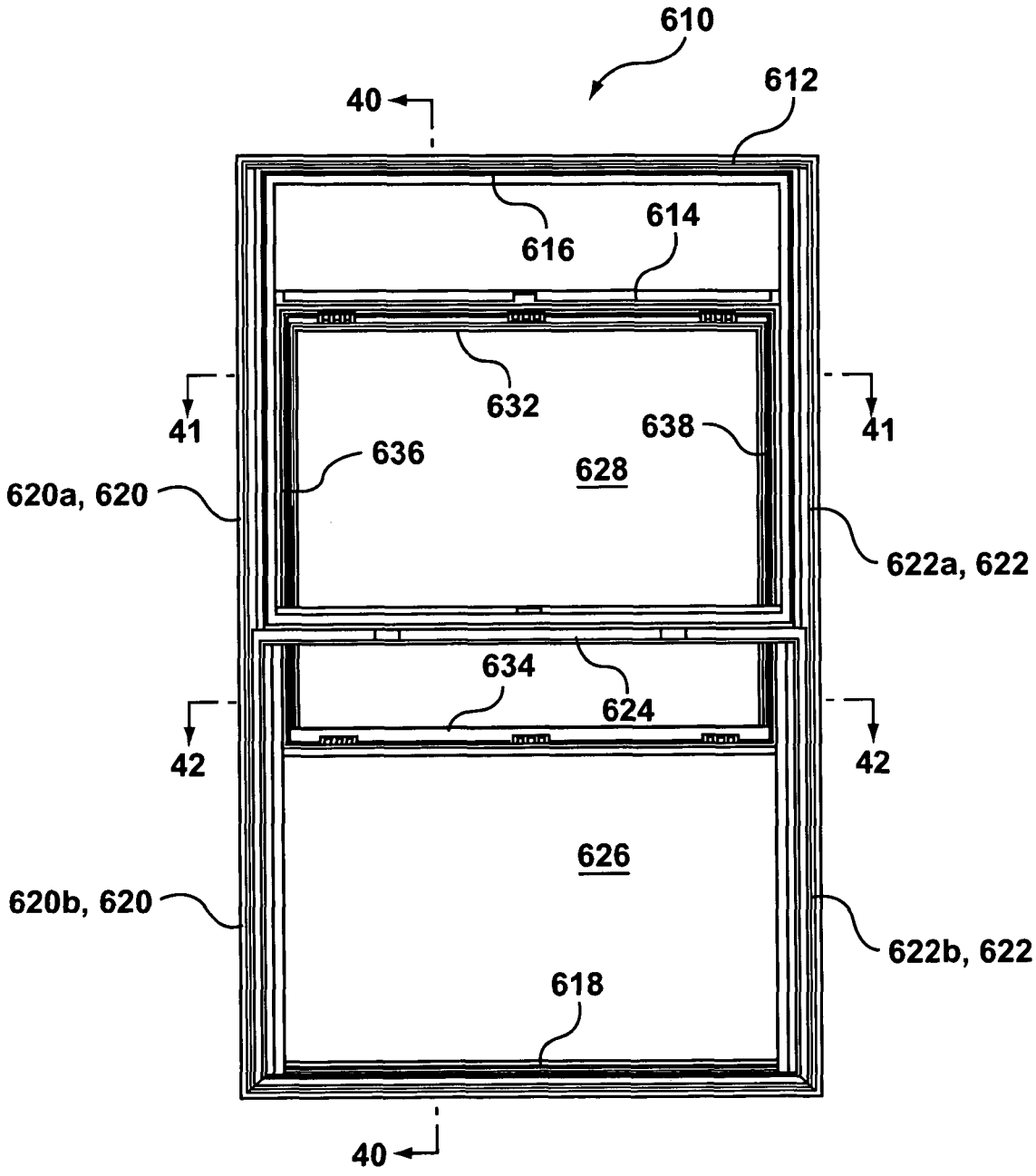
FIG. 39 is an exterior elevation view of the assembly of FIG. 38.
Figure 40:
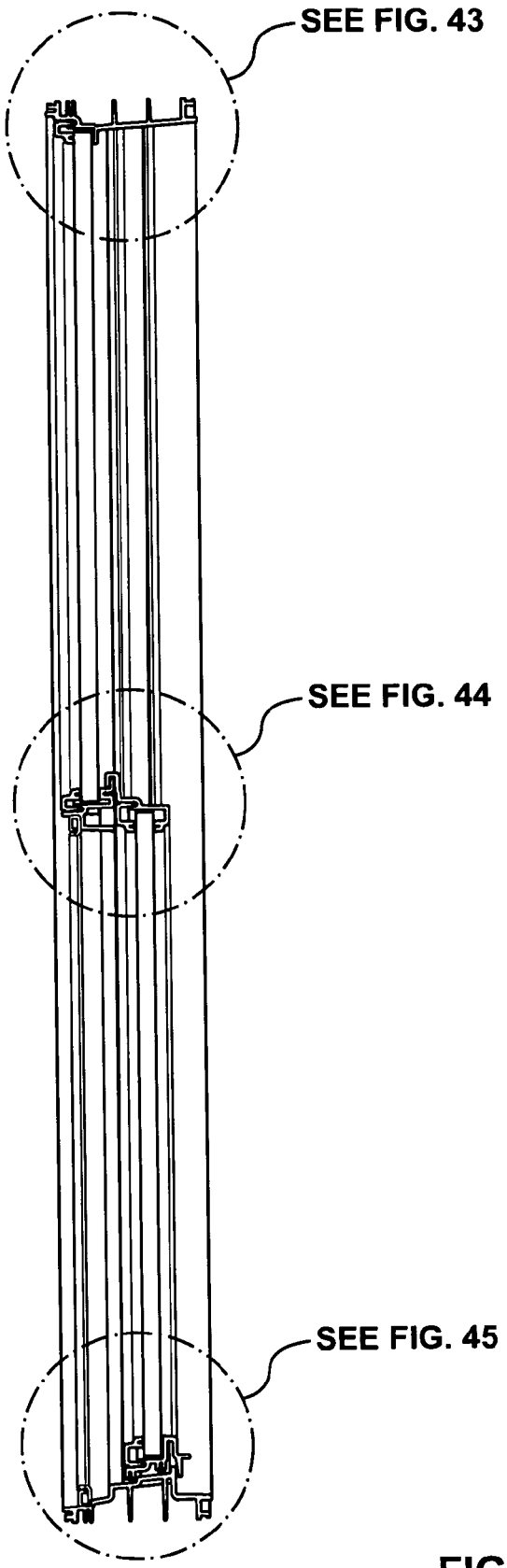
FIG. 40 is a section view of the assembly of FIG. 39 taken along the line 40-40 and with the sash frame moved to a lowered position.

The master frame 612 has an upper horizontal member or header 616, a lower horizontal member or sill 618, and left and right jambs 620 and 622. The master frame 612 also has a mullion 624 that extends in a horizontal direction, parallel to and spaced between the header 616 and sill 618. As seen in FIG. 39, in the embodiment illustrated, the mullion 624 generally divides the master frame 612 into a vent section 626 (below the mullion 624) and a fixed section 628 (above the mullion 624). The fixed section 628 is adapted to support a fixed glazing unit 630 (FIG. 38) extending between the header 616 and the mullion 624, and between the upper portions of the left and right jambs 620 and 622.

The master frame 612 is of one-piece, integrally moulded construction, devoid of any seams or joint lines between contiguous vertical and horizontal members 616, 618, 620, and 622, and the mullion 624. The members of the master frame 612 are shaped and sized to facilitate manufacturing the master frame 612 by a moulding process, such as, for example, injection moulding. The master frame 612 can be constructed of a suitable plastic material, such as polypropylene or a recycled plastics material.

Figure 46:
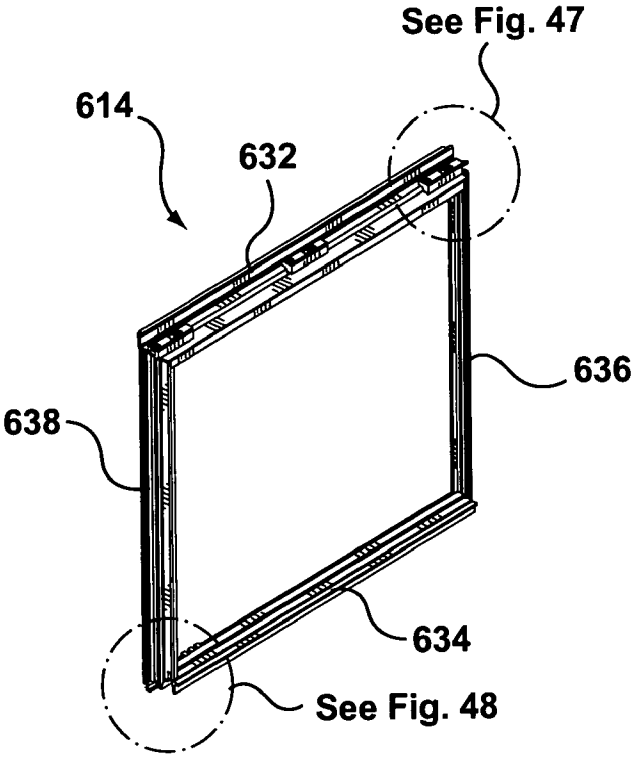
FIG. 46 is an interior perspective view of a sash frame member of the assembly of FIG. 38.

Referring now also to FIG. 46, the sash frame 614 has an upper horizontal member 632, a lower horizontal member 634, and left and right vertical members 636 and 638. The sash frame 614 is, in the embodiment illustrated, also of one piece, integrally moulded construction, and can be constructed of the same material as the master frame 612.

As seen in FIG. 39, each of the jambs 620 and 622 of the master frame 612 has an upper portion 620*a*, 622*a* and lower portion 620*b*, 622*b*, respectively. The upper portions 620*a*, 622*a* extend between the header 616 and the mullion 624, and the lower portions 620*b*, 622*b* extend between the mullion 624 and the sill 618. The upper portions and lower portions of the jambs 620, 622 can have different profiles in cross-section.

Figure 41:
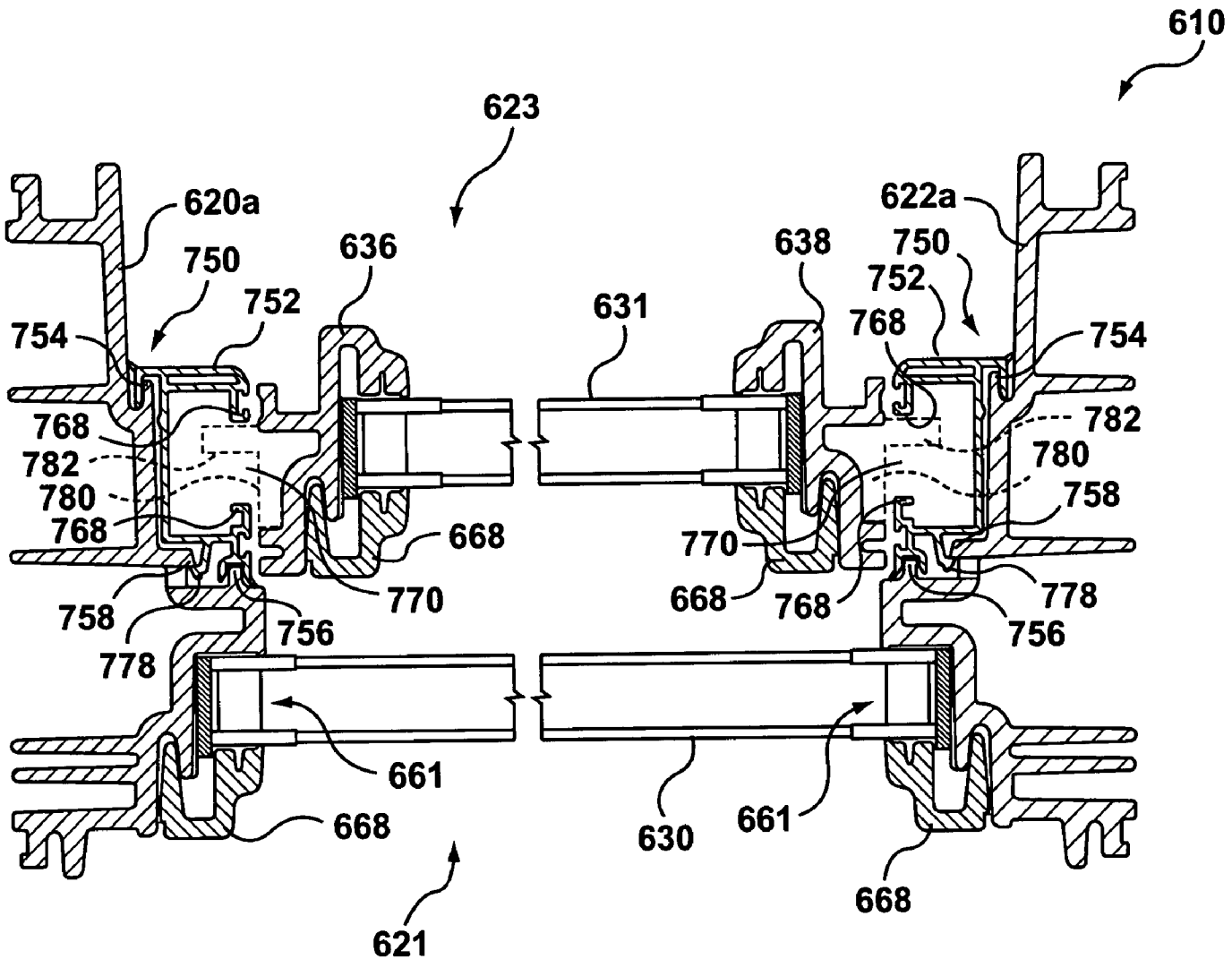
FIG. 41 is a section view of the assembly of FIG. 39 taken along the line 41-41.
Figure 42:
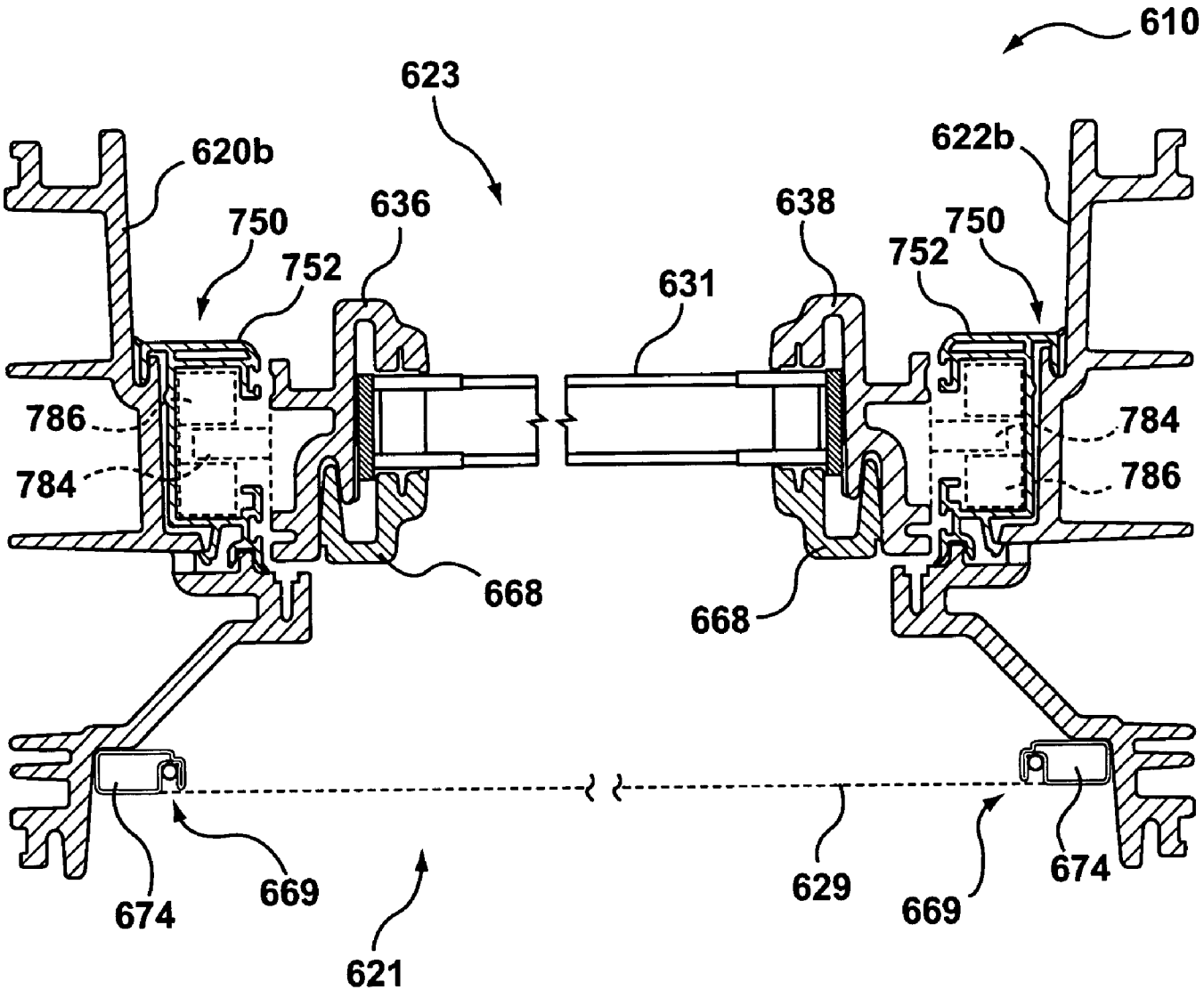
FIG. 42 is a section view of the assembly of FIG. 39 taken along the line 42-42.
Figure 43:
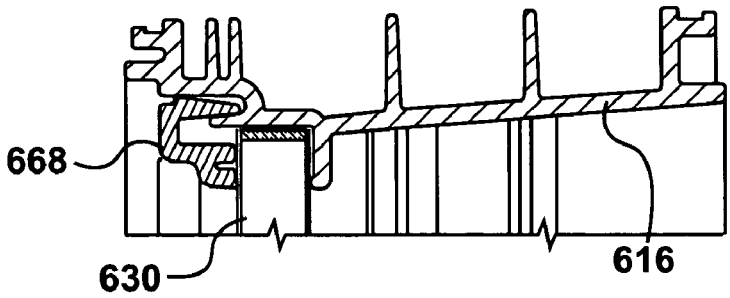
FIG. 43 is an enlarged view of a portion of the assembly of FIG. 40.
Figure 44:
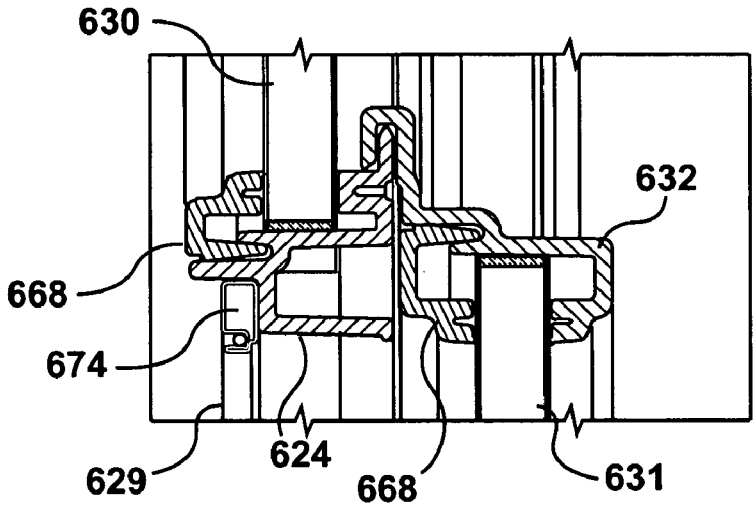
FIG. 44 is an enlarged view of another portion of the assembly of FIG. 40.
Figure 45:
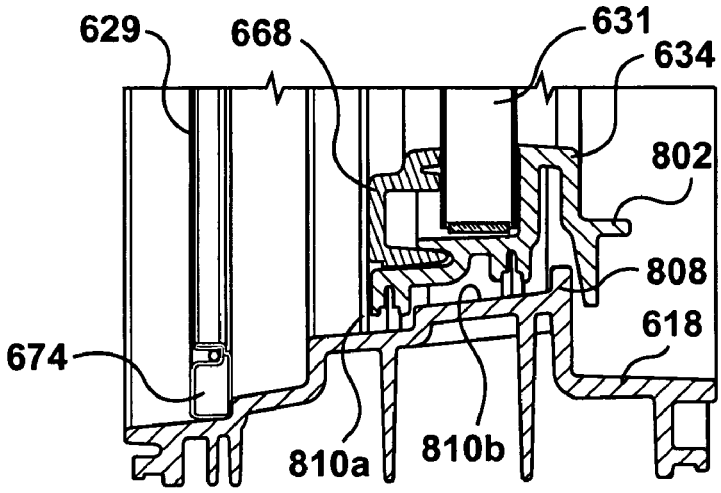
FIG. 45 is an enlarged view of another portion of the assembly of FIG. 40.

Referring now also to FIGS. 41 and 42, in the embodiment illustrated, each upper portion 620*a*, 622*a* has, towards the exterior face 621 of the assembly 610, glazing support features 661 for supporting fixed glazing 630 (FIG. 41). Each lower portion 620*b*, 622*b* has, towards the exterior face 621 of the assembly 610, screen support features 669 for supporting the screen element 629 (FIG. 42). Both the upper 620*a*, 622*a* and lower 620*b*, 622*b* portions of the jambs 620, 622 are provided, towards the interior face 623 of the assembly 610, with liner support features 750 for supporting jamb liners 752.

Figure 49:
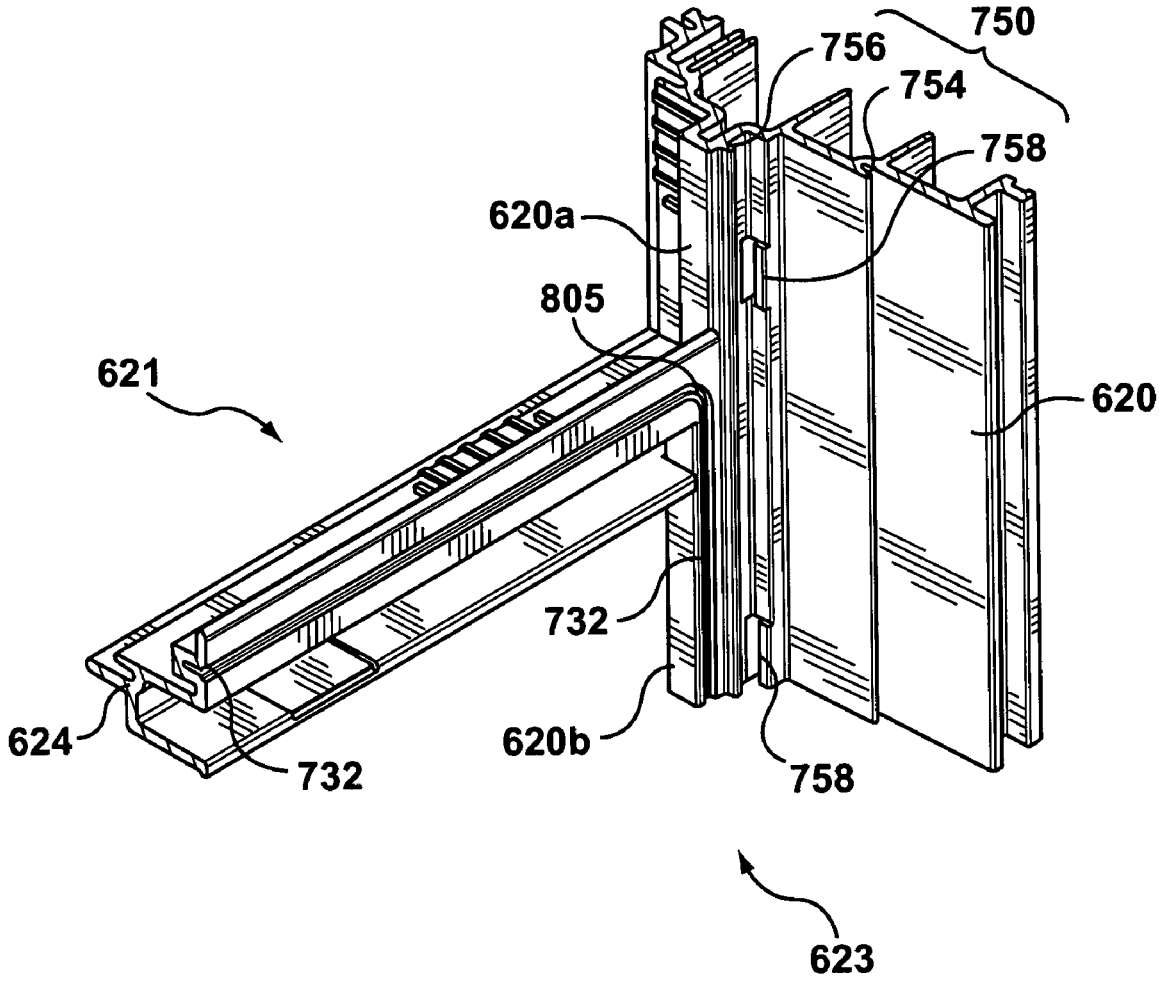
FIG. 49 is an interior perspective view of a portion of the master frame of FIG. 38.

As best seen in FIG. 41, 42, and 49, the liner support features 750 can be adapted to provide snap-fit assembly of the jamb liners 752 to the respective jambs 620, 622. In the embodiment illustrated, the liner support features 750 generally include a first engagement rib 754 and a second engagement rib 756 extending from each of the jambs 620, 622. Both ribs 754 and 756 are generally parallel to each other, perpendicular to the plane of the glazing elements, and directed towards the interior face 623 of the assembly 610. The ribs are offset from each other in two dimensions, the first rib 754 being positioned nearer to the interior face 623 than the second rib 756 (i.e. offset front-to-back), and being positioned laterally further outward (relative to the centerline of the assembly 610) than the second rib 756 (i.e. offset side-to-side).

In the illustrated embodiment, the liner support features 750 further include a locking tab 758 extending perpendicular to the ribs 754, 756 (protruding laterally inwardly), towards the centerline of the assembly 610. The locking tab 758 need not be continuous along the length of the jamb 620, 622, and can be provided in segments of about, for example, but not limited to, 25 mm segments spaced every 200 mm along the length of the jamb. Providing the locking tab 758 in segmented form can facilitate injection moulding of the tabs 758 with the master frame 612, using slides in the injection moulding die to form the tabs 758.

The jamb liners 752 are, in the embodiment illustrated, elongate members provided along the jambs 620 and 622. The jamb liners 752 can be made of an extruded plastic material. The jamb liners 752 provide a jamb track 760 for slidably supporting the sash 614, as is described in greater detail hereinafter. The jamb liners can also be provided with attachment features for attaching the liners 752 to a respective jamb 620, 622 of the master frame 612.

Figure 50:
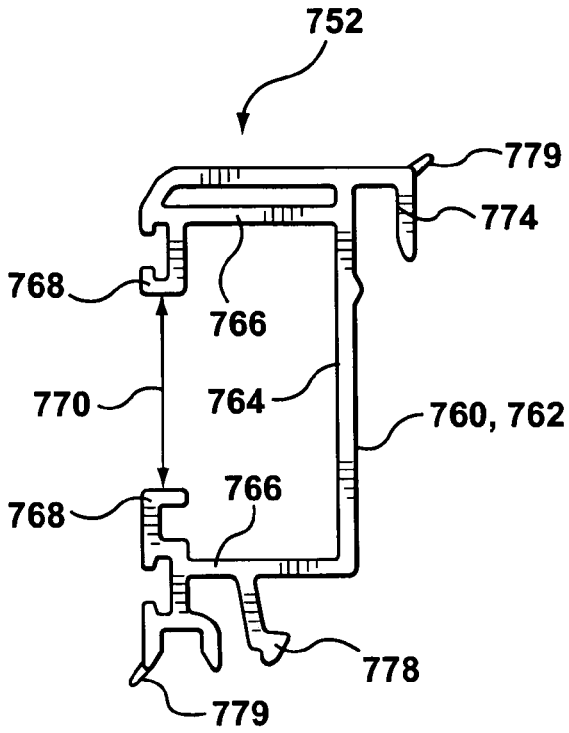
FIG. 50 is an enlarged cross-sectional view of a portion of FIG. 41 showing a jamb liner element in greater detail.

In the embodiment illustrated, and with reference also to FIG. 50, the track 760 of each jamb liner 752 includes a channel 762 that is generally C-shaped in cross-section. The channel 762 includes a base member 764 adapted to be positioned generally flush against an inner surface of the jamb 620, 622, and two opposed side members 766 extending generally orthogonally from the base member 764. A pair of inturned lips 768 extend towards each other from the opposing side members 766 to define an open slot 770 extending between the lips 768 and directed towards the vertical members 636 and 638 of the sash frame 614 (FIG. 41).

The attachment features of each jamb liner 752 include a first groove 774 for engaging with the first engagement rib 754, and a second groove 776 for engaging with the second rib 756. The jamb liner 752 is further provided with a resilient claw 778 extending from a side member 766, adjacent the second groove 756. The claw 778 is inclined slightly relative to the base 764, and hence also relative to the first and second ribs 754, 756 when installed on the jambs 620, 622. The claw 778 is flexibly movable between a closed (or engaged) position and an opened (or disengaged) position, and is biased to the closed position (seen in FIGS. 50 and 51).

The jamb liners 752 can further be provided with flexible fins 779 adjacent the grooves 774 and 776. The flexible fins 779 can be adapted to bear against adjacent surfaces of the jamb 620, 622 to seal against passage of air and/or moisture between the jamb liners 752 and the jambs 620, 622.

Figure 51:
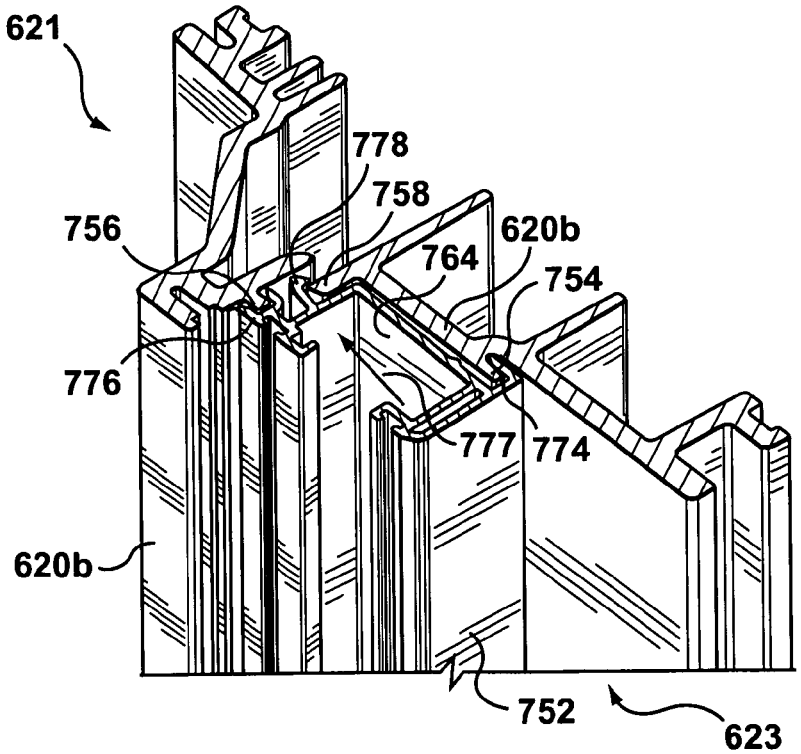
FIG. 51 is an enlarged view of a jamb portion of FIG. 49 shown in combination with an attached jamb liner element of FIG. 50.

Referring now also to FIG. 51, to install the liner 752 onto a jamb 620, 622, the liner 752 can be aligned with the jamb 620, 622 such that first groove 774 of the liner 752 is aligned with the first rib 754 of the jamb 620, 622, and the second groove 776 of the liner 752 is aligned with the second rib 754 of the jamb 620, 622. The liner can then be pressed parallel to the ribs 754, 756 towards the exterior 621 (and in the direction marked by arrow 777 in FIG. 51) so that the ribs 754, 756 are seated in the respective grooves 774, 756. As the liner 752 is pressed into position, the claw 778 can flex (in a lateral direction) over the locking tab 758 of the jamb to the open position, and snap back (laterally) into the closed position behind the tab 758 once the liner 752 is pressed fully into position on the jamb 620, 622. Once installed, the liner 752 cannot be pressed further forward, nor can it move laterally with respect to the jambs 620, 622 because of the engagement of the ribs 754, 756 in the respective grooves 774, 776. Furthermore, the liner 752 cannot be pulled back (opposite the direction of assembly) because of the engagement of the claw 778 and the locking tab 758.

Figure 47:
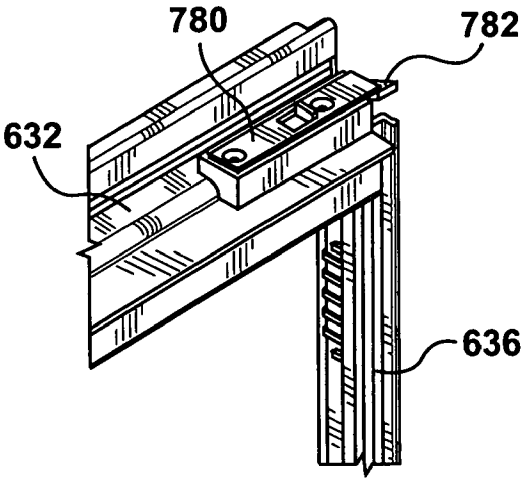
FIG. 47 is an enlarged portion of the sash frame of FIG. 46 showing an upper corner in greater detail.
Figure 48:
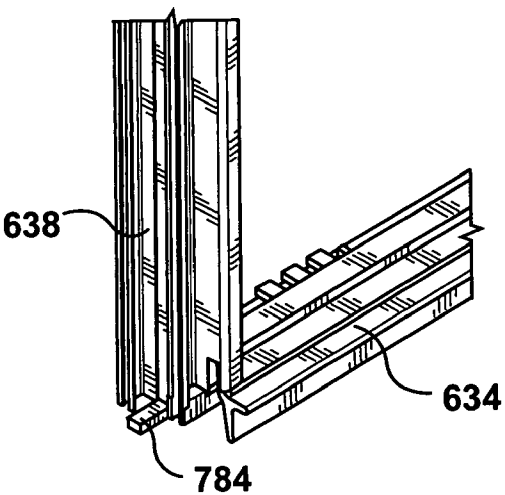
FIG. 48 is an enlarged portion of the sash frame of FIG. 46 showing a lower corner in greater detail.

The method of supporting the sash frame 614 in the master frame 612 will now be described. Referring to FIGS. 41 and 47, the sash frame 614 is provided with a tilt latch 780 at either end of the upper horizontal member 632, providing retractable engagement fingers 782 that can fit between the lips 768 of the slot 780. Referring to FIGS. 42 and 48, the lower end of the sash frame 614 is provided with pivot pins 784 that extend outward beyond either end of the lower horizontal member 634 of the sash frame 614. The pivot pins 784 are also adapted to fit between the lips 768 of the slot 770 in the track 760. The upper and lower horizontal members 632 and 634 of the sash frame 614 can have integrally moulded attachment features for securing the tilt latch 780 and the pivot pin 784 to the members 632 and 634, respectively.

Furthermore, in the embodiment illustrated, the channel 762 of the track 760 is adapted to slidably support a shoe 786 that can be inserted into an open end of the track 760 prior to installing the jamb liner 752 to the jamb 620, 622 (see FIGS.

42 and 52). The shoe 786 is provided with an aperture 788 that is open to, and aligned with, the slot 770. To install the sash, the opposed pivot pins can be inserted into respective apertures 788 of the shoes 786, and the fingers 782 of the tilt latch 780 can be snapped into engagement with the slot 770. The shoe 786 can be connected to a balance 790, such as a spring balance, which can also be positioned in the channel 762 and which can provide a counter balance for the sash 614. In this way, the sash 614 is coupled to the jamb liner 752 for smooth vertical displacement within the master frame 612.

Figure 52:
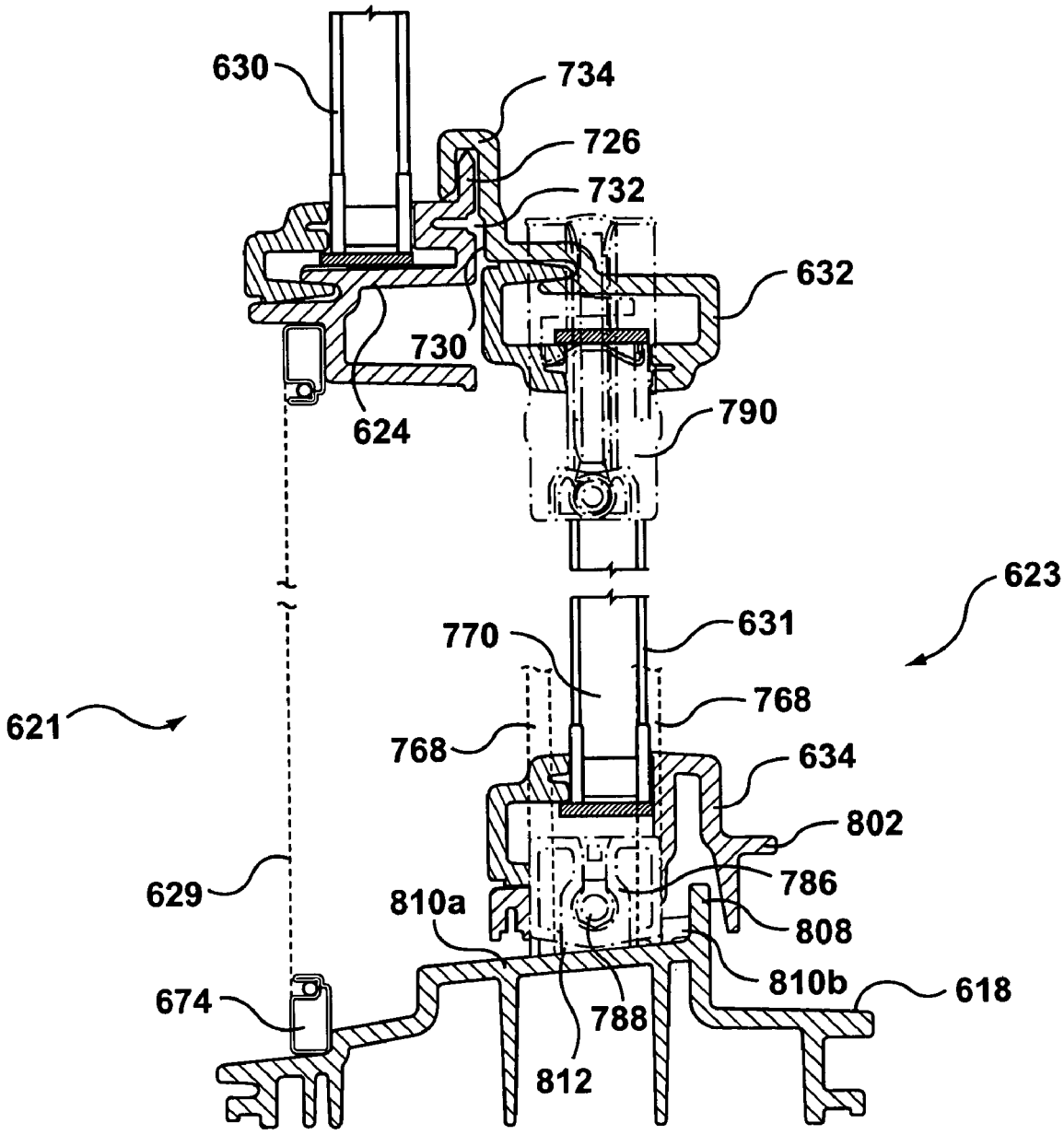
FIG. 52 is an enlarged view of a portion of FIG. 40.

To move the sash frame 614 up and down within the master frame 612, a person can apply a vertical force against the sash frame 614, causing the shoes 786 to slide within the tracks 760 of the jamb liners 752. To facilitate grasping the sash frame 614, the lower horizontal member 634 can be provided with an inwardly directed flange 802 to serve as a handle (FIG. 52).

The frame assembly 610 is also provided with features to improve the strength and performance of the assembly 610, particularly when the sash frame 614 is in a completely closed (lowered) position. Referring again to FIG. 52, the mullion 624 of the master frame 612 is provided with an engagement flange 726. The engagement flange 726 extends generally vertically upwards from the mullion 624, between the interior face 623 and the fixed glazing 630. The upper horizontal member 632 of the sash frame 614 is provided with a cooperating return bracket 734 for engaging with the engagement flange 726 of the mullion 624. In the embodiment illustrated, the return bracket 734 is generally in the shape of an inverted U, and as the sash frame 614 is lowered, the return bracket 734 receive the engagement flange 726. Below the interengaging flange 726 and bracket 734, the mullion 624 can be provided with a seal recess 732 to receive a length of weatherstripping (not shown). The weatherstripping can engage a seal surface 730 provided on a facing surface of the upper horizontal member 632 of the sash frame 614. Any force or windload from the exterior face 621 of the frame assembly 610 is resisted by the interengaging flange 726 and bracket 734, as well as by the weatherstripping in the recess 732.

Furthermore, as best seen in FIG. 49, the seal recess 732 can extend continuously from either end of the mullion 624 downward along the lower portions 620*b*, 622*b* of the jambs 620, 622. The corners 805 where the jamb and mullion portions of the recess 732 intersect can be gently curved so that a unitary length of weatherstripping can extend continuously along the mullion 624 and both lower jamb portions 620*b* and 622*b*. This can advantageously reduce the number of joints between lengths of weatherstripping, which can further improve the sealing performance of the assembly 610.

Figure 53:
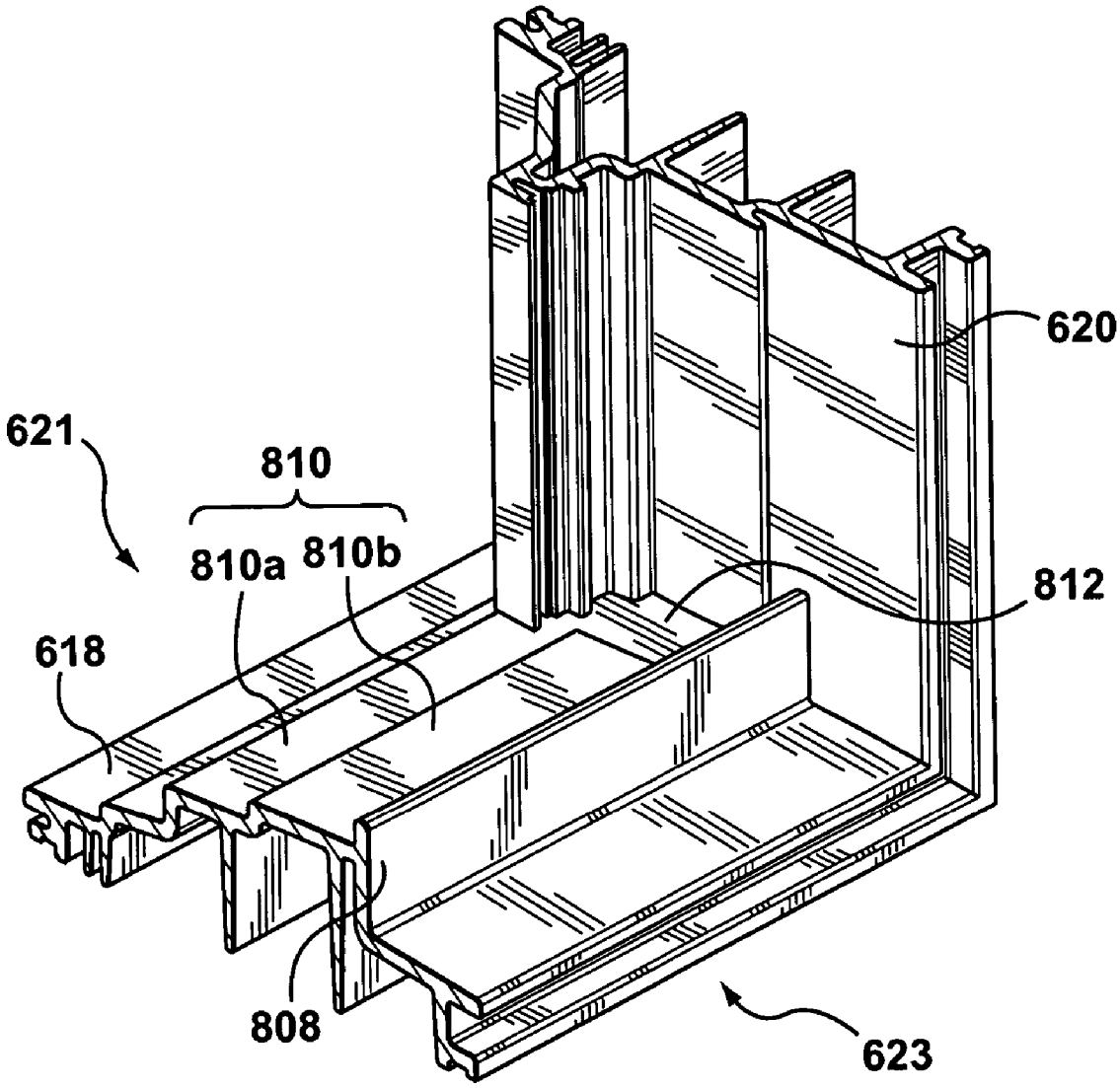
FIGS. 53 and 54 are interior perspective views of a lower portion of the assembly of FIG. 38, without and with an attached jamb liner element, respectively.
Figure 54:
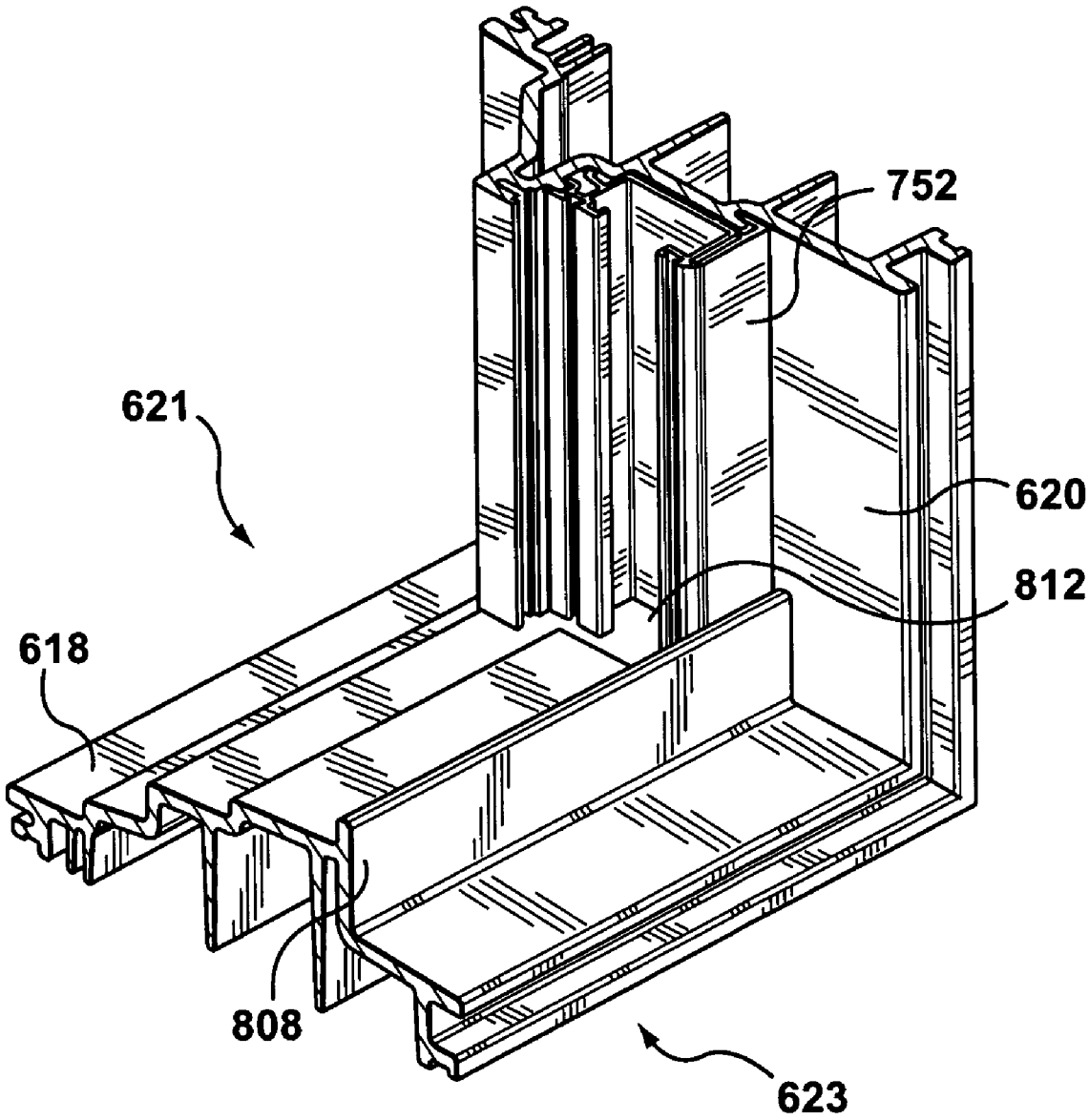

Referring now to FIGS. 53 and 54, the frame assembly 610 can be further enhanced by providing the sill 618 with an upstanding barrier wall 808. In the embodiment illustrated, the barrier wall 808 is a generally vertical wall that extends above the height of the sash abutment surface 810 of the sill 618. The barrier wall 808 is positioned between the interior face 623 of the assembly 610 and the abutment surface 810.

Figure 55:
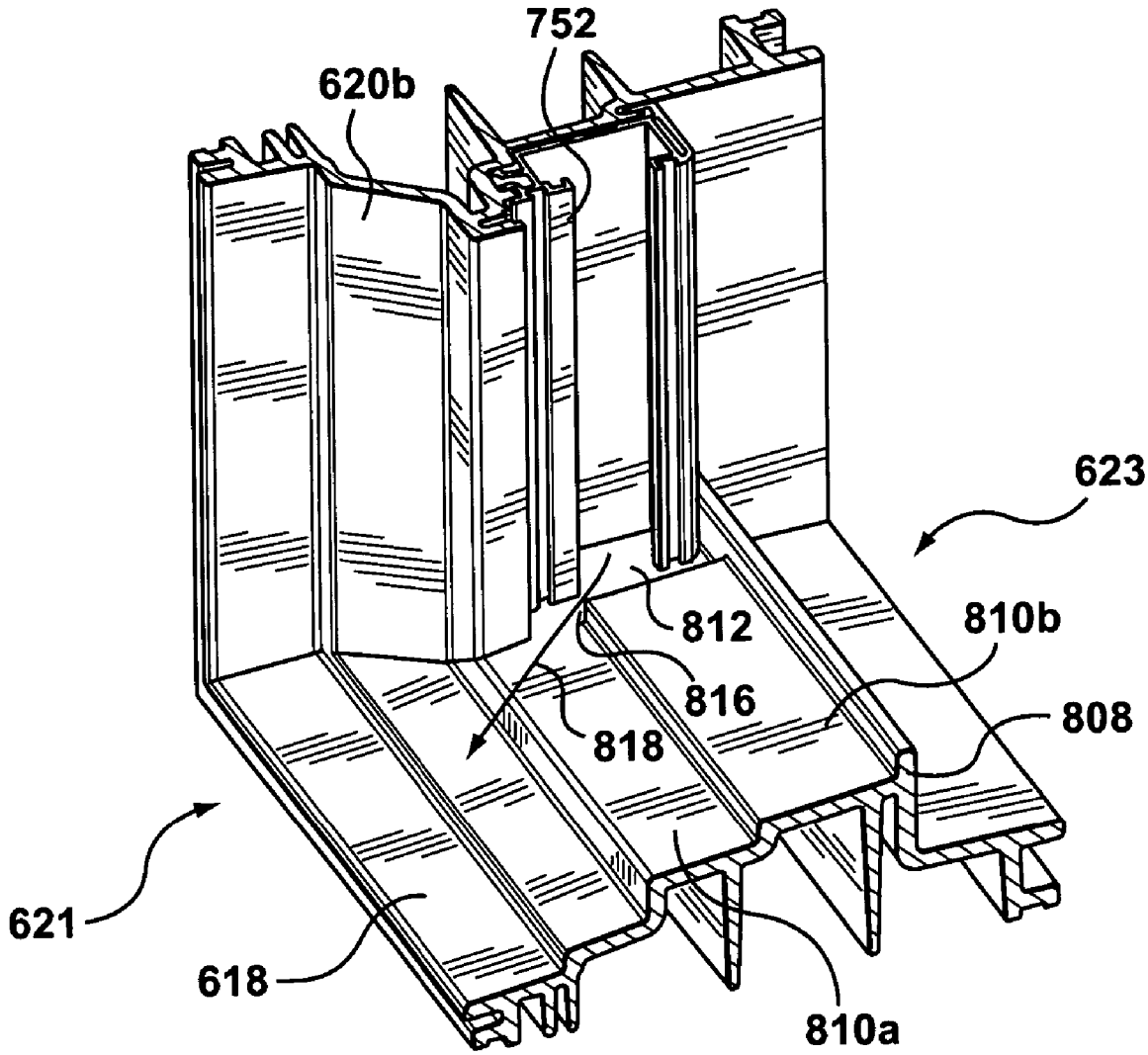
FIG. 55 shows the elements of FIG. 54 from an exterior viewing angle.

The barrier wall 808, the opposing surfaces of the inwardly protruding portion of the jamb 620, 622, and the jamb sidewall extending between the barrier wall 808 and inwardly protruding portion cooperate to define a pocket 812 at either end of the sill 618. As best seen in FIGS. 54 and 55, the pocket 812 can accommodate a lower end of the jamb liner 752, so that the jamb liner 752 is further supported against an inwardly directed force (such as caused by wind loads or attempted forced entry) by the barrier wall 808. As best seen in FIG. 52, the pocket 812 can also be adapted to accommodate the shoe 786 when the sash frame 814 is in the lowered (or closed) position.

The abutment surface 810 can, as in the illustrated embodiment, be stepped, having a lower surface 810*a* and a raised (plateau) surface 810*b*. This can provide dual seal surfaces (see FIG. 45). In the illustrated embodiment, the raised surface 810*b* extends between, but not into, the pockets 812. This can leave a gap 816 between the end of the raised surface 810*b* and the jamb liner 752, providing a passageway for water drainage, as indicated at arrow 818 in FIG. 55.

While preferred embodiments of the invention have been described herein in detail, it is to be understood that this description is by way of example only, and is not intended to be limiting.

We claim:

1. A frame assembly for a window having a vertically sliding sash, the frame assembling comprising:

a) an integrally moulded unitary master frame having upper and lower horizontal members and opposed first and second vertical jamb members extending therebetween, and an integral horizontal mullion extending between the first and second vertical jamb members, the mullion spaced apart from the upper and lower horizontal members;

b) a respective jamb liner affixed to and extending along each vertical jamb member; and, c) an integrally moulded unitary sash frame coupled to the jamb liner, wherein the first and second vertical jamb members each comprise a liner support structure integrally moulded with the master frame for securing the respective jamb liners thereto in snap-fit, and wherein the liner support structure comprises first and second engagement ribs each extending along generally the height of each respective jamb member, each rib having a rib extend protruding orthogonally towards an interior face of the master frame.

2. The frame assembly of claim 1, wherein the liner support structure comprises a locking tab protruding laterally inwardly, perpendicular to the rib extents.

3. The frame assembly of claim 2, wherein the jamb liner comprises first and second grooves for receiving the first and second ribs, and a resilient claw for engaging the locking tab.

4. The frame assembly of claim 1, wherein the master frame comprises liner end pockets in the lower horizontal member adjacent each jamb member for receiving an end portion of each respective jamb liner therein.

5. The frame assembly of claim 4 wherein each pocket is partially defined by an upstanding barrier wall extending between the first and second vertical jamb members, and upward from the lower horizontal member.

6. The frame assembly of claim 5 wherein the lower horizontal member of the master frame comprises a lower and a raised abutment surface against which seal elements of the sash can abut when in the closed position.

7. The frame assembly of claim 6 wherein the raised abutment surface extends between, but not into, the liner end pockets of the lower horizontal member.

8. The frame assembly of claim 2, wherein along each vertical jamb member the second engagement rib protrudes in a direction parallel to the first engagement rib.

9. The frame assembly of claim 8, wherein the first and second ribs are offset from each other in each of a front-to-back and side-to-side direction.

10. The frame assembly of claim 2, wherein the locking tab is provided in spaced-apart segments along each vertical jamb member.

11. The frame assembly of claim 3, wherein the claw is flexibly resilient and is movable from a closed, engaged position to an open, disengaged position.

12. The frame assembly of claim 2, wherein each jamb liner comprises an elongate body of constant cross-section, the body having a base member and a first side member extending from the base and facing an interior face of the window frame, and a second side member extending from the base and facing an exterior face of the window frame, the base and sidewalls generally defining a track for slidably supporting the sash frame.

13. The frame assembly of claim 2 wherein each jamb liner comprises at least one integrally co-extruded sealing fin to bear against the respective jamb.

14. A frame assembly for a window, comprising:

a) an integrally molded unitary master frame having an upper horizontal member, a lower horizontal member, and spaced apart first and second vertical jamb members each extending between the upper and lower horizontal members, the lower horizontal member having an upper surface facing the upper horizontal member, and a first pocket in the upper surface adjacent the first vertical jamb member, and a second pocket in the upper surface adjacent the second vertical jamb member, wherein each pocket is partially defined by an upstanding barrier wall extending between the first and second vertical jamb members, and upward from the lower horizontal member, and wherein the first and second vertical members each include respective integrally moulded first and second liner support structures formed with the master frame;

b) an extruded first jamb liner attached to the first liner support structure of the first vertical jamb member, the first jamb liner having a first track extending along its length and first lower end received in the first pocket;

c) an extruded second jamb liner attached to the second liner support structure of the second vertical jamb member, the second jamb liner having a second track extending along its length and a second lower end received in the second pocket; and d) at least one sash frame vertically slidable within the master frame, the sash frame having a first side coupled to the first track, and a second side coupled to the second track for vertical displacement of the sash frame along the first and second tracks.

* * * * *